United States Patent [19]

Brown

[11] 4,444,536

[45] Apr. 24, 1984

[54] HIGH SPEED WELL WORKING APPARATUS

[76] Inventor: Joe R. Brown, P.O. Box 19310, Houston, Tex. 77024

[21] Appl. No.: 258,923

[22] Filed: Apr. 30, 1981

Related U.S. Application Data

[63] Continuation-in-part of Ser. No. 35,933, May 4, 1979, abandoned.

[51] Int. Cl.[3] ..... E21B 19/00

[52] U.S. Cl. ..... 414/22; 254/106; 294/88; 414/745

[58] Field of Search ..... 414/22, 745, 786; 198/799; 166/77; 175/85; 173/149; 254/31, 106, 199; 24/263 DA, 263 D; 294/88, 102 A; 92/23, 24; 226/173, 167, 162

[56] References Cited

U.S. PATENT DOCUMENTS

| | | | |
|---|---|---|---|
| 2,867,338 | 1/1959 | Simmonds | 414/22 |
| 3,096,075 | 7/1963 | Brown | 24/263 DA |
| 3,265,138 | 8/1966 | Alexander et al. | 414/22 X |
| 3,610,503 | 10/1971 | Pryor | 226/173 |
| 3,759,147 | 9/1973 | Johnsson et al. | 92/24 X |
| 3,797,570 | 3/1974 | Leutwyler | 166/77 |
| 3,999,610 | 12/1976 | Sage | 166/77 X |
| 4,332,062 | 6/1982 | Byrne, Jr. | 24/263 DA |
| 4,348,044 | 9/1982 | Wood | 294/88 |

*Primary Examiner*—Robert J. Spar
*Assistant Examiner*—Donald W. Underwood
*Attorney, Agent, or Firm*—Browning, Bushman, Zamecki & Anderson

[57] ABSTRACT

Disclosed is a rig for working on wells, and including a pair of continuous chains for moving a pair of pipe holders along a mast. Each of the two pipe holders is fixed to a point in each chain. The chains are driven along parallel paths by twin motors with linked drive shafts. The motors are mounted on the top of the mast so that only one side of the closed loop on each chain is loaded when the pipe is being pulled from a well. One of the pipe holders may comprise a snubbing head which may be operated in reciprocal motion for high speed snubbing of pipe into a well.

17 Claims, 51 Drawing Figures

FIG. 8
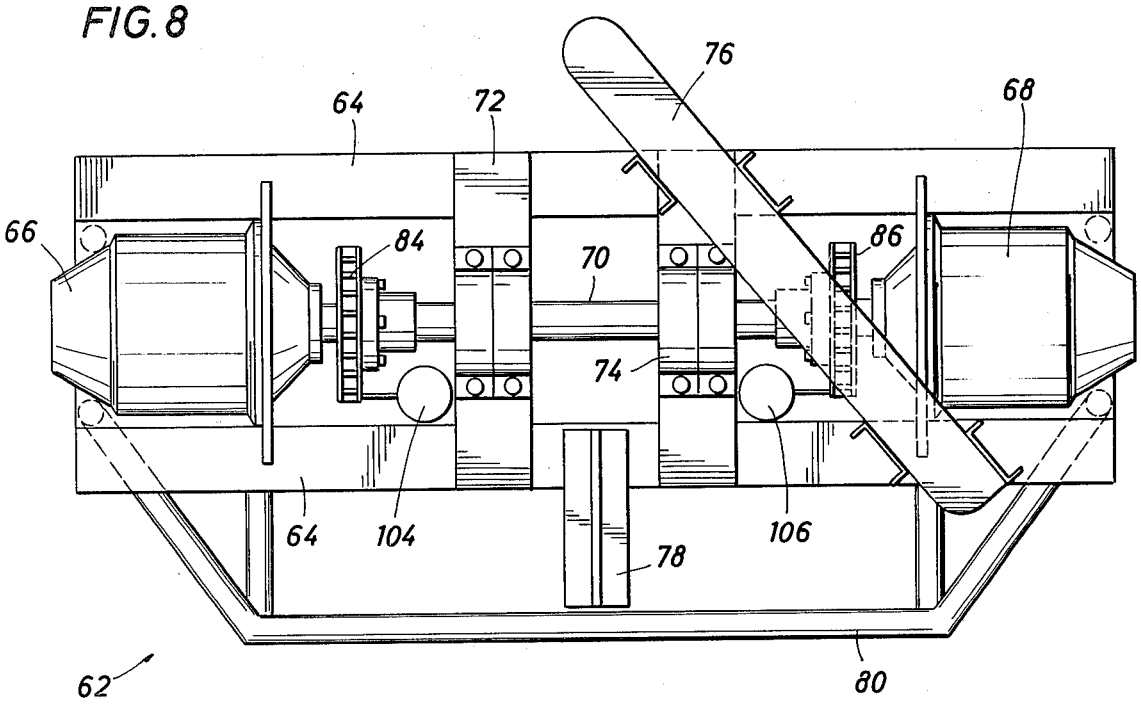
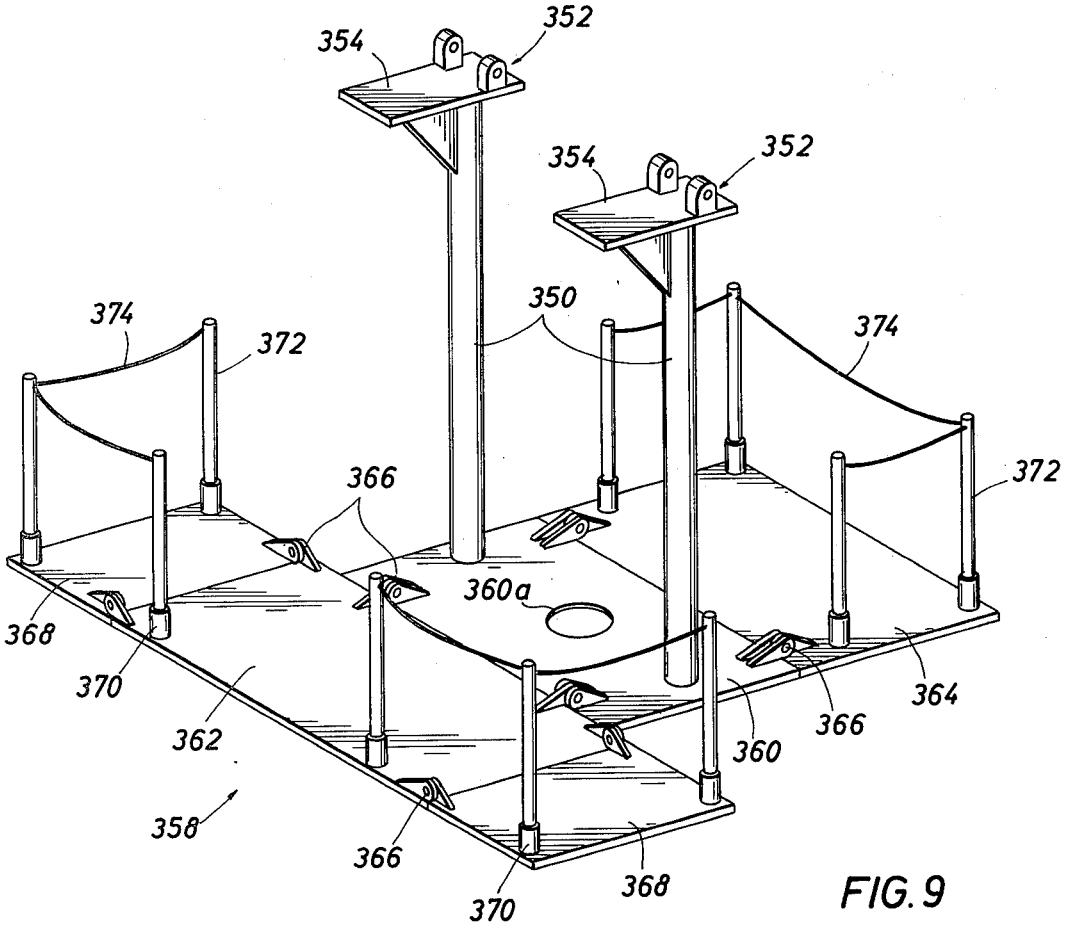
FIG. 9

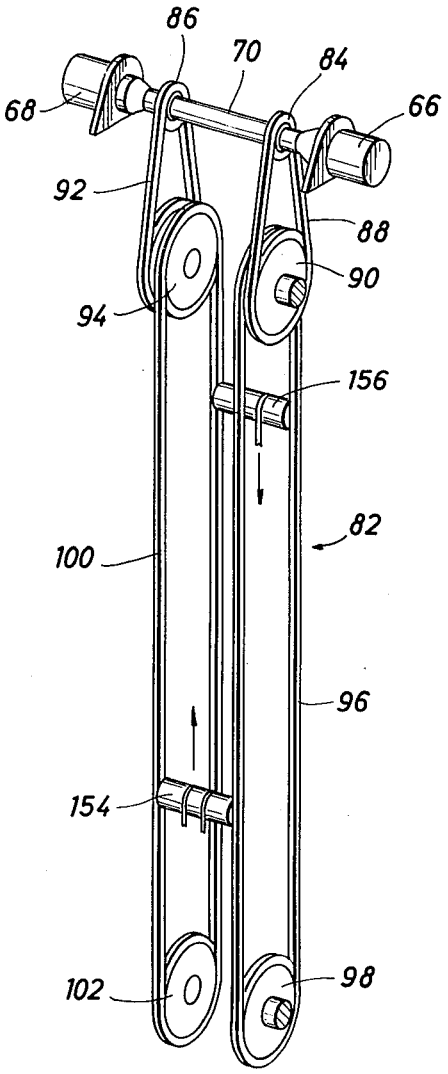
FIG. 10
FIG. 16
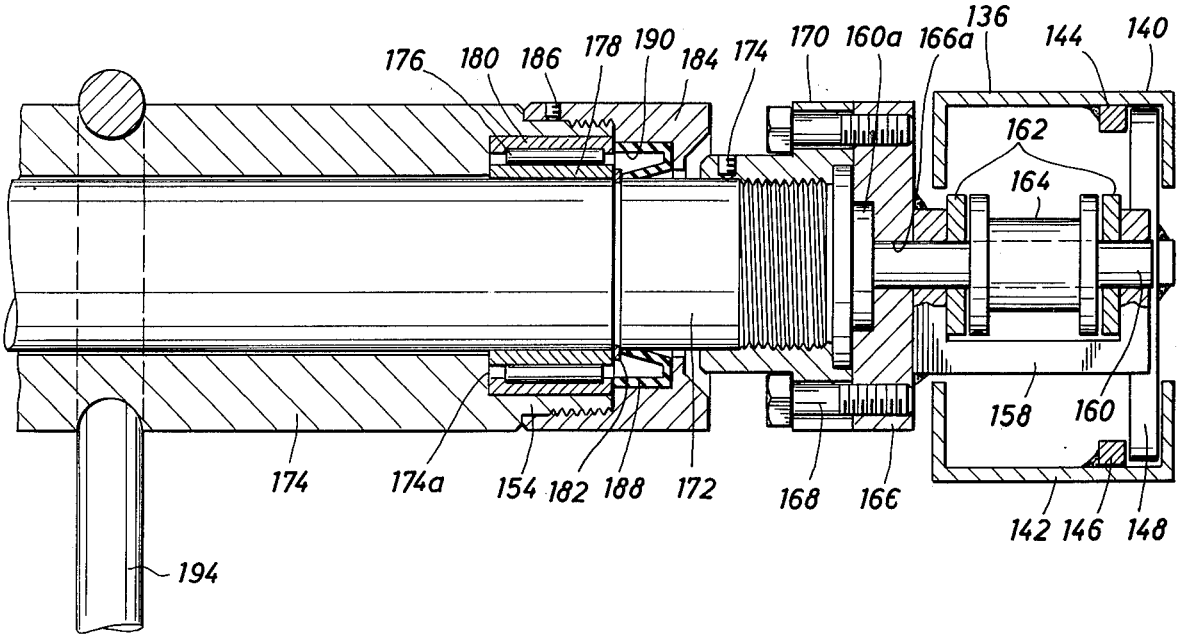

48
42
40
50
56
48
370
56b
288
50
368
56a
366
366
140
48
138
142
144
146
136
136
292
102
158
364
156
154
360a
360
362
294
98
158
136
370
52
290
58a
54
368
58b
52
54
46
44
58
52
370

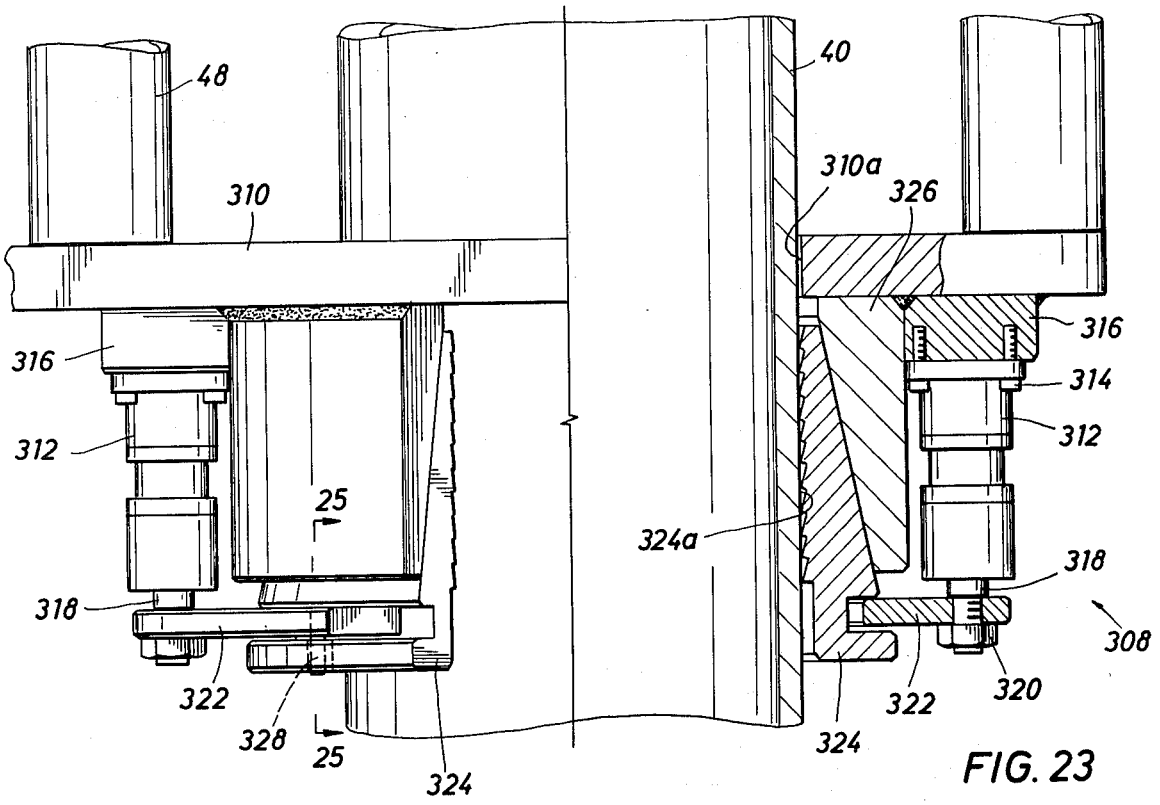
FIG. 23
FIG. 24
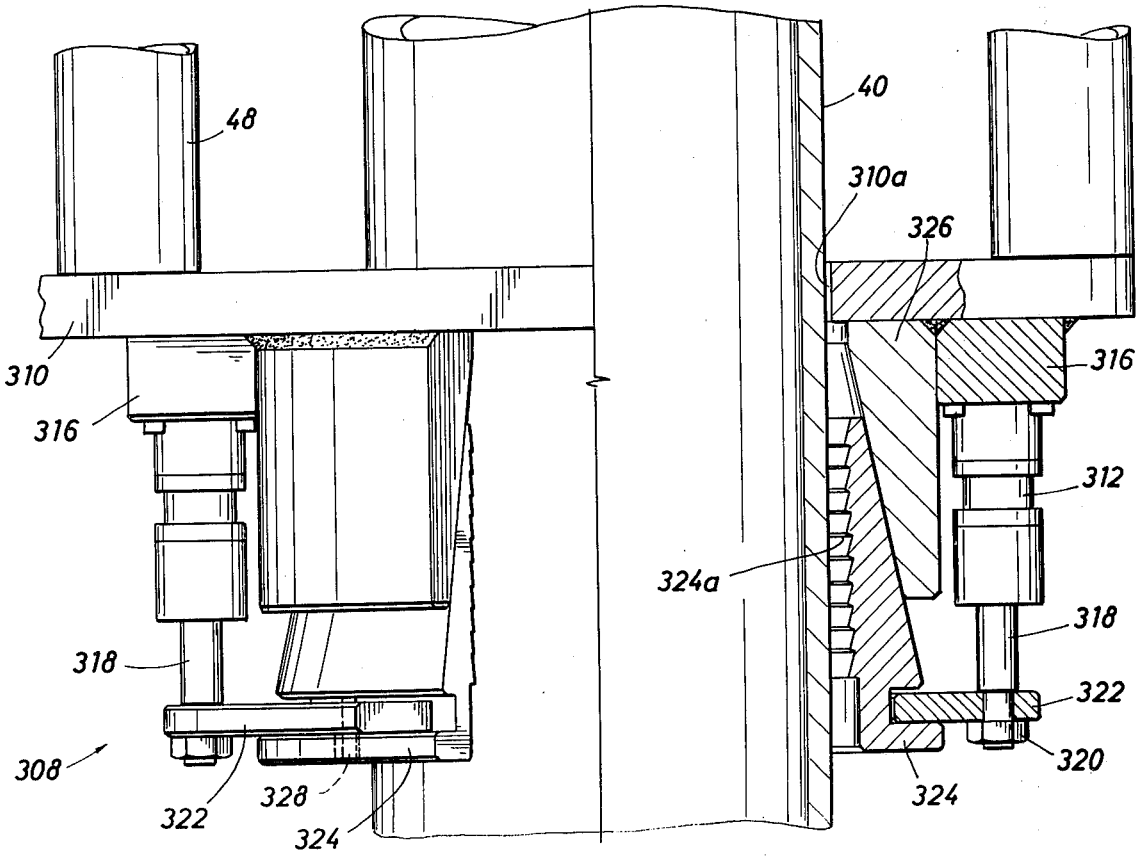

FIG. 26
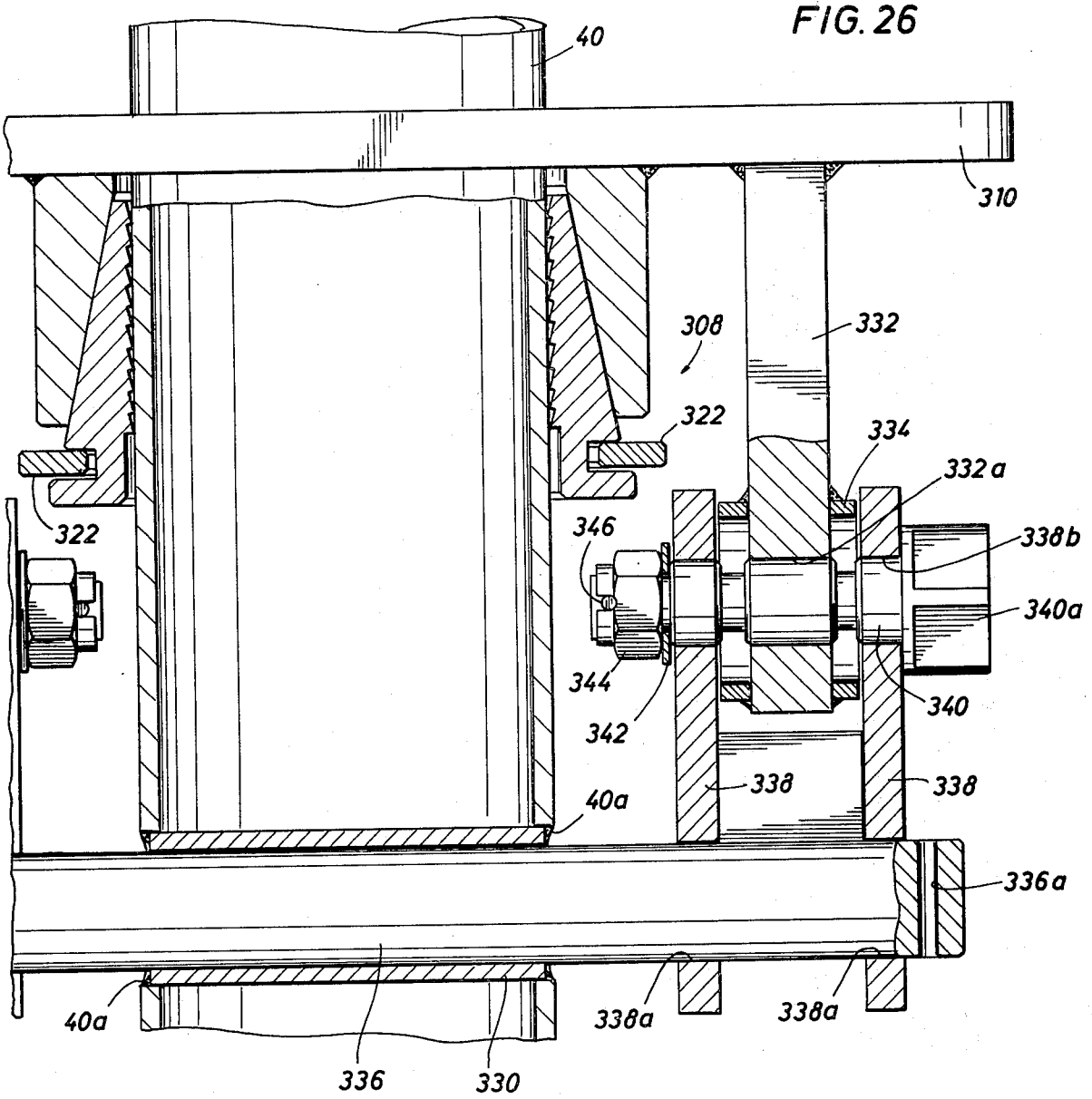
FIG. 25
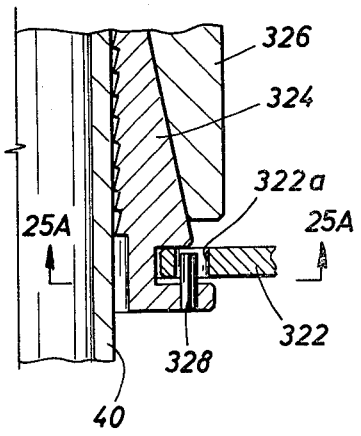
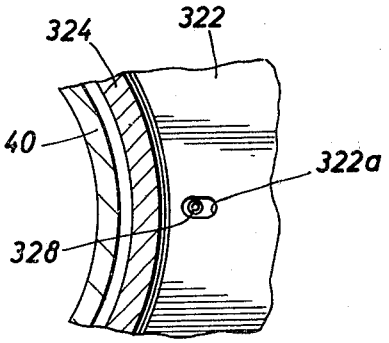
FIG. 25A

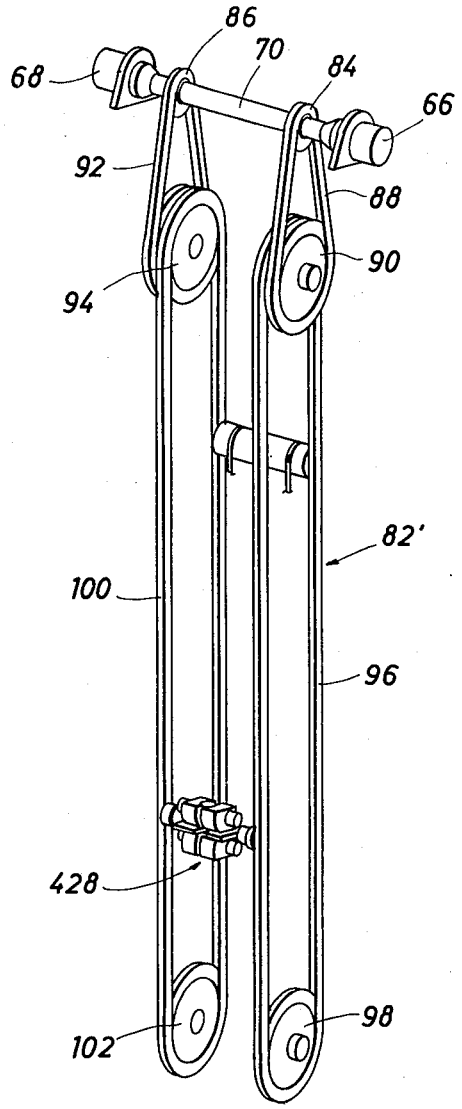
FIG. 35
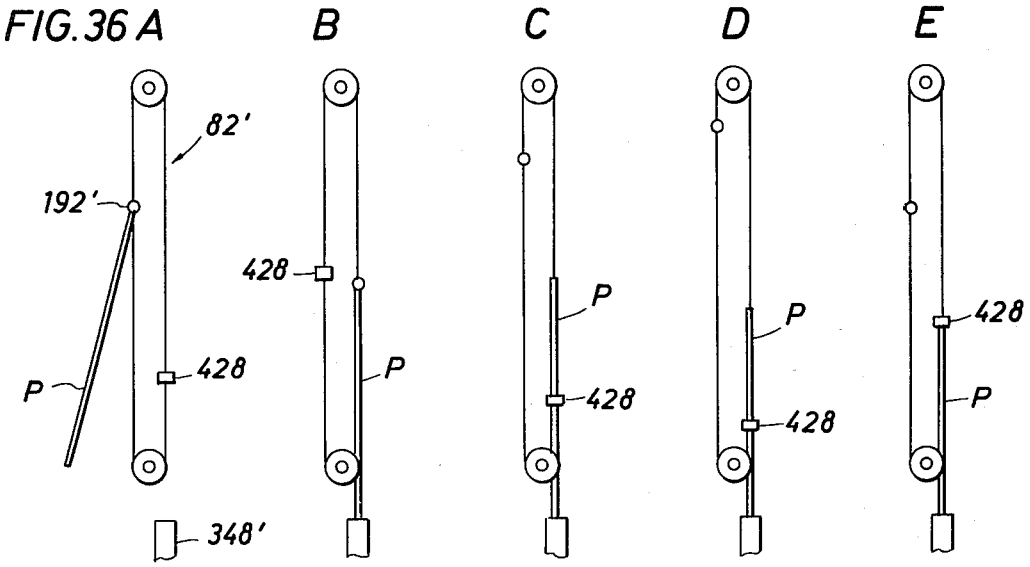

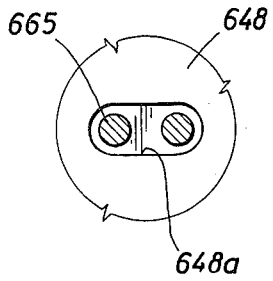
FIG. 45
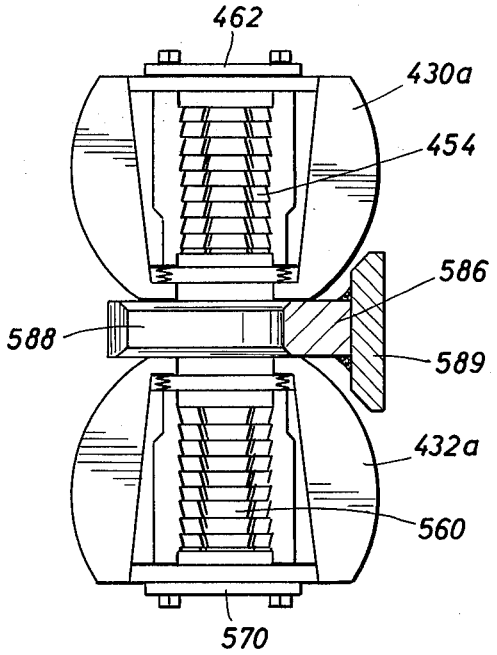
FIG. 40
FIG. 41
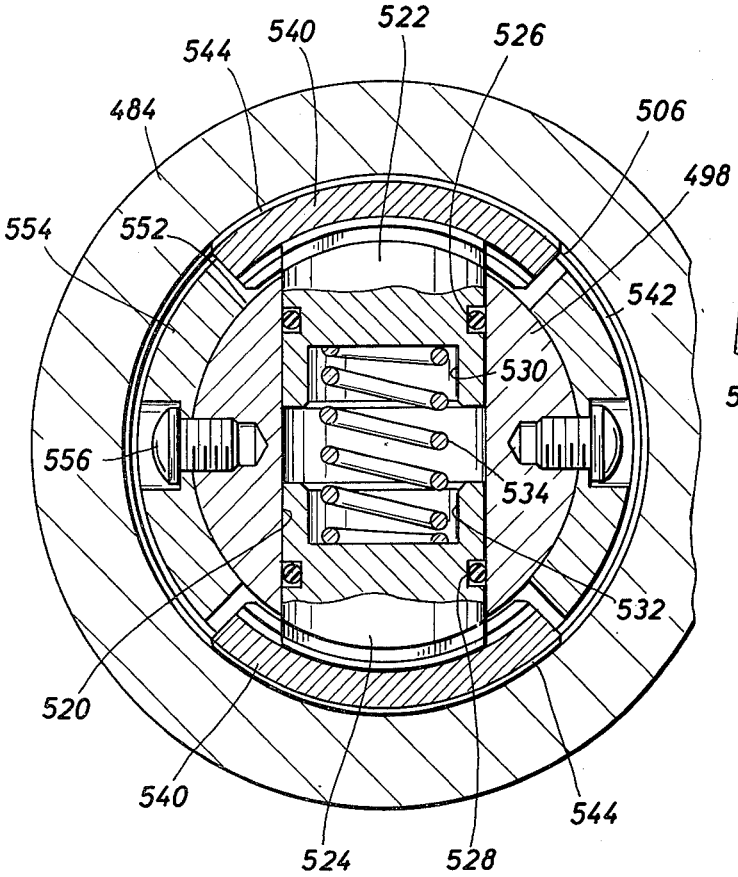
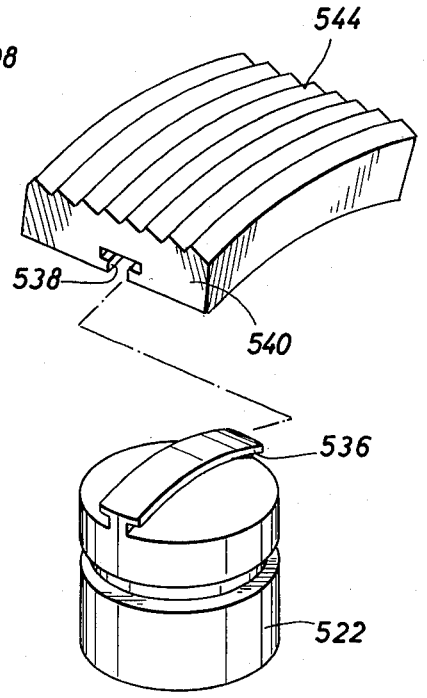
FIG. 42

HIGH SPEED WELL WORKING APPARATUS

This is a continuation-in-part of application Ser. No. 35,933, filed May 4, 1979, now abandoned.

BACKGROUND OF THE INVENTION

1. Field of the Invention

The present invention pertains to apparatus and methods for manipulating tubular members. More particularly, the present invention relates to well working apparatus for manipulating pipe members into and out of wells.

2. Description of Prior Art

Well working rigs of considerable variety are known, and include design features to achieve special purposes. For example, rigs are known with fold-down masts sufficiently lightweight to be transportable by truck to and from well sites. It is desireable, particularly for economic purposes, to be able to transport virtually an entire rig on a single truck, and to be able to configure the mast for operating on a well in a short period of time after arrival at the well site.

Workover rigs, for performing operations on already-drilled wells are generally small compared to rigs used to initially drill wells, and may even take the form of a snubber, a gin pole and a winch line. Such workover rigs are generally transportable by truck. However, such workover rigs may be limited to manipulating a single pipe member at a time as opposed to a drilling rig which can typically manipulate a stand of three pipe members threaded together. Similarly, snubbers used to drive pipe into wells under high pressure well conditions, for example, generally grip and manipulate one pipe member at a time, and operate a stroke length typically of just a few feet. Consequently, a workover rig should be operable to manipulate pipe members rapidly so as to minimize the time required to withdraw a pipe string from a well, or to insert a pipe string into a well.

Copending application Ser. No. 35,848, filed concurrently with the aforementioned application Ser. No. 35,933, discloses apparatus and methods for extending and locking a mast.

SUMMARY OF THE INVENTION

The present invention provides apparatus and methods for rapidly manipulating pipe members, and for manipulating pipe into and out of a well under high pressure well conditions.

Two like closed loop working chains are extended, in generally parallel paths, along a mast between sprocket wheels. At least two hoisting bars link the two chains. Each hoisting bar ends in a link assembly which forms a link in the corresponding working chain. The interior of the mast is open, at least to the extent that the two working chains may be circulated about their respective paths in unison with each other, and with the two hoisting bars moving with the chains.

Each of the two hoisting bars may carry an elevator, or other pipe handling or gripping device. A two-way gripping snubbing head type pipe handling device may be used to operate on high pressure wells, for example. Thus, by engaging a pipe member by one of the pipe handling devices, the pipe member may be raised and/or lowered generally within the lateral extent of the mast by circulation of the two working chains about their respective paths. With each pipe handling device engaging a different pipe member, two pipe members may be maneuvered generally along the mast at the same time, and by the same drive mechanism used to operate the working chains. A snubbing head, mounted on a hoisting bar or in place of one, may be reciprocated vertically over a fixed snubbing head by operation of the drive mechanism to insert pipe into a well by a sequence of strokes, and may also be used to withdraw pipe from a well.

Such a drive mechanism is mounted at the top of the mast, and therefore pulls up on one side of each of the two working chain loops. Consequently, only one side of each of the two chain loops is loaded when force is applied to raise pipe, in contrast to virtually the entire length of each chain being loaded to raise pipe if the drive mechanism were engaging the chains toward the bottom of the mast.

In the embodiments described in detail, the drive mechanism includes a pair of motors, such as hydraulically-operable motors. The twin motors are positioned at the top of a mast, and operate to rotate a shaft assembly supported in bearing-lined brackets joined to the masthead. A pair of relatively short, closed loop drive chains engages small-diameter sprocket wheels on the shaft assembly, and also engages drive wheels coupled with the sprocket wheels engaged by the working chains toward the masthead. Simultaneous operation of the twin motors rotates the shaft assembly, and circulates the two drive chains to circulate, in turn, the two working chains.

The present invention is shown herein included in a truck-mounted workover rig with a foldable and extendable mast. The two hoisting bars are located at generally opposite points about the closed loop of each working chain. The truck is positioned so that, when the mast is erect, the working chains will be in position to move one hoisting bar at a time along a generally vertical straight line path generally aligned with the well axis at the surface. At the same time, the other hoisting bar will be moved along a parallel path, displaced laterally from the well axis.

The hoisting bars are equipped with rotatable, floating mountings by which the pipe handling devices are attached to the hoisting bars. Consequently, although at least a portion of each hoisting bar completes a rotation about its longitudinal axis each time the working chains execute one complete circuit of their respective closed paths, the pipe handling devices, and any pipe members attached thereto, are not required to rotate.

A snubbing head type pipe handler may be mounted on the working chains, generally as a hoisting bar, for example, and includes a pair of slip housings centered about a recess in a central support beam. Each of the slip housings carries a plurality of pipe gripping slip elements for selectively gripping pipe members positioned within the recess. The slip members carried by the upper slip housing may be oriented to transmit upwardly-directed forces to the pipe member, and the slips of the lower slip housing, for example, may be oriented to transmit downwardly-directed forces to the pipe. The upper and lower slip housings may be mutally independently operated. Thus, the snubbing type head may be selectively operated to grip a pipe member and to transmit forces thereto in either vertical sense, for example.

Each slip housing is selectively operable by means of fluid pressure communication to move the slip members into position to grip a pipe member, and out of such pipe-gripping configuration. In the particular embodiments disclosed, each slip housing includes two slip housing members carrying the slip members, and movable along the central beam between an extended configuration relative to the beam recess, in which configuration the slip members do not engage the pipe member, and a retracted configuration in which the slip members are positioned to grippingly engage a pipe member enclosed within the central beam recess.

Each slip housing member is propelled by a fluid pressure piston-and-cylinder assembly, the piston arm of which is anchored to the corresponding slip housing member. With the slip housing in the retracted, pipe-gripping configuration, the corresponding piston arms are locked relative to the respective fluid pressure cylinders. The locking of the piston arms to the cylinders is accomplished by floating pistons, spring-biased to automatically effect locking engagement between the piston arms and cylinders when the piston arms move the housing members to the retracted configuration. Fluid pressure may be applied to move the floating pistons to unlock the piston arms from the cylinders, and to propel the pistons with the attached slip housing members to the extended configuration. Since the locking of the slip members in the retracted, pipe-gripping configuration is effected mechanically, the fluid pressure used to operate the pipe-gripping head may be either gaseous or hydraulic.

The double snubbing head may be mounted on the working chains by rotatable swivel mountings generally after the fashion of the hoisting bars so that the slip housings need not rotate as the working chains are driven to execute complete circuits of their respective closed paths. Alternatively, the rotatability of the snubbing head relative to the chains may be limited for convenience in carrying out snubbing type operations.

A pair of snubbing type gripping devices may be mounted on the working chains in the same manner that the hoisting bars with their related pipe handling devices may be so mounted, as described hereinbefore. Alternatively, one double-headed snubbing type device may be mounted on the working chains in conjunction with a hoisting bar supporting an elevator-type pipe handling device mounted at a generally opposite location on the working chains. Then, the elevator device may be used to transport pipe members between a loading/unloading position and the top of the well while the snubbing type device is used to move the pipe members into and out of the well.

With the present rig pipe members may be manipulated two at a time. Thus, for example, during a process of inserting pipe in a well, one pipe member may be lowered, generally along the well axis, by one pipe handling device moving downwardly with the working chains. At the same time, the other pipe handling device may be engaging a pipe member, and moving it upwardly. When the first pipe member is lowered sufficiently, it may be gripped by a pipe gripping device, such as a snubber, and disengaged from the pipe handling device supported by the hoisting bar. The rotation of the working chains is continued, with the now-empty pipe handling device moved out from over the well, and the second pipe member is positioned in alignment with the well. As the second pipe member is lowered into the well, a subsequent pipe member may be engaged and picked up by the first pipe handling device. Each time a new pipe member is positioned over and lowered toward the well, the new pipe may be rotated to thread it to the last previous pipe member added to the pipe string extending into the well. In this manner, a pipe string may be made up as it is inserted in a well, with relatively little time required for the rotation of the working chains to be held up.

The snubber type pipe gripping head may be utilized to insert pipe into a well. With a pipe member positioned over the well and gripped by a fixed pipe gripping device such as a snubber head, the snubber type gripping device mounted on the working chains may be positioned to grip the pipe member. With the fixed snubber head having released the pipe member, the working chains may then be propelled to drive the snubber head mounted thereon downwardly, with the lower slip housing in retracted configuration and its slip members gripping and transmitting the downward force to the pipe member. After the pipe has been driven partly into the well, the fixed head is operated to grip the pipe member, and the chain-mounted head is released and repositioned at a higher location along the pipe member. The snubber type gripping head then engages the pipe member, and, with the fixed gripping head in release configuration, is operated by means of the working chains to further drive the pipe member downwardly. In this way, the snubbing type head mounted on the working chains may be utilized to stroke pipe members downwardly into wells under conditions wherein the well pressure is sufficiently high to support the pipe string, and even tend to drive it upwardly. Once the balance point of the well has been surpassed, wherein the weight of the pipe string in the well is greater than the upward force generated by the well pressures acting on the pipe string, the upper slip housing may be utilized to grip the pipe and support at least a portion of the pipe string weight while lowering the pipe member into the well.

A working chain-mounted snubbing type head may be utilized in this fashion in conjunction with an elevator-type pipe handling device at the opposite location on the working chains. The elevator device may be used to maneuver the pipe members into position over the well, and to support their weight as they are being threaded to the pipe string. Alternatively, the snubbing head mounted on the working chains may be used to maneuver the pipe members into position in such fashion, with the upper slip housing used to engage and support the pipe members during such manipulation. A single snubber-type gripping head mounted on the working chains may be used to carry out the entire pipe manipulation/pipe insertion procedure. Also, two snubber-type gripping devices may be mounted on the working chains and used to manipulate the pipe members into position over the well in addition to gripping the pipe during the insertion procedure. Then, as the insertion of a pipe member is being completed by one snubber head, the other snubber head may be raising the next pipe member, which is then moved, by the second snubber head, into position over the well and inserted therein by that second snubber head.

The process is generally reversed to removed pipe from a well. In such a case, the sense of rotation of each of the chains is reversed. A pipe member extending above the well is engaged by a pipe handling device, which then raises the pipe string until the top pipe member is raised to a position to be unthreaded from the pipe string. The pipe member is then lowered along the other leg of travel, displaced from the well axis, and removed from the pipe handling device for storage. While the pipe member is thus being lowered, the other pipe handling device has engaged the next pipe member in the pipe string, and is raising the pipe string. When the top pipe member is clear, it is unthreaded and lowered by means of the circulation of the working chains.

Similarly, the process of removing pipe from a well using the snubber type gripping device mounted on the working chains may be effected by generally reversing the procedures described hereinbefore in conjunction with the insertion of pipe members by means of the snubber type head. In circumstances where well pressures tend to drive the pipe string upwardly, the lower slip housing may be utilized to grip and control the ascent of a pipe member out of the well by operation of the working chains. Otherwise, where the pipe member must be lifted, the upper slip housing may be used for such purpose.

Generally, the pipe member is gripped by the chain-mounted snubber head and released by the fixed snubber, or other pipe gripping device. The working chains are then operated to raise the pipe member, after which the fixed pipe gripping device is operated to grip the pipe remaining extending downwardly into the well. The top pipe member is then unthreaded from the remainder of the pipe string, and maneuvered either by the same snubber type gripping device, utilizing the upper slip housing, or by a second chain-mounted snubber head or an elevator-type device, to a position relative to the well from which the pipe member may be further maneuvered to a storage facility, for example. Such pipe removal procedures may thus be effected either by utilizing a single chain-mounted snubber type head, two such pipe gripping devices, or one such snubber type head in conjunction with an elevator-type pipe handler.

The disclosed apparatus thus provides a relatively rapid technique for manipulating multiple pipe segments at the same time by means of a double chain Ferris wheel assembly including pipe handling devices positioned at mutually displaced positions along the chain assembly. The drive motors are positioned at the masthead supporting the chain assembly to minimize the amount of chain length required to be loaded to effect an upward force to raise pipe. A snubbing head carried by the chain assembly may be reciprocated above a fixed pipe gripping device to rapidly stroke pipe into a high pressure well.

BRIEF DESCRIPTION OF THE DRAWINGS

FIG. 8 is a top plan view of the rig mast in vertical orientation, showing the twin motors, taken along line 8—8 of FIG. 4;

FIG. 9 is a perspective view of the work basket in unfolded configuration.

FIG. 10 is a schematic perspective view of the chain and sprocket wheel assembly of the rig;

FIG. 16 is a partial plan view, in partial section, of a hoisting bar showing the connection of the hoisting bar to one of the working chains;

FIG. 23 is a fragmentary side elevation, in partial section, of one mast pole and the corresponding slip cone assembly, taken along line 23—23 of FIG. 22, showing the slip cones in anchoring configuration;

FIG. 24 is a view similar to FIG. 23, but showing the slip cones in release configuration;

FIG. 25 is a fragmentary side elevation, in partial section, showing the linkage of a slip cone, taken along line 25—25 of FIG. 23;

FIG. 25A is a bottom plan view of the fragment of FIG. 25, taken along line 25A—25A of FIG. 25;

FIG. 26 is a fragmentary view similar to FIG. 23, but showing the locking of a traveling pole to a gin pole;

FIG. 35 is a schematic perspective view of the chain and sprocket assembly similar to FIG. 10, but including a double snubbing head;

FIGS. 36A through 36E are schematic diagrams of a pipe member in various stages of being manipulated by the chain-mounted snubbing head of FIG. 35;

FIG. 40 is a vertical cross section of the dual snubbing head, taken along line 40—40 of FIG. 38;

FIG. 41 is an enlarged, fragmentary vertical cross section of the snubbing head driving cylinder, taken along line 41—41 of FIG. 38, and showing details of the double locking piston;

FIG. 42 is an exploded, perspective view of a locking piston head and cap;

FIG. 45 is a vertical cross section, taken along the line 45—45 of FIG. 39, illustrating the pins and slot used to limit rotation of the snubbing head.

DESCRIPTION OF PREFERRED EMBODIMENTS

The present invention is included in apparatus for manipulating pipe members shown in FIGS. 1–45 as a chain operated Ferris wheel type well working rig mounted on a truck bed. The well working rig is shown at 10 in FIGS. 1–7, with details shown in FIGS. 8–26, 35 and 37–45. The manner of operation of the well working rig 10 is illustrated in FIGS. 27–29 and 36A–36E. Details of the adjustable mounting of the rig skid on the truck bed are provided in FIGS. 30–33. A hydraulic system for operating the rig is shown schematically in FIG. 34. FIGS. 35–45 particularly illustrate details of the construction, mounting and use of the high speed snubbing head.

Figure 1:
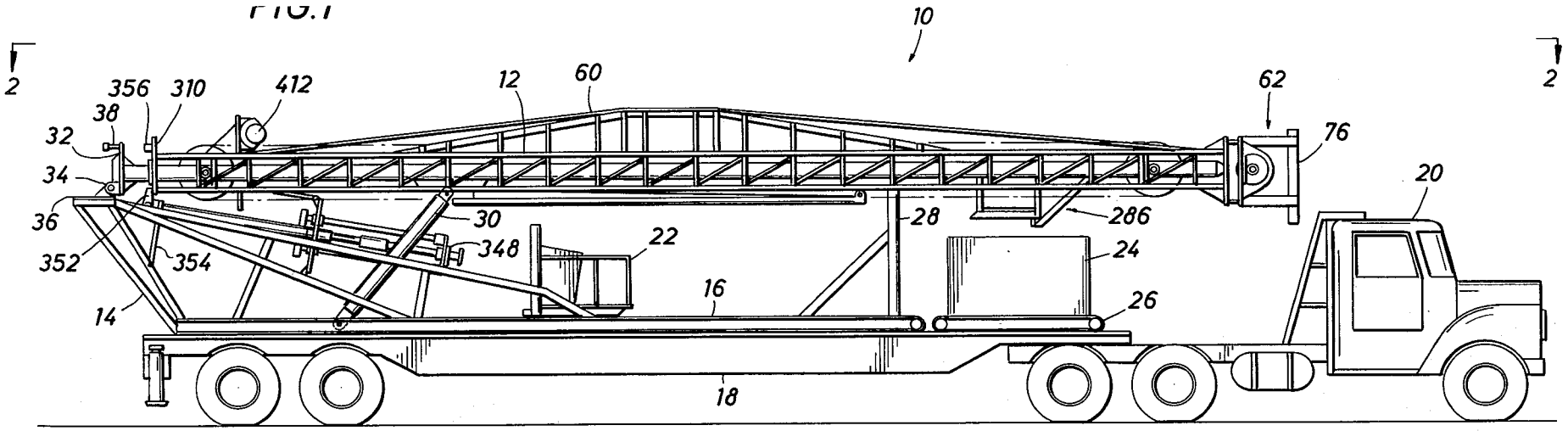
FIG. 1 is a side elevation of a chain drive, Ferris wheel type well working rig mounted on a truck bed and in collapsed and folded configuration.
Figure 2:
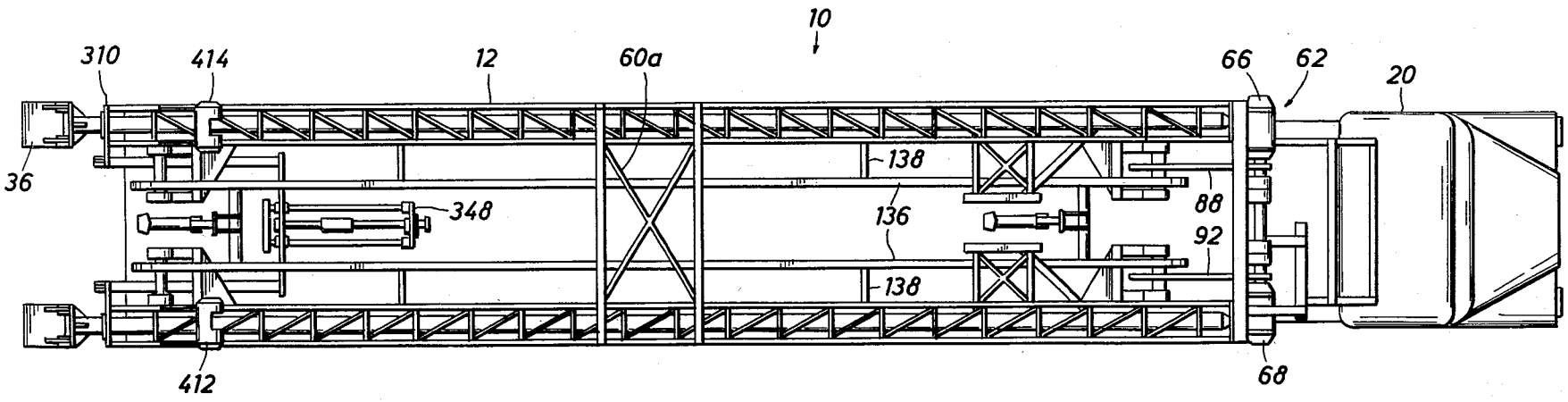
FIG. 2 is a top plan view of the well working rig as shown in FIG. 1, taken along line 2—2 of FIG. 1.

The well working rig 10 includes a mast 12 mounted, by means of a substructure frame 14 on a skid 16. The skid 16 is supported on a flatbed 18 propelled by a fifth-wheel type truck 20. In FIGS. 1 and 2 the mast is shown in a collapsed and folded configuration, extending forward over the flatbed 18. A control console assembly 22 is also supported by the skid 16 (FIG. 1). A power assembly 24 is mounted on a separate skid 26 which is supported by the forward end of the flat bed 18.

As seen in FIG. 1 the substructure framework 14 extends beyond the back end of the skid 16. In the collapsed and folded configuration, the mast 12 also rests on a support framework 28 positioned on the forward portion of the skid 16.

Figure 3:
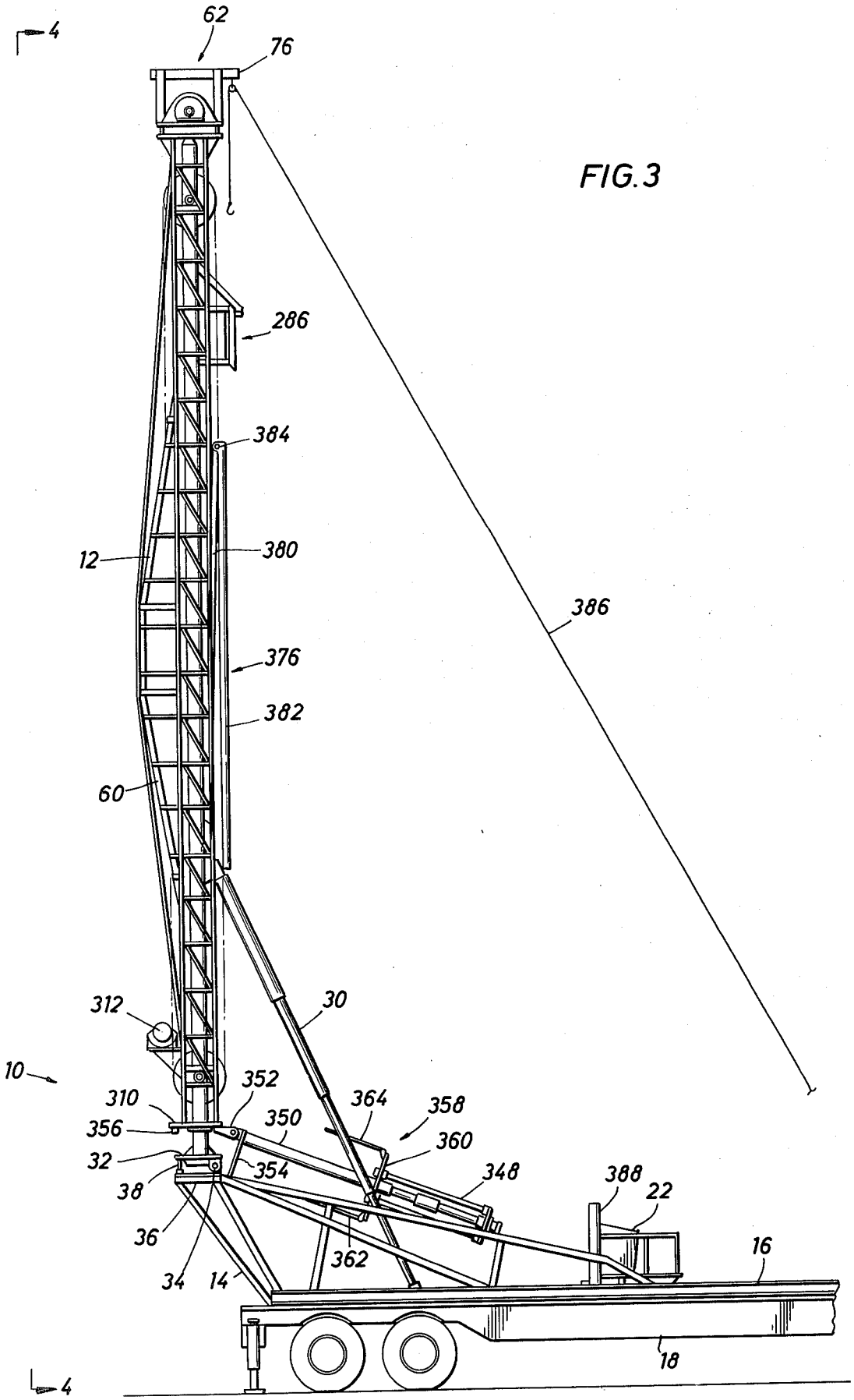
FIG. 3 is a partial side elevation of the rig of FIGS. 1 and 2, showing the mast erect.
Figure 4:
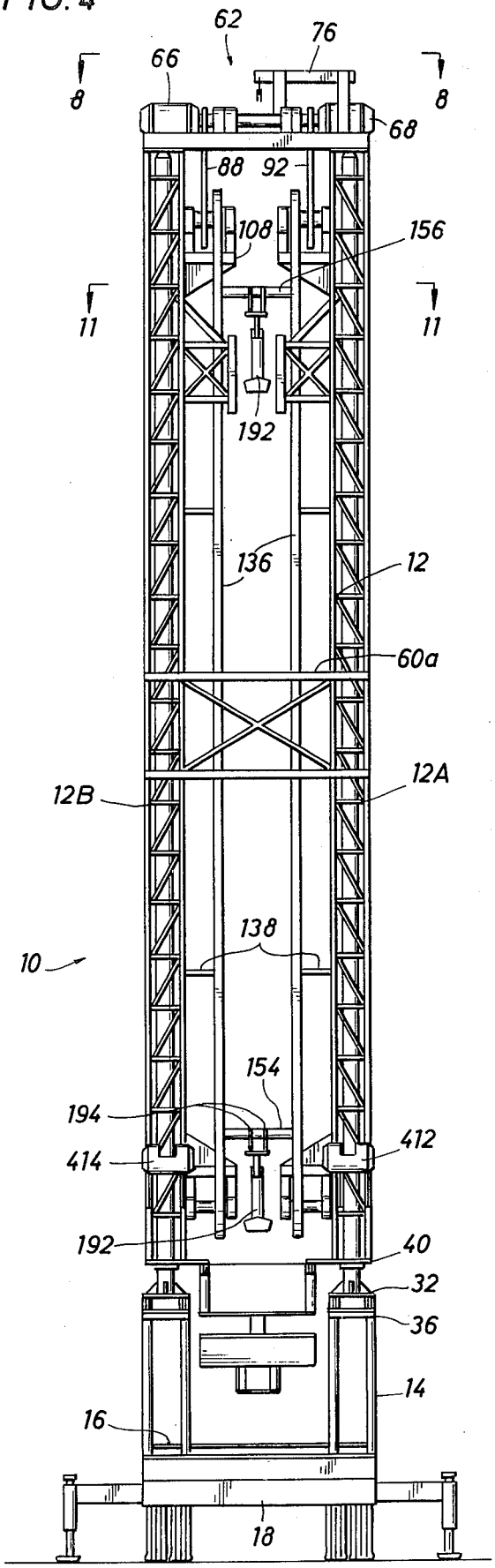
FIG. 4 is an end elevation of the vertical mast taken along line 4—4 of FIG. 3.

In FIGS. 3 and 4 the mast 12 is shown in an erect, collapsed configuration. The mast 12 is erected by operation of a pair of three stage piston-and-cylinder assemblies 30 which are hingedly connected to both the skid 16 and the mast 12. The bottom of the mast 12 includes a pair of feet 32 which are pivotedly connected by hinge pins 34 to a pair of flat plates 36 forming the top of the substructure framework 14. Adjustable pins 38 extend from the feet 32 to form support points in contact with the flat plates 36 when the mast is in the erect configuration, in addition to the hinge pin connections 34. Swing bolts (not shown) may be used to latch the feet 32 to the flat plates 36 when these elements 32 and 36 are closed upon each other in the mast-erect configuration. The mast 12 is then locked in the erect configuration.

Figure 7:
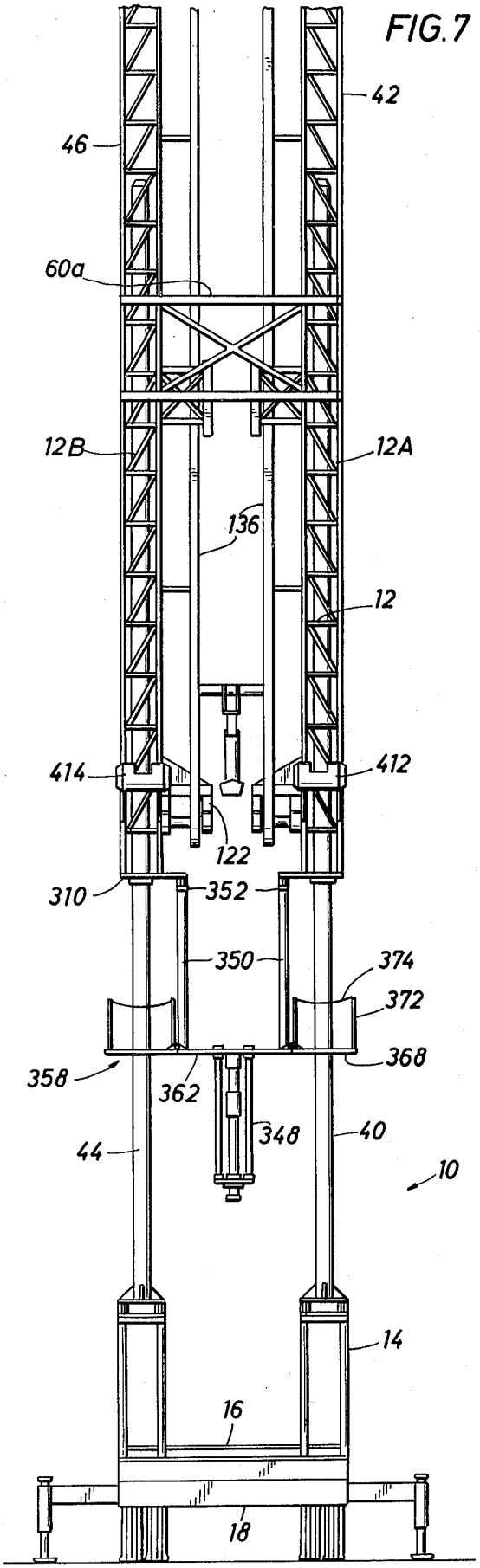
FIG. 7 is an end elevation of the rig mast extended in vertical configuration, taken along line 7—7 of FIG. 6.
Figure 5:
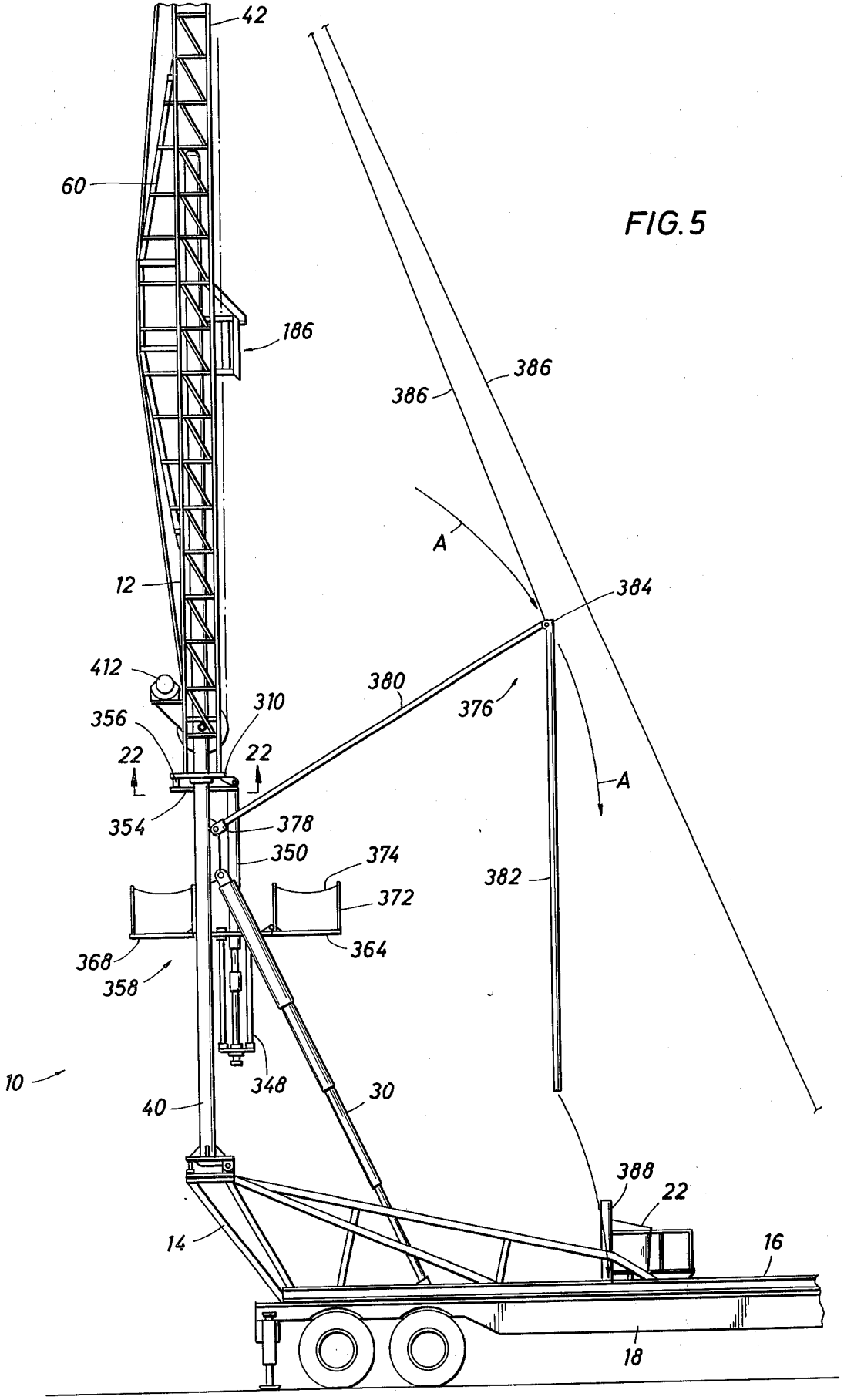
FIG. 5 is a partial side elevation of the rig mast extended in vertical configuration, with the work basket unfolded, the control console legs partially lowered, and a snubber suspended in vertical orientation.
Figure 6:
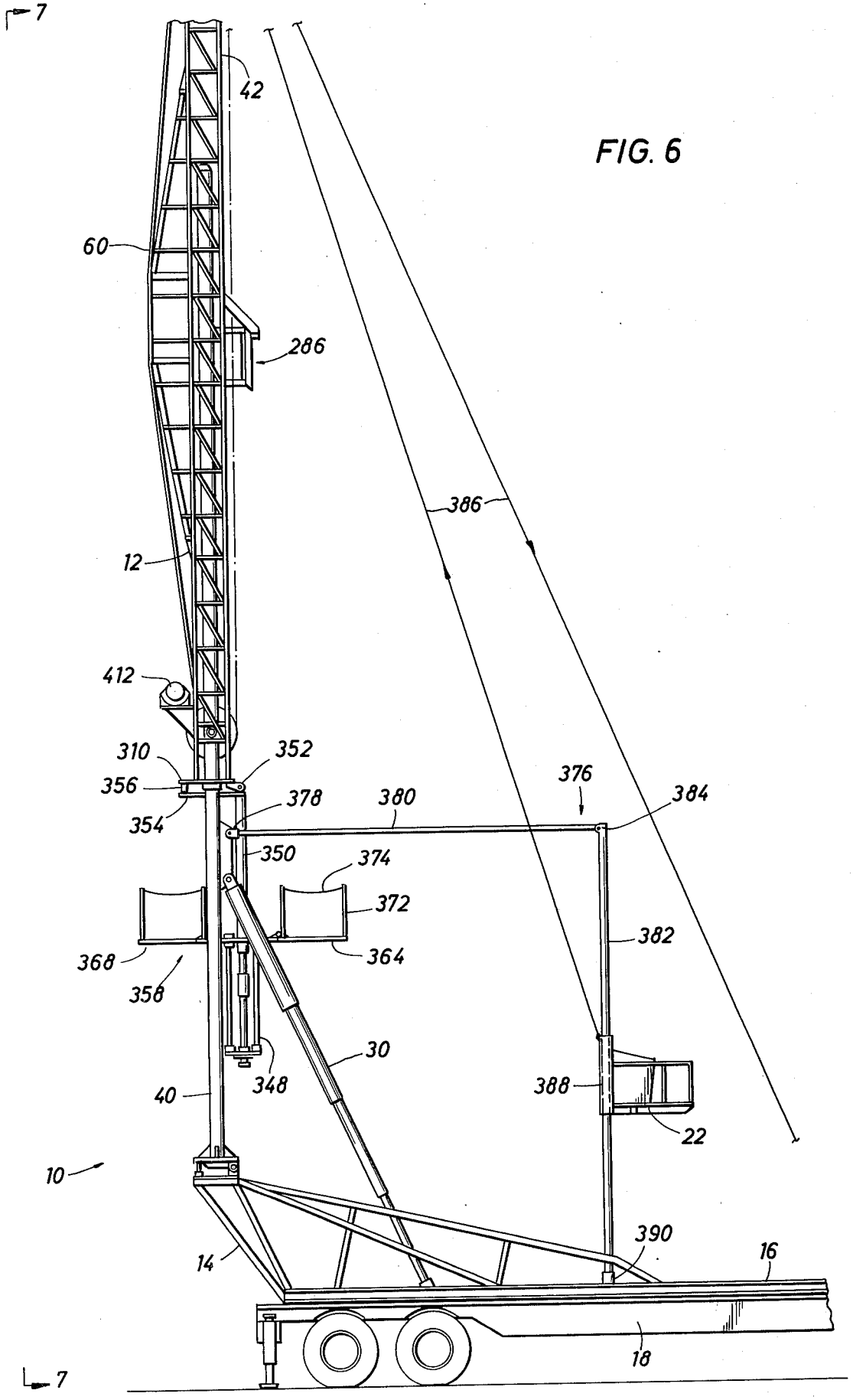
FIG. 6 is a view similar to FIG. 5, but showing the control console raised on the lowered control console legs.

The mast 12 may be extended upwardly as shown in FIGS. 5–7. The manner of extending the mast is dicussed in detail hereinafter. As may be appreciated by reference to FIGS. 3–7, the mast 12 includes generally two legs 12*a* and 12*b*, each such leg being constructed in two sections. Thus, the leg 12*a* includes a gin pole 40 and a traveling pole 42. The leg 12*b* includes a gin pole 44 and a traveling pole 46. Each of the gin poles 40 and 44 are generally elongate cylindrical members having at their lower ends the feet 32. Each of the traveling legs 42 and 46 features generally four elongate tubular members fastened together with a network of cross pieces and struts. Construction of the traveling poles may be further appreciated by reference to FIG. 11. The traveling pole 42 includes the four hollow elongate members 48 joined by cross pieces 50. Similarly, the traveling pole 46 includes four hollow elongate members 52 joined together by cross pieces 54.

A plurality of centering plates 56 is arrayed generally throughout the length of the traveling leg 42, with each centering plate joined to each of the tubular members 48. Each centering plate 56 includes an arcuate opening 56A generally concentric with the periphery of the plate, and a generally V-shaped passage 56*b* leading to the opening 56*a*. The arcuate opening 56*a* in each plate 56 is sufficiently large to receive the elongate gin pole 40. However, the passage 56*b* is sufficiently narrow at the intersection with the arcuate opening 56*a* to confine the gin pole 40 within the arcuate opening. A similar plurality of centering plates 58 is likewise positioned along the length of the traveling pole 46, joined to the tubular members 52. An arcuate opening 58*a* receives the gin pole 44. A V-shaped passage 58*b* of design similar to 56*b* also leads to the arcuate hole 58*a* in each plate 58.

Each of the traveling poles 42 is thus composed of a framework of tubular members, centering plates, and cross pieces and struts. A truss assembly 60 adds rigid support to the back of both traveling poles 42 and 46, and includes cross members 60*a* (FIGS. 2, 4 and 7) whereby the traveling poles are interconnected.

The traveling poles 42 and 46 are also interconnected at their respective top ends by a masthead assembly shown generally at 62, and illustrated in detail in FIG. 8. The masthead assembly 62 includes cross members 64 linking the ends of the two traveling poles 42 and 46. Two motors 66 and 68 are mounted on the cross members 64 with their respective drive shafts aligned generally along the same axis transverse to the traveling poles 42 and 46. A coupling shaft 70 connects the drive shafts of the two motors 66 and 68, and is constrained within brackets 72 and 74 connected to the cross members 64. The coupling shaft 70 rides within suitable bearings contained within the brackets 72 and 74.

A pulley support frame 76 extends generally across the masthead assembly 62 and provides support points, extending beyond the cross members 64, for pullies utilized with winch lines, as described hereinafter. A second pulley support 78 (FIG. 8) extends outwardly from the cross member 64 at the back of the masthead 62. A protective bumper 80 (FIG. 8) may be constructed to extend outwardly beyond the rearward cross member 64 to protect the masthead assembly, particularly during transit.

The motors 66 and 68 are utilized to operate a double-chain Ferris wheel type drive assembly, shown schematically at 82 in FIG. 10. A pair of sprocket wheels 84 and 86 is carried by, and held fixed against rotational motion relative to, the motor drive shafts and the coupling shaft 70. A continuous drive chain 88 engages the sprocket wheel 84 and also engages a double-rim, or double wheel, sprocket driver 90. A similar drive chain 92 links the sprocket 86 with a double-rim drive sprocket wheel 94. A continuous working chain 96 engages the inner rim sprocket of the driver 90 and extends downwardly to engage a sprocket wheel 98. Similarly, a continuous working chain 100 engages the sprockets of the second, or inner rim of the driver 94 and extends downwardly to engage a sprocket wheel 102. Operation of the two motors 66 and 68, which motors may be hydraulically operable, is synchronized. Thus, both motors may be operated off of the same power source and through the same hydraulic feed lines, for example. Thus, virtually zero speed differential may be maintained between the two motors 66 and 68. Consequently, operation of the chain and sprocket wheel assembly 82 is carried out with the sprocket wheels 84 and 86 rotating in unison. Therefore, the drivers 90 and 94 rotate in unison, and the wheels 98 and 102 are rotated in unison. Consequently, the working chains 96 and 100 are pulled, by means of the drivers 90 and 94, respectively, about the wheels 98 and 102 in the same rotational sense and at the same rotational rate. Therefore, for any given point in the working chain 96 moving along the continuous path defined by the configuration of the chain 96, there is a corresponding point on the working chain 100, moving at any moment in a path paralleling that of the first point on the working chain 96, and in the same direction and at the same rate. The sprocket wheels 84 and 86, and the drive chains 88 and 92, are maintained in a lubricated state by means of gravity feed oilers 104 and 106, respectively, mounted on the masthead assembly 62 (FIG. 8).

Figure 11:
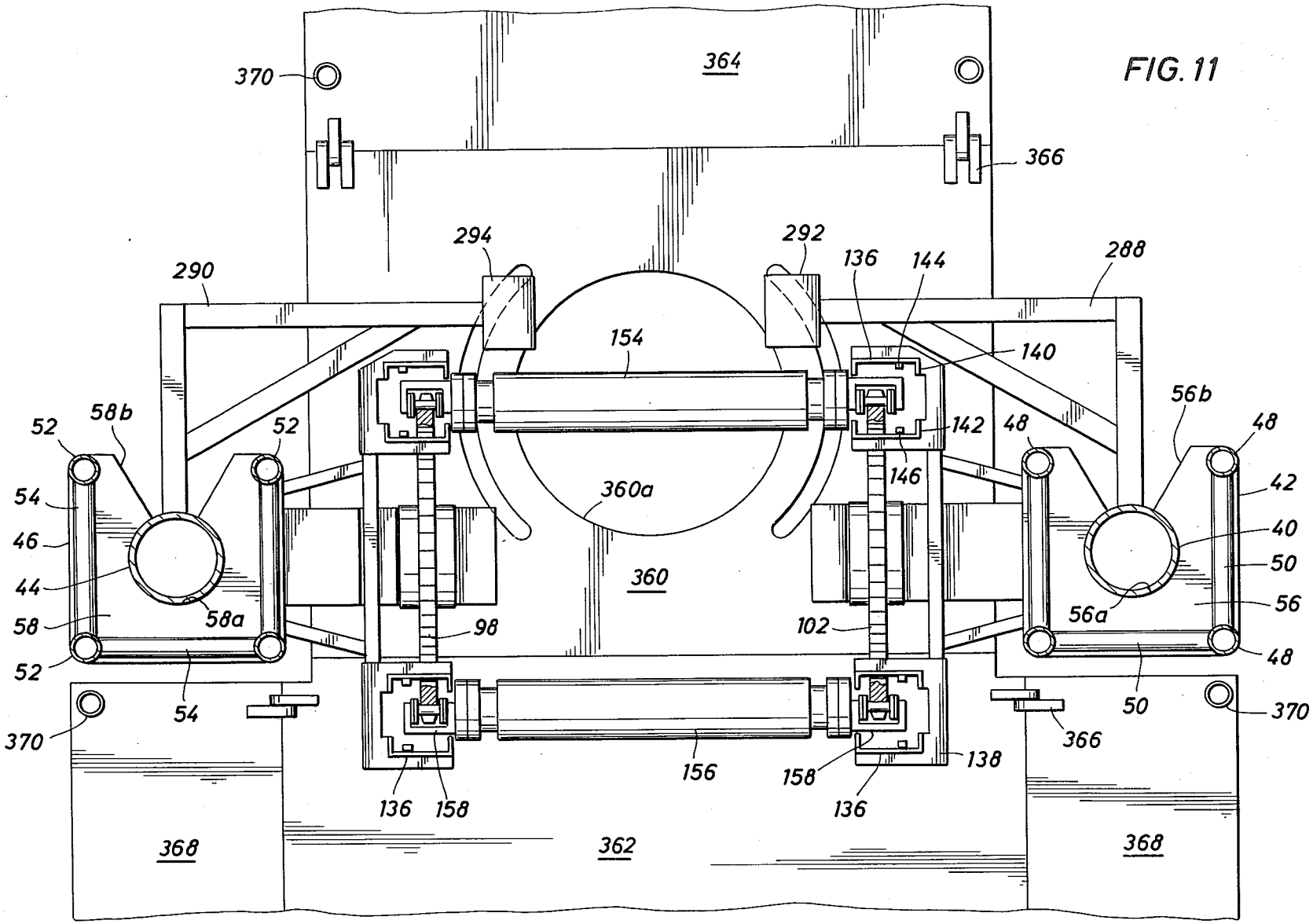
FIG. 11 is a horizontal cross section of the mast in vertical orientation, taken along line 11—11 of FIG. 4, showing the mast pole construction.
Figure 13:
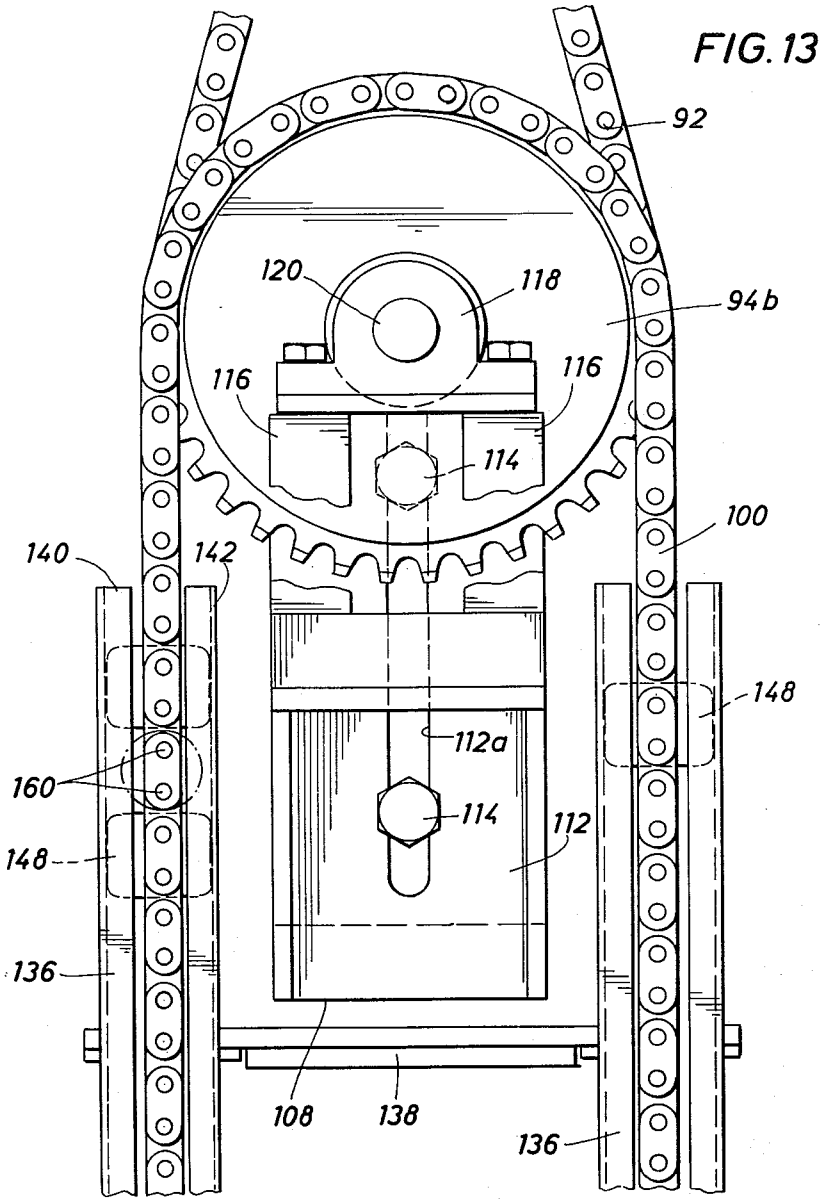
FIG. 13 is a side elevation of the upper drive wheel assembly of FIG. 12 taken along line 13—13 of FIG. 12.
Figure 12:
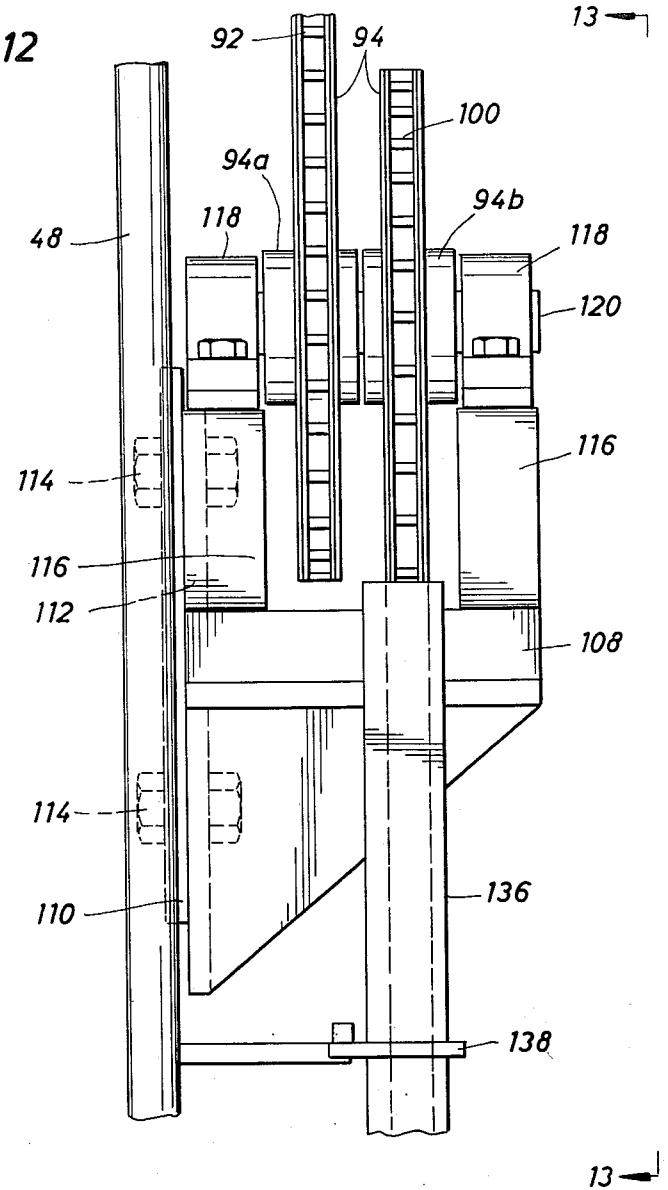
FIG. 12 is a fragmentary end elevation of one of the upper drive wheel assemblies.

The construction and operation of the double-rimmed sprocket drivers may be appreciated by reference to FIGS. 12 and 13, which show details of the construction and mounting of one of the sprocket drivers, say 94, the remaining sprocket driver 90 being virtually the same in its construction and mounting. A mounting bracket 108 is bolted to a mounting plate 110 fixed to the structure of the traveling pole 42. In FIG. 12, the traveling leg 42 is indicated by the illustration of a fragment of one of its elongate tubular members 48. The mounting plate 110 may be welded to such tubular members 48, and/or to cross members 50 (FIG. 11).

The bracket 108 includes a back plate 112 containing an elongate slot 112*a* therethrough. A pair of nut and bolt combinations 114 passes through the slot 112*a* and corresponding throughbores in the mounting plates 110. Tightening the nut and bolt combinations 114 maintains the mounting bracket 108 fixed against movement relative to the mounting plate 110 and, therefore, the traveling pole 42.

The mounting bracket 108 includes a pair of upwardly-directed posts 116. A bearing-lined bracket 118 is fixed to the top of each pair of posts. The sprocket driver 94 is positioned on the shaft assembly 120 which rides within the bearing brackets 118.

As may be seen in FIG. 12, the sprocket drivers 94 may be constructed from a pair of individual sprocket wheels 94*a* and 94*b*. The sprocket wheels 94*a* and 94*b* are mounted on the same shaft asssembly 120, and are therefore constrained to rotate in unison.

With the drive chain 92 in place about the sprocket wheel 86 and the sprocket driver wheel 94*a*, the mounting bracket 108 may be adjusted vertically, with the nut and bolt combinations 114 loosened, to provide the proper amount of tension in the drive chain 92. The slot 112*a* accomodates vertical movement of the mounting bracket for this purpose. With the bracket 108 properly positioned with the appropriate amount of tension in the drive chain 92, the working chain 100 may be positioned about the driver sprocket wheel 94*b*.

Figure 15:
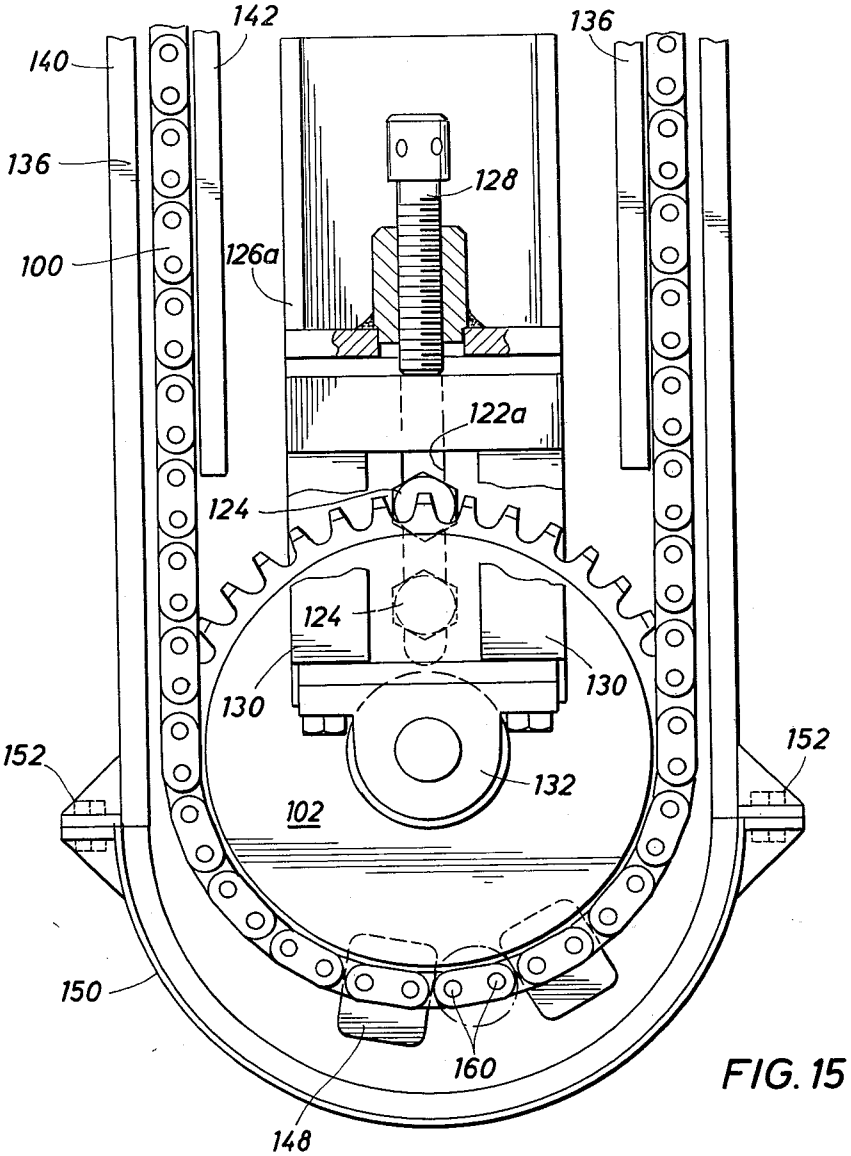
FIG. 15 is a side elevation of the lower sprocket wheel assembly of FIG. 14, taken along line 15—15 of FIG. 14.
Figure 14:
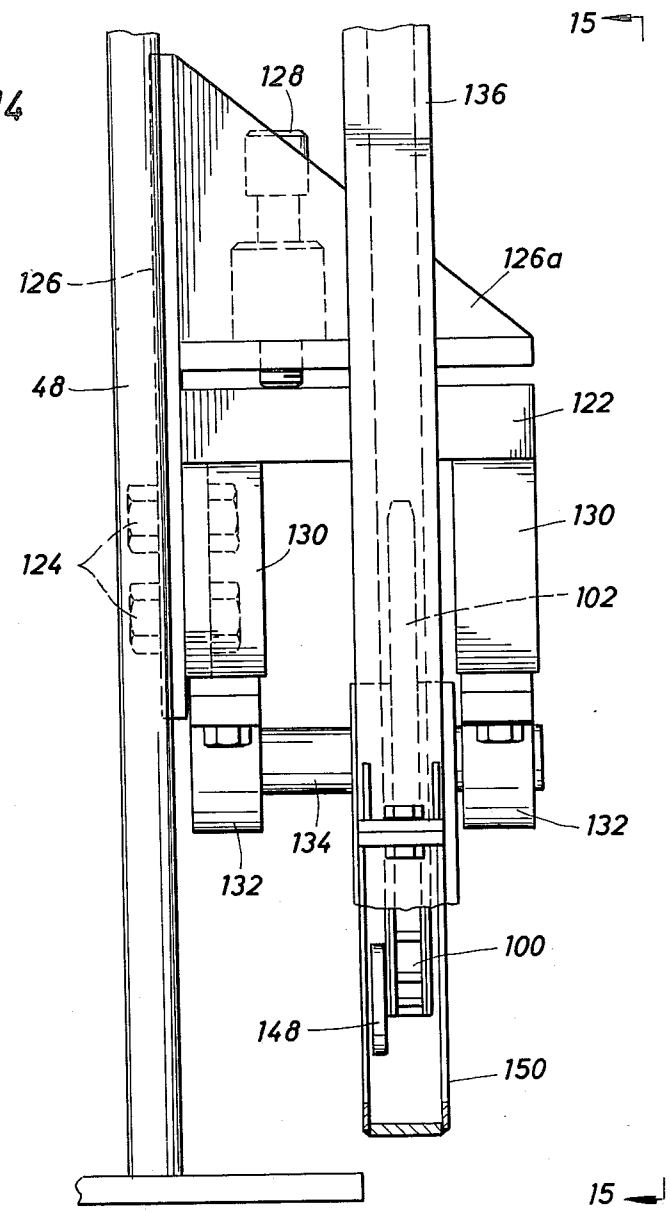
FIG. 14 is a fragmentary end elevation of one of the lower sprocket wheel assemblies.

Details of the lower sprocket wheel 102 construction and mounting may be appreciated by reference to FIGS. 14 and 15. Similar construction and mounting are provided for the sprocket wheel 98. A mounting bracket 122 features a vertical slot 122*a* by which the mounting bracket is held, with nut and bolt combinations 124, to a mounting plate 126 fixed relative to the traveling pole 42, here indicated by a vertical tubular member 48 (FIG. 14). The vertical position of the mounting bracket 122 may thus be adjusted, in the manner of adjustment of the upper mounting bracket 108, to provide the proper tensioning of the working chain 100. With the bracket 122 thus positioned, the nut and bolt combinations 124 may be tightened to hold the mounting bracket fixed relative to the traveling pole 42. Additional constraint is placed on the bracket 122 by a bolt 128 threadedly engaged in an overhang 126*a* of the mounting plate 126. The bolt 128 is so positioned to lock the mounting bracket 122 from upward movement relative to the traveling leg 42 once the bracket 122 has been appropriately positioned to provide the necessary tension in the working chain 100.

The mounting bracket 122 includes two pairs of posts 130 extending downwardly, with each pair supporting a bearing-lined bracket 132. The sprocket 102 rides on a shaft 134 which is supported by the bearinged brackets 132.

The working chain 100 is enclosed within a chain guard 136, except for that portion of the working chain engaging the driver wheel 94, and the chain links immediately adjacent thereto. The chain guard 136 is supported by the traveling pole 42 by means of support frames 138. The construction of the chain guard 136 may be appreciated by reference to FIGS. 11–16. Channel beams 140 and 142 are held by the support frames 138 in mutually-facing configuration to form a box-like beam. The channel beams 140 and 142 are equipped with runners 144 and 146, respectively, welded within the corresponding channel beams and running generally throughout their lengths (FIGS. 11 and 16). The back leg of the chain guard 136 is similarly constructed of a pair of channel beams each fitted with such a runner.

The working chain 100 is composed of a sequence of links, with a plurality of such links equipped with retaining plates 148. Each of the retaining plates 148 is of a size to permit the plate to move along the interior of the chain guard 136 but not to move out of the narrow troughs defined by the channel beams 140 and 142 and their respective runners 144 and 146. The bottom of the chain guard 136 includes an arcuate cover 150 bolted to the channel beams at 152. Consequently, the working chain 100 is constrained against lateral movement by the chain guard 136 throughout the length of the chain 100 except for those portions of the chain directly engaging the sprocket wheels 94 and 102, and immediately adjacent thereto. Further, the portion of the chain 100 in the vicinity of the lower wheel sprocket 102 is nevertheless encased by the continuation downwardly of the outer channel beams and the cover 150 bolted thereto. Thus, in the event that the working chain 100 breaks, for example, any portions of the chain tending to fall will be confined by the chain guard 136, and particularly by the retaining plates 148 being restrained by the runners 144 and/or 146. Consequently, it may be expected that a break in the chain 100 will result in little more than the chain supporting itself within the chain guard in a limp condition, without any substantial falling chain.

A similarly-constructed chain guard 136 also encloses the working chain 96, and is likewise supported by the traveling pole 46 by frames 138. The working chain 96 is also equipped with a plurality of retainer plates riding in the troughs formed by runners in the corresponding chain guard 136 to prevent the chain 96 from falling out of the chain guard.

As shown in FIG. 10, the working chains 96 and 100 are joined together by two hoisting bars 154 and 156. Each of the ends of the hoisting bars 154 and 156 features a U-shaped retainer 158 joined to the remainder of the hoisting bar by a pair of spaced pins 160 (only one visible in FIG. 16). The pins 160 pass through holes in both sidewalls of the retainer 158. One pin 160 also passes through holes in an adjacent chain link 162; the second pin 160 (hidden in FIG. 16) similarly passes through holes in an adjacent chain link toward the opposite end of the retainer 158. An interior chain link 164 also encircles the two pins 160 and completes the hoisting bar link assembly.

The retainer 158 is joined to an end cap 166 which is held, by bolts 168, to a threaded receptacle 170. The pins 160 pass through holes **166*a* in the end cap, and are stopped by pin caps 160*a*** or the like.

A cylindrical bar 172 features threaded ends, one of which is received in threaded engagement by each of the receptacles 170. A set screw 174 prevents the bar 172 from inadvertently unthreading from each receptacle 170.

A hoisting bar sleeve 174 encloses the greater portion of the length of the bar 172. A plurality of roller bearings 176 is maintained in inner and outer roller bearing raceways 178 and 180, respectively. The raceways 178 and 180 are held against longitudinal movement along the hoisting bar by an internal shoulder **174*a* of the sleeve 174, and a snap ring 182 held in an appropriate groove in the bar 172 as a stop abutting the inner raceway 178. The sleeve 174 fits loosely around the bar 172. The roller bearings 176 and raceways 178 and 180 thus provide a constraint to prevent movement of the sleeve 174 along the longitudinal axis of the bar 172, but permit relative rotational movement between the bar 172 and the sleeve 174** about their common longitudinal axis.

A seal retainer 184 is threadedly engaged with the end of the sleeve 174, and locked thereto by a set screw 186. The retainer 184 is shaped so as to avoid contact between the retainer and either the bar 172 or the receptacle 170. However, an annular seal element 188 is contained within the retainer 184 and provides a fluid-tight seal between the retainer and the surfaces of the bar 172. The seal element 188 is of a folded-back design, with its innermost edge bevelled and riding about the surface of the bar 172. The seal element 188 thus forms an annular pocket 190. Thus, the annular spacing between the bar 172 and the sleeve 174 may be filled with lubricant. This lubricant may also fill all open spaces around and about the roller bearings 176 and raceways 178 and 180, and also fill the pocket 190. The seal element 188 then functions to provide an end seal to retain the lubricant within the aforementioned areas. Thus, frictional forces tending to inhibit the rotational motion between the bar 172 and the sleeve 174 are minimized.

As in the case of the coupling between the retainer 158 of each hoisting bar and the corresponding working chain, the construction and assembly of the hoisting bar elements 158–188 are essentially the same for all hoisting bar ends.

Figure 17A:
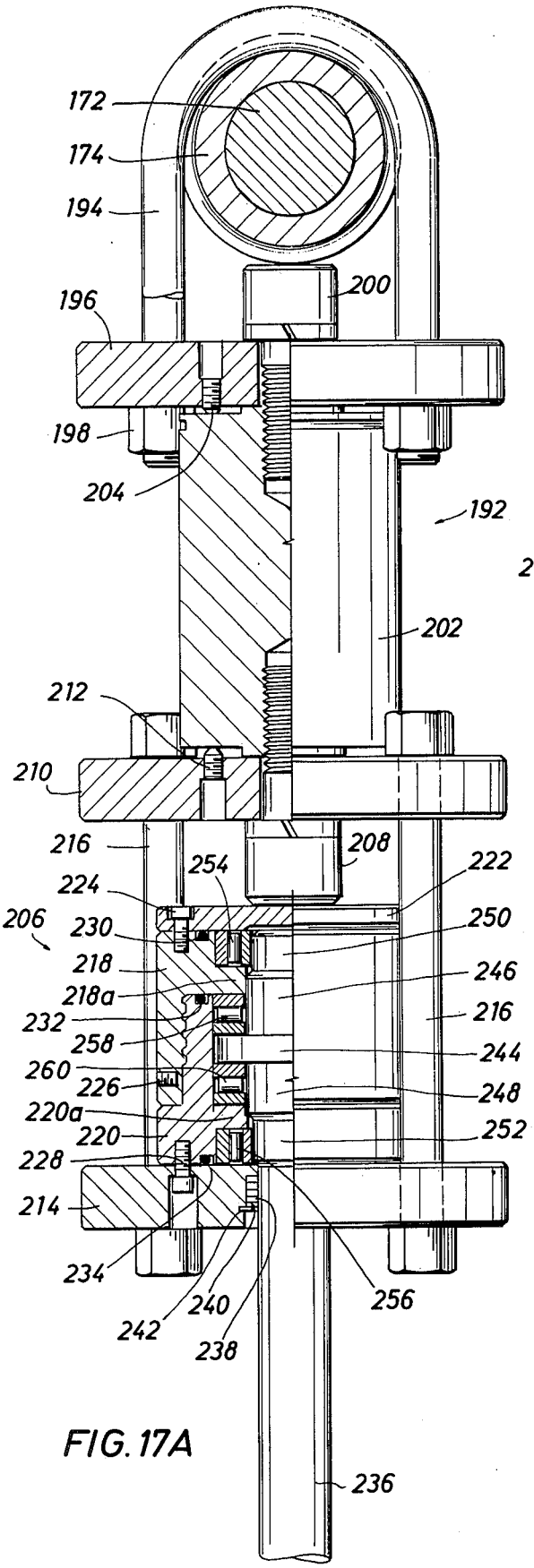
FIGS. 17A and 17B together are a side elevation, in partial section, of one of the hoist assemblies, illustrating a hoisting bar and an elevator, with FIG. 17A showing the hoisting bar and the elevator swivel, and FIG. 17B showing the elevator.
Figure 17B:
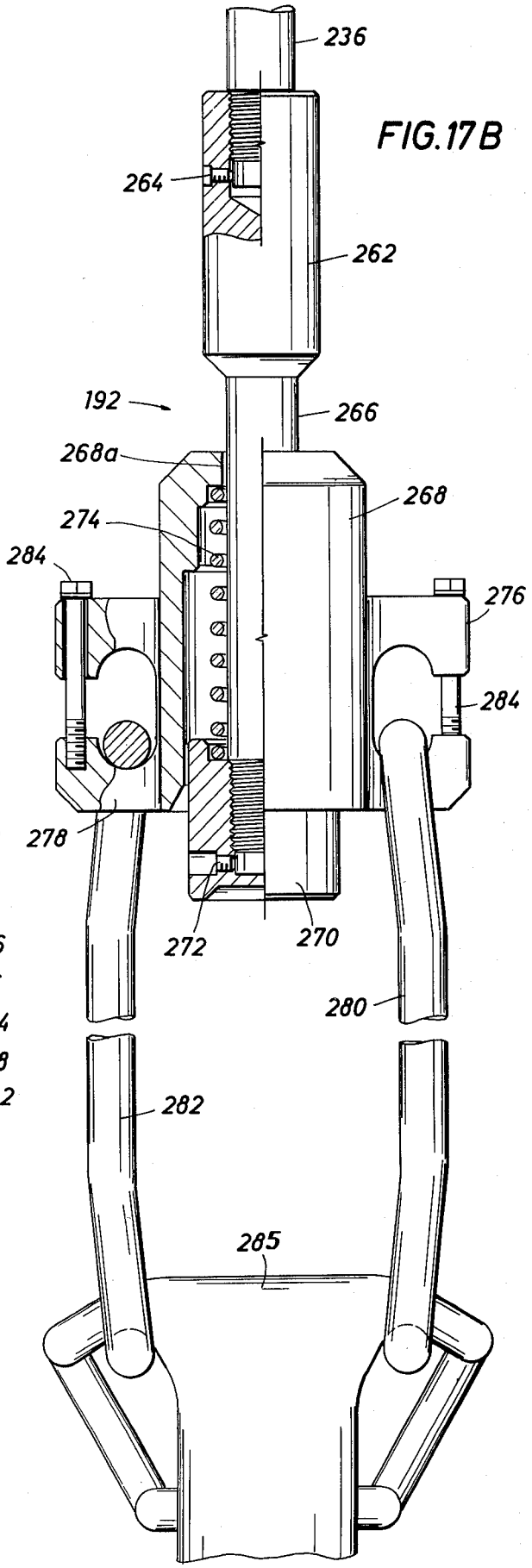

Each of the two hoisting bars 154 and 156 supports a hoist assembly, or pipe holder, shown generally at 192 in FIGS. 17A and 17B. Each of the hoist assemblies 192 is carried by a pair of U-bolts 194 secured in appropriate grooves in the hoisting bar sleeves 174. The U-bolts pass through holes in a plate 196 and are held, against shoulders (not shown) of the U-bolts, by nuts 198. A positioning bolt 200 is threaded into the top end of a coupling shaft 202. The bolt 200 is adjusted so that it fits tightly against the sleeve 174 when the nuts 198 are fastened on the U-bolts 194. Thus, the hoist assembly 192 is held fixed to the sleeve 174 against rotational as well as translational movement relative thereto. One or more set screws 204 holds the shaft 202 against rotational movement about its longitudinal axis relative to the plate 196, thereby preventing inadvertent loosening of the bolt 200.

A swivel assembly, shown generally at 206, is joined to the shaft 202 by means of a second positioning bolt 208 which passes through a plate 210, which the bolt 208 holds fast against the shaft 202 by threadedly engaging the shaft. One or more set screws 212 prevents rotational movement between the plate 210 and the shaft 202, thereby preventing inadvertent loosening of the bolt 208. Another plate 214 is fixed relative to the plate 210 by four nut and bolt combinations 216 (only two are visible in FIG. **17*a***).

The swivel assembly 206 includes a housing comprising, primarily, three major components: upper and lower bearing assembly retainers 218 and 220, respectively, threaded together; and a top plate 222 held to the upper bearing retainer 218 by bolts 224. The two bearing retainers 218 and 220 are held against mutual rotational movement by set screws 226. The lower bearing retainer 220 is partially closed by the plate 214. Bolts 228 prevent rotational motion between the lower bearing retainer 220 and the plate 214. O-ring seals 230, 232, and 234 provide fluid-tight sealing integrity among the housing components 222, 218, and 220 and between the lower bearing retainer 220 and the plate 214. The bolt 208 is positioned within the corresponding threaded bore of the shaft 202 so that the housing components 218–222 are held together under compressive forces between the bolt 208 and the plate 214, the latter being held to the plate 210 by the bolts 216.

An arm 236 extends downwardly from the interior of the swivel assembly 206. The arm 236 is fluid-sealed within a hole through the plate 214, through which the arm passes, the fluid-sealing being effected by packing 238 and a packing retainer ring 240 held in place against the packing by a snap ring 242 positioned within a groove in the plate 214. Consequently, a chamber is defined within the housing components 218, 220, 222 and the plate 214, which is fluid-sealed to retain lubricating fluid for the bearing assemblies contained therein. The arm 236 includes an annular flange 244 flanked by shoulders of enlarged diameter 246 and 248. Beyond the shoulders 246 and 248 are shanks of lesser diameter 250 and 252, respectively.

The upper bearing retainer 218 includes an inwardly-directed annular flange 218*a*. A roller bearing assembly 254, including a plurality of roller bearings and inner and outer annular races, is positioned between the flange 218*a* and the top plate 222 so that the roller bearings provide relatively friction-free coupling between the shank 250 and the upper bearing retainer 218. The lower bearing retainer 220 features an inwardly-directed flange 220*a*. A second roller bearing assembly 256, including a plurality of roller bearings and inner and outer races, is positioned between the flange 220*a* and the plate 214 to provide relatively friction-free coupling between the shaft 252 and the lower bearing retainer 220. It will be appreciated that the roller bearing assemblies 254 and 256 prevent lateral movement, or twisting, by the arm 236 relative to the swivel assembly 206, while providing relatively friction-free coupling to permit rotation of the arm about its longitudinal axis relative to the swivel assembly.

A roller bearing assembly 258, including a plurality of roller bearings and upper and lower annular races, is positioned between the flange 218*a* and the arm flange 244 of the arm 236. Similarly, a roller bearing assembly 260, including a plurality of roller bearings and upper and lower annular races, is positioned between the arm flange 244 and the flange 220*a*. The roller bearing assemblies 258 and 260 act as thrust bearings, coupling the arm 236 by means of the flange 244 to the swivel 206.

By use of the roller bearing assemblies 254–260, the arm 236 is rotatable about its longitudinal axis relative to the hoisting bar 272, but is constrained against longitudinal motion along the axis of the arm 236.

The bottom end of the arm 236 is threaded and joined, thereby, to a mounting bar 262. A set screw 264 prevents inadvertent rotational motion between the mounting bar 262 and the arm 236. The lower end of the mounting bar 262 is narrowed to a shank 266 which passes into the interior of a spring housing 268, and is threadedly connected to a collar 270. A set screw 272 prevents inadvertent rotational motion between the collar 270 and the shank 266. A coil spring 274 is confined within the housing 268 by the collar 270 and an inwardly-directed shoulder 268*a* of the housing. The collar 270 may be drawn within the housing 268. Thus, longitudinal motion between the shank 266 and the housing 268 is permitted, although the coil spring 274 biases the shank 266 downwardly relative to the housing 268 as viewed in FIG. 17B.

Two brackets 276 and 278 extend outwardly from the spring housing 268, and receive elevator links 280 and 282, respectively. The elevator links 280 and 282 are basically loops which, after being received by the brackets 276 and 278, are retained therein by bolts 284. The links 280 and 282 fit loosely within the brackets 276 and 278, respectively, permitting sideways movement of the links relative to the housing 268 and, therefore, the arm 236. The links support an elevator coupling 285 for engaging and supporting pipe members, as discussed in detail hereinafter.

Figure 18:
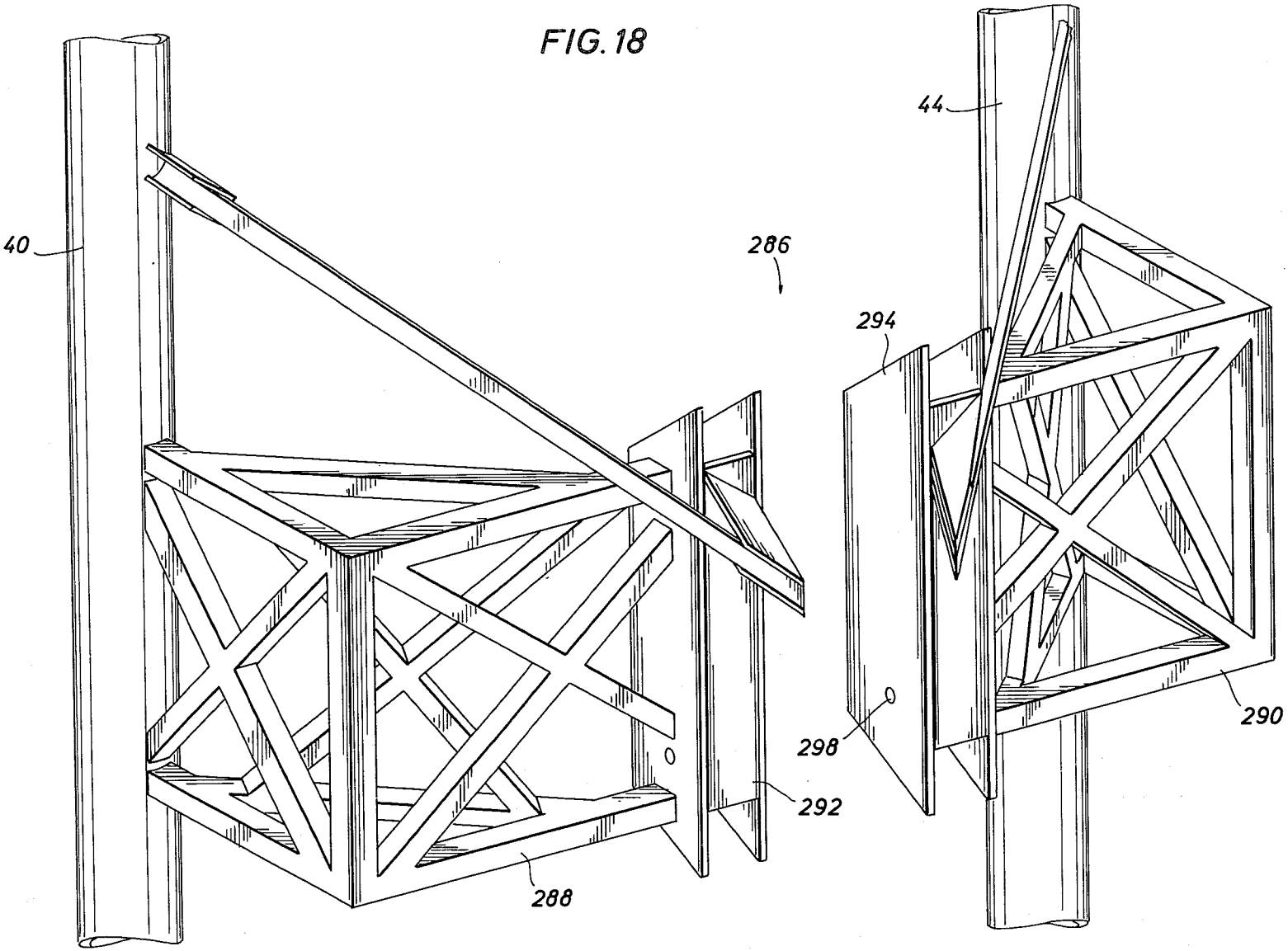
FIG. 18 is a perspective view of the hoisting mechanism framework.
Figure 21:
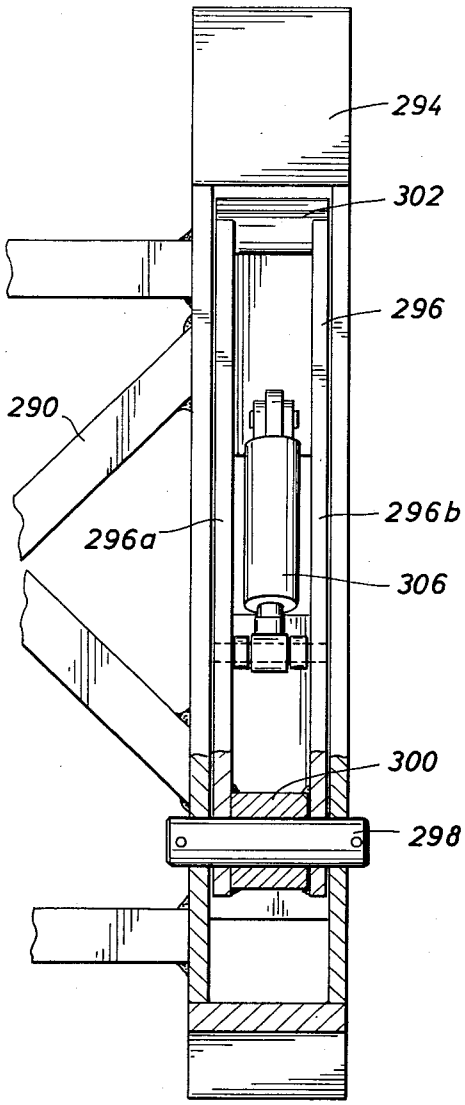
FIG. 21 is a fragmentary end elevation, partially broken away, of the hoisting clamp of FIG. 19, taken along line 21—21 of FIG. 19.

A hoisting mechanism, shown generally at 286 in FIG. 18, is affixed to the front of the mast 12. Details of the hoisting mechanism 286 may be appreciated by reference to FIGS. 11 and 18. The hoisting mechanism 286 includes a framework 288 supported by the gin pole 40, and a similar framework 290 supported by the other gin pole 44. The frameworks 288 and 290 are structurally able to support the weight of the traveling poles 42 and 46.

The framework 288 ends in a clamp housing 292 positioned a short distance in front of the working chain 100. Similarly, a clamp housing 294 is supported by the frame 290, and positioned a short distance in front of the working chain 96. Details of the housing 294 and its contents may be appreciated by reference to FIGS. 19–21, while noting that the housing 292 is of similar construction and contains like contents.

The housing 294 contains a clamp mechanism, including a clamping arm 296 pivotally joined to the housing 294 by a hinge bar 298 passing through appropriate holes in the sidewalls of the housing. As may be appreciated by reference to FIG. 21, the arm 296 includes a pair of elongate side panels 296*a* and 296*b*. The hinge bar 298 passes through a spool 300 welded between the side panels 296*a* and 296*b*. The top end of the clamp includes a curved saddle 302, also joined to the two panels 296*a* and 296*b*. An additional cross piece 304 provides added rigidity to the arm 296.

Figure 20:
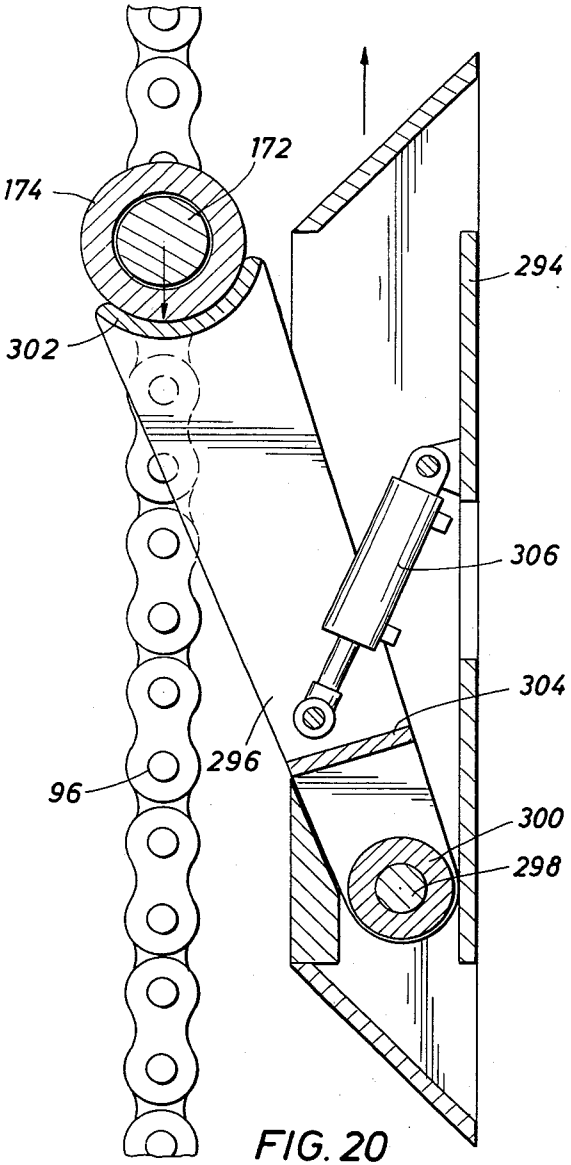
FIG. 20 is a view similar to FIG. 19, showing the arm extended and engaging a hoisting bar.
Figure 19:
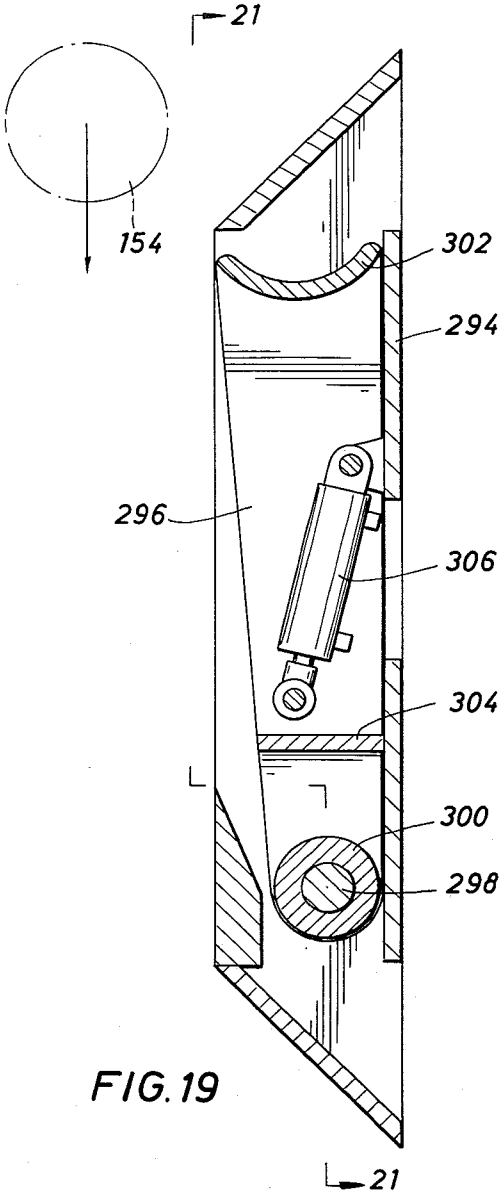
FIG. 19 is a vertical cross section of a hoisting clamp, with the arm retracted.

A fluid pressure cylinder assembly 306 is hingedly joined to the arm 296 and the back wall of the housing 294. The arm 296 may be selectively extended or retracted, by rotation about the hinge bar 298, by means of operation of the cylinder assembly 306. Thus, for example, with the cylinder assembly in its retracted configuration as shown in FIG. 19, the arm 296 is withdrawn into the interior of the housing 294. Extension of the cylinder assembly 306, as indicated in FIG. 20, causes the arm 296 to pivot outwardly. The housing 294 is so positioned in front of the working chain 96 that, with the arm 296 extended as shown in FIG. 20, the saddle 302 is placed between the two working chains 96 and 100 in vertical alignment with either of the hoisting bars 154 or 156 passing along the front of the working chain loops. Thus, circulation of the working chains 96 and 100 to effect downward movement by the hoisting bars along the front of the working chain loops eventually causes one of the hoisting bars to be engaged by the saddle 302. With the arm 296 retracted into the housing 294 as indicated in FIG. 19, the hoisting bars may pass by the housing without contact with the arm. A hoising bar, say 154, is shown in phantom in FIG. 19 at a position along the path the hoisting bar would take by the housing 294.

The bottom end of each of the two traveling poles 42 and 46 is equipped with a slip cone assembly, one of which is shown generally at 308 in FIGS. 22–24 and 26, supported by an end plate 310. The end plate 310 forms the bottom, or foot, of the traveling pole, such as 42, and is generally horizontal when the mast 12 is erect.

An arcuate opening 310*a* in the end plate 310 receives the gin pole 40. A V-shaped passage 310*b* leads to the arcuate opening 310*a*, but is sufficiently narrow at the junction between the passage 310*b* and the opening 310*a* to prevent the gin pole 40 from passing therethrough. It will be appreciated that the sizes and shapes of the arcuate opening 310*a* and the passage 310*b* are essentially the same as those of the arcuate opening 56*a* and the passage 56*b*, respectively, of the plate 56, as illustrated in FIG. 11.

A pair of fluid pressure cylinder assemblies 312 extends downwardly (with the mast 12 erect) from below the end plate 310 where they are held, by bolts 314, to pillars 316 welded to the bottom of the end plate. The piston 318 of each of the cylinder assemblies 312 carries, by means of a nut 320, an angular-shaped operating plate 322. Each of the operating plates 322 extends radially inwardly, and rides in an external groove along the bottom of each of two slip cones 324. Thus, operation of the cylinder assemblies 312 causes the pistons 218 to extend downwardly or to retract upwardly. The operating plates 322 are constrained to move vertically with the corresponding pistons 318. The groove attachments between the operating plates and the slip cones 324, therefore, causes the slip cones to move vertically with the operating plates and the pistons.

An arcuate, downwardly-facing wedge member 326 is fastened to the bottom side of the plate 310 adjacent to the outside of each of the slip cones 324. With the pistons 218 retracted into the cylinder assemblies 312, as shown in FIG. 23, the slip cones 324 ride upwardly and inwardly along the inner bevelled surfaces of the wedge members 326, and are wedged tightly against the exterior surface of the gin pole 40. Each of the slip cones 324 features, along its inner surface, rows of arcuate inwardly-facing edges 324*a*, which engage the outer surface of the gin pole 40 to prevent downward movement of the plate 310 and, therefore, the traveling pole 42 relative to the gin pole, when the slip cones 324 are wedged between the gin pole and the wedge members 326 as shown in FIG. 23. When the pistons 318 are extended, as indicated in FIG. 24, the slip cones 324 are drawn downwardly relative to the wedge members 326, and are released from gripping engagement with the gin pole 40. In that case, the traveling pole 42 is not inhibited by the slip cone assembly 308 from moving longitudinally along the gin pole 40.

A pin 328 passes through the operating plate 322 and the slip cone 324 in each case, thereby preventing lateral, or rotational, movement of each of the slip cones 324 relative to the operating plates 322 and, therefore, the wedge members 326. The pins fit firmly in appropriate holes in the bottom of each of the slip cones 324. However, each of the pins 328 may ride radially in a slot 322*a* in the corresponding operating plate 322 to accommodate the radial movement of the slip cones 324 as they ride along the wedge members 326 (see FIGS. 25 and 25A).

It will be appreciated that the construction and operation of the slip cone assembly associated with the traveling pole 46, operable to selectively grip the gin pole 44, is the same as that of the slip cone assembly 308 described in relation to the traveling pole 42 and the gin pole 40.

Figure 22:
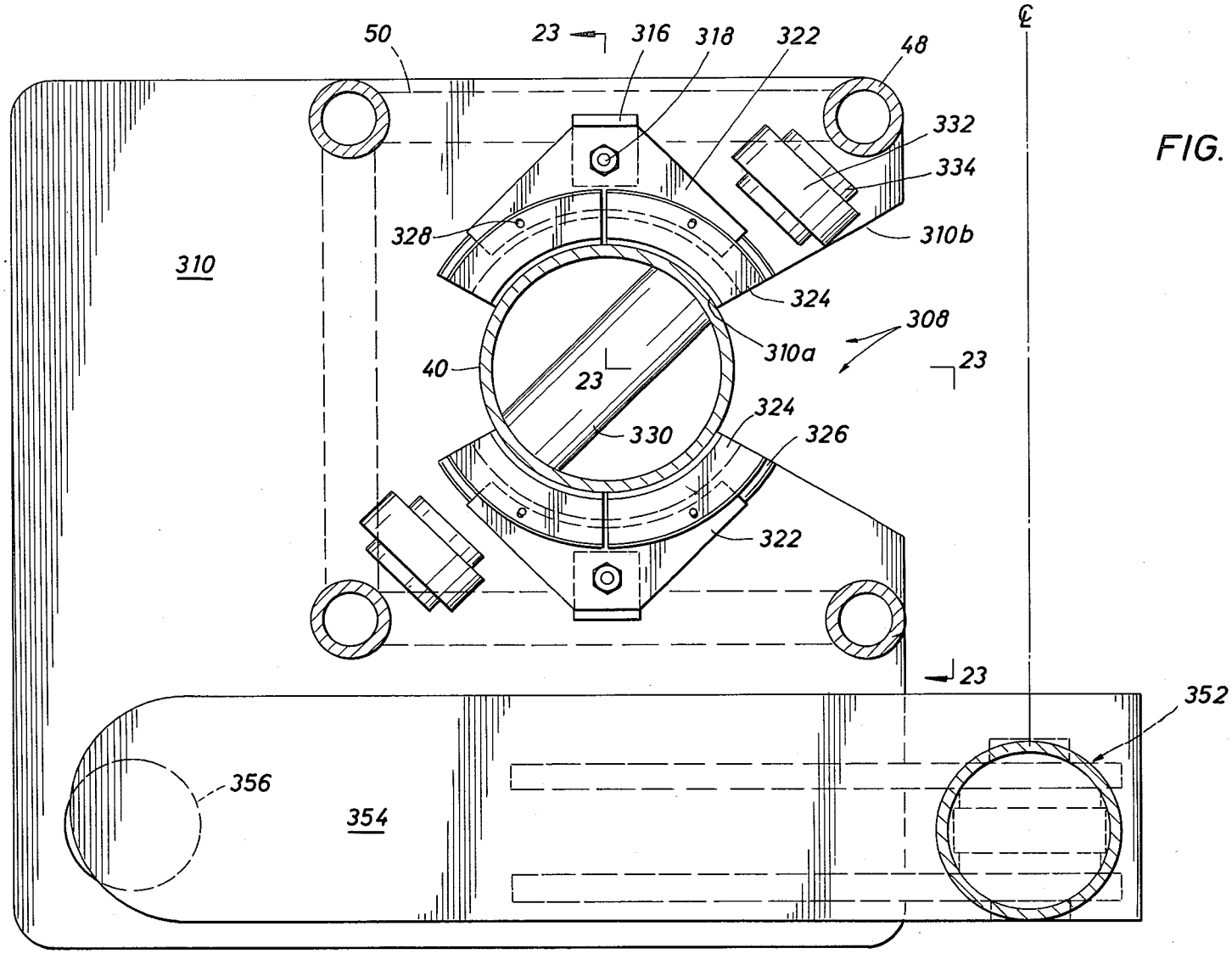
FIG. 22 is a horizontal cross section of one mast pole, taken along line 22—22 of FIG. 5, and showing the slip cone arrangement.

The gin pole 40 includes, generally toward the bottom end, a lateral sleeve 330 defining a passage through the gin pole and communicating externally of the gin pole through appropriate holes 40*a* in the wall of the gin pole (see FIGS. 22 and 26). The end plate 310 also features a pair of downwardly-extending posts 332 with ring spacers 334 welded to both sides of each post and circumscribing a bore 332*a* passing through the posts. When the mast 12 is in its retracted configuration, as in FIGS. 1–4, the posts 332 extend within the vicinity of the sleeve 330 in the gin pole 40. Then, a locking bar 336 may be passed through the sleeve 330 to extend beyond both ends of the sleeve, and, therefore, the lateral dimensions of the gin pole 40. At the same time, a pair of links 338 containing throughbores 338*a* is positioned to either side of the gin pole 40 so that the bar 336 also passes through the holes 338*a* in each of the links. On each side of the gin pole 40, the pair of links 338 is positioned to straddle the post 332 and the spacer rings 334. Each of the links 338 also features an upper throughbore 338*b* which may then be aligned with the hole 332*a* in the corresponding post 332. A load pin 340 may then be inserted through the holes 332*a* and 338*b* in the post 332 and both links 338, and locked in place by a washer 342 and nut 344. A cotter pin 346 may be added to prevent the nut 344 from disengaging from the pin 340. The head of the pin 340*a* is maintained relatively firmly against the adjacent link 338. A like load pin is locked in position in the links 338 and post 332 on the opposite side of the gin pole 40.

The load pin contacts the posts 332 and each of the adjacent links 338 to prevent longitudinal movement of the traveling pole 42 relative to the gin pole 40. Each end of the bar 336 is equipped with a lateral bore 336*a* to accommodate a cotter pin (not shown) to prevent movement of the bar out of engagement within the links 338.

It will be appreciated that similar constructions of posts 332 and a sleeve 330 are utilized on the traveling pole 46 and the gin pole 44, respectively, so that the traveling leg 46 may be locked to the gin pole 44 by means of a locking bar 336, links 338 and load pins 340 as in the case illustrated in FIG. 26. Thus, each of the traveling poles may be locked to the corresponding gin pole to secure the mast in collapsed configuration.

When the mast 12 is to be extended by raising the traveling poles relative to the gin poles, the load pins 340, the links 338, and the bar 336 may be removed from the mast leg in each case, leaving the posts 332 disengaged from the gin poles. Then, the traveling legs 42 and 46 may be moved relative to the corresponding gin poles 40 and 44.

The mast 12 may be extended by use of one or the other of the hoisting bars and the hoisting mechanism 286. With the mast 12 erect, the cylinder assemblies 306 are extended to move both clamping arms 296 into alignment with a hoisting bar as discussed. The motors 66 and 68 are operated in unison to drive the hoisting bars downwardly along the front of the working chain loops, in line with the saddles 302. As soon as one of the hoisting bars is received by the clamping arm saddles 302, continued downward driving of the hoisting bar by the motors 66 and 68 forces the traveling poles 42 and 46, to which the working chains are attached, upwardly relative to the gin poles 40 and 44, to which the hoist mechanism 286 is attached. The traveling poles 42 and 46 will continue to be lifted as long as the motors 66 and 68 continue to drive downwardly the hoisting bar so engaged by the saddles, and until the mast 12 is extended to the point that the lower sprocket wheels 98 and 102 have been elevated in the vicinity of the hoisting mechanism 286, as shown in FIGS. 5–7. Then, the circulation of the working chains 96 and 100 is stopped, and the traveling legs 42 and 46 are anchored against downward movement relative to the gin poles 40 and 44 by operation of the slip cone assemblies 303, as discussed. The clamping arms 296 are disengaged from the hoisting bar and retracted, with the motors 66 and 68 first operated to raise the hoisting bar from the saddles 302 if necessary.

To lower the mast 12 to its erect and retracted configuration, as shown in FIGS. 3 and 4, the steps just described are generally reversed. The arms 296 are extended to receive a hoisting bar in the saddles 302 as described hereinbefore. When a hoisting bar is seated in the saddles 302, the anchoring of the traveling legs 42 and 46 to the gin poles 40 and 44, respectively, by the slip cone assemblies 308 is released, as discussed hereinbefore. Then, the working chains 96 and 100 support the weight of the traveling legs 42 and 46, and of all apparatus suspended or supported by the traveling legs. The motors 66 and 68 may then be operated to allow the hoisting bar engaged by the saddles 302 to rise along the front leg of the working chain closed loops. The traveling legs thus lower themselves on the hoisting bar which remains fixed relative to the gin poles 40 and 42 as the working chains are circulated about the sprocket wheels by operation of the motors 66 and 68. At any time during the descent of the traveling legs, the motors 66 and 68 may be stopped, and the slip cone assemblies 308 actuated to anchor the traveling legs against further downward movement relative to the gin poles. Then, the clamping arms may be removed from engagement with the hoisting bar as discussed hereinbefore, and retracted.

A snubber 348 is suspended by a double-leg framework 350 generally between the lateral positions of the mast legs 12A and 12B, when the mast is in the erect configuration. As best seen in FIG. 7, one leg of the frame 350 is adjoined to the plate 310 of each of the traveling legs 42 and 46. The union between the leg 350 and the end plate 310 in each case is a hinged connection, as may be appreciated by reference to FIGS. 1, 3, 5 and 6. A hinge assembly 352 permits the snubber 348 and the frame 350 to be folded forward, toward the front of the flatbed 18. Thus, when the mast 12 is lowered to its horizontal position as shown in FIG. 1, the snubber is folded under the mast 12. As the mast 12 is extended in its erect configuration, with the traveling legs 42 and 46 moving upwardly along the corresponding gin poles 40 and 44, the snubber 348 and the frame 350 are generally lifted, and are then free to swing vertically on the hinged connection 352.

A pad 354 is rigidly connected to each leg of the frame 350 adjacent the hinged connection 352. As the frame 350 and the snubber 348 are pivoted to an erect configuration the pads 354 swing toward the end plates 310 and abut downwardly-facing pins 356 on each of the end plates 310. Then, the contact between the frame 350 and the mast 12 is by way of the two hinge connections 352 and the contact between the two pads 354 and the pins 356.

The frame 350 also carries a foldable work basket, shown generally at 358. Details of the work basket 358 may be appreciated by reference to FIG. 9.

A rectangular plate 360 is rigidly connected to the bottom of the two-legged frame 350. The plate 360 features a central hole **360*a* through which drill pipe may be passed proceeding to and from a well below. Rearward and forward plates 362 and 364, respectively, are hinged connected to the plate 360 by hinge joints 366. Similar hinge joints 366 connect side plates 368 to both lateral ends of the rearward plate 362. The hinge connections 366 are such that the plates 368 may be pivoted upwardly relative to the plate 362, and the plates 362 and 364 may be pivoted upwardly relative to the plate 360. However, in the flattened configuration shown in FIG. 9, wherein all plates, 360, 362, 364 and 368 are generally in a single plane, the hinge connections 366 cooperate with the edges of the plates to prevent any downward pivoting from the configuration as shown in FIG. 9. The end plates 368 may be collapsed completely against the rearward plate 362. The rearward and forward plates 362 and 364, respectively, may be folded to an orientation at an angle of approximately 90° relative to the plate 360. In that folded configuration of the plates, the work platform 358 permits the frame 350 to swing forward of the gin poles 40 and 44. In the unfolded configuration, however, the end plates 368 of the work platform 358 extend behind and beyond the gin poles 40 and 44, as may be appreciated by reference to FIGS. 5–7 and 11**.

The periphery of the work platform in its unfolded configuration of FIG. 9 contains a plurality of receptacles 370 which, with the work platform so unfolded, may receive posts 372 which support chain or cable 374 to provide a railing around a portion of the periphery of the work platform 358. The posts 372 may be removed from the receptacles 370 for the purpose of permitting the work platform 358 to be folded about the hinge connections 366.

The mast 12 features an additional foldable component which may be utilized to support a platform, or a work area, such as the control console 22. A pair of leg assemblies shown generally at 376 in FIGS. 3, 5 and 6 is pivotally mounted at points 378 on the masts. Each of the legs in the assembly 376 includes a first segment 380 joined to the mast by the pivotal connection 378, and a second segment 382 connected to the opposite end of the first segment by a pivotal, or hinged connection 384. With the mast in the erect configuration of FIGS. 3, 5 and 6, the leg assemblies 376 may be extended, or unfolded. To carry out this operation, a winch line 386 may be extended from a winch included in the power assembly 24 to a pulley carried by the pulley support frame 76 and then connected to the leg assembly 376 in the vicinity of the hinged connection 384 on each of the two legs 376. As the winch is operated to lower the legs 376, as indicated by arrows A in FIG. 5, the first leg segments 380 pivot about the connections 378 while the second leg segments 372 retain their vertical orientation, pivoting relative to the first segments 380 about the connections 384. Consequently, as the first segments are rotated about the connection points 378, the second segment of each of the two legs 376 travels outwardly and downwardly relative to the position of the mast 12.

The control console 22 includes a pair of upright generally tubular members 388 which receive the pair of second leg segments 382 as the latter are lowered on the winch line 386. To accomplish this, the control console must be placed at the appropriate position on the skid 16 to receive the leg second segments 382. As may be appreciated by reference to FIG. 6, when the bottom of each of the second leg segments 382 contacts the skid 16, the first leg segments 380 are generally horizontally oriented. A pair of receptacles 390 fixed to the skid receive the bottom ends of the second leg segments 382 when the latter have passed through the control console members 388. Then, each of the legs 376 is anchored against lateral motion at two points, namely the hinged connection 378 and the receptacle 390. Consequently, as long as the legs 376 are not lifted, they are sufficiently rigid to support the control console 22 as follows.

With the leg assemblies 376 unfolded and positioned with the ends of the second leg segments in the receptacles 390, the winch line 386 may be removed from the leg assembly 376 and extended downwardly to be fastened to a point on the control console 22 generally toward the back of the skid 16. The winch of the power source 24 may then be operated to draw in the winch line 386, thereby causing the control console 22 to ride up along the second leg segments 382, which are contained within the tubular members 388 and held by the receptacles 390. Thus, as the winch line 386 is drawn by the power source 24, the control console 22 rides vertically upwardly along the second leg segments 382 which serve as tracks. When the desired height of the control console 22 is reached, pins may be inserted in appropriate holes in the tubular members 388 and through corresponding holes in the second leg segments 382 to lock the control console against movement relative to the second leg segments 382. Then, the winch line 386 may be removed from the control console 22, which will remain locked in the configuration elevated above the skid 316.

To lower the control console 22, the procedure is generally reversed, with the winch line 386 being fastened to the control console and pulled tight by the winch of the power system 24. The pins locking the control console 22 against movement relative to the second leg segments 382 are removed, leaving the winch line 386 to prevent downward movement by the control console. The winch line 386 is then paid out slowly, allowing the control console 22 to ride downwardly along the upright second leg segments 382, serving as tracks. When the control console 22 contacts and rests on the skid 16, the winch line 386 may be removed from the control console. With the control console 22 thus supported by the skid 16, the leg assemblies 376 may be folded against the mast 12 in anticipation of the mast being folded forward over the skid 16.

To accomplish the folding of the leg assemblies 376, the winch line 386 is joined to the two leg assemblies at or near the pivot connections 384, and the winch line is drawn in by the winch of the power source 24. As the winch line 386 is thus retracted, the first leg segments 380 pivot about their corresponding connections 378 with the mast gin poles, while the second leg segments 382, remaining vertically oriented, are moved upwardly and toward the mast 12, with both first and second segments 382 and 380 very nearly parallelling the mast, as shown in FIG. 3. The leg assemblies 376 may then be fastened to the structure of the gin poles 40 and 44, and thereby held secure against the mast 12 when the mast is folded to its horizontal configuration, such as in FIGS. 1 and 2.

Figure 30:
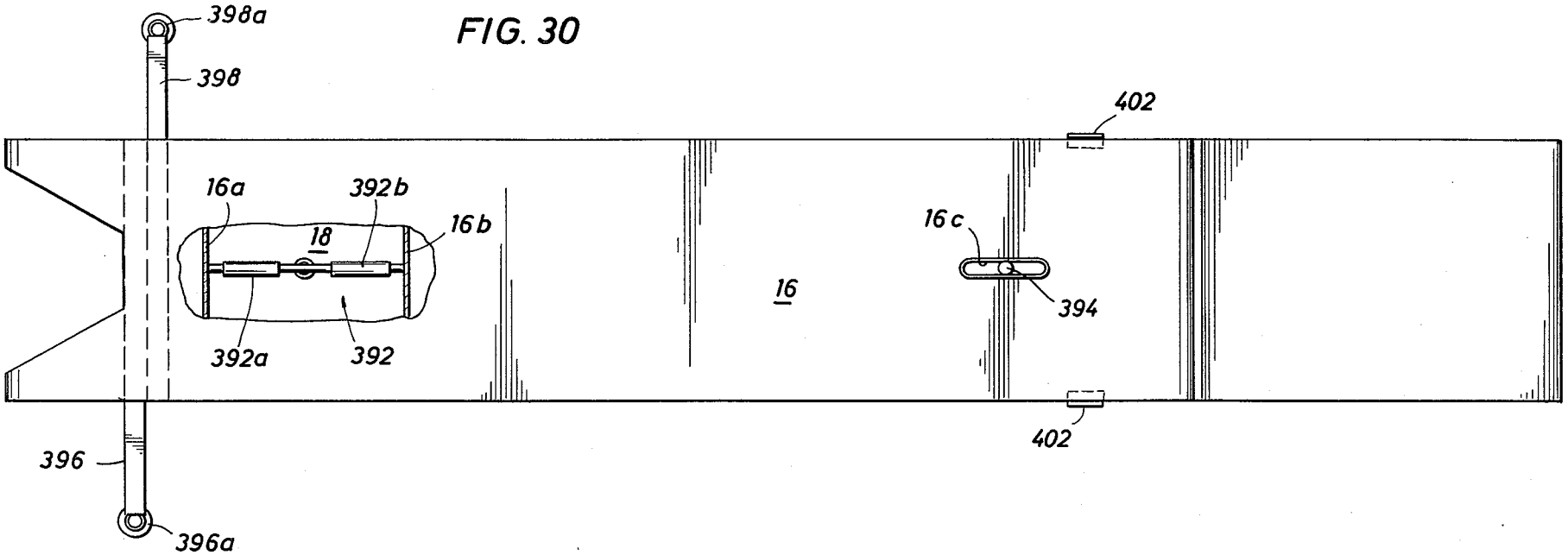
FIG. 30 is a top plan view of the rig truck bed and skid partially broken away, showing the pin-in-slot and the double cylinder assembly for positioning the skid on the truck bed.
Figure 31:
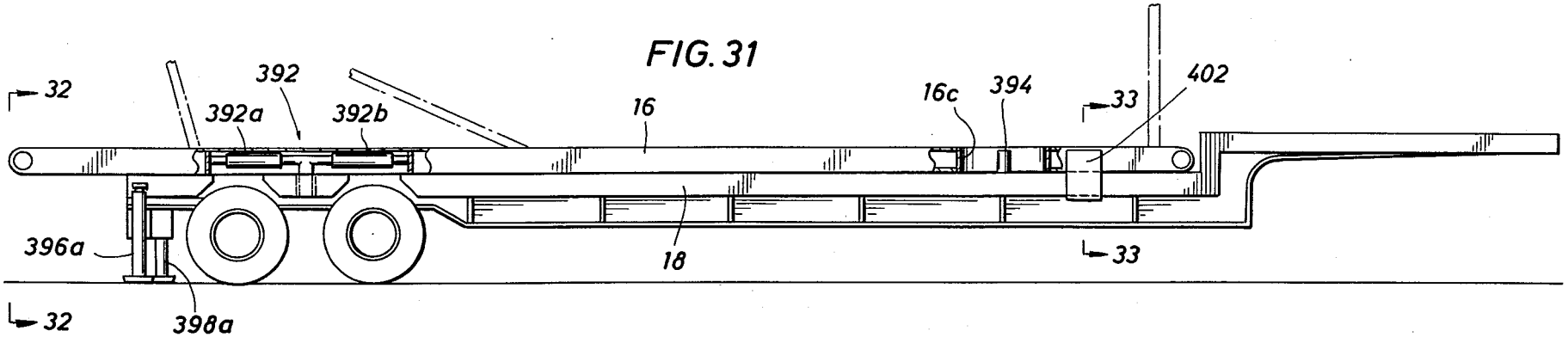
FIG. 31 is a side elevation of the skid and truck bed.

Horizontal adjustments of the skid 16 may be made by utilizing a double-cylinder system, shown generally at 392 in FIGS. 30 and 31, which couples the skid 16 to the flatbed 18. The double-cylinder system 392 includes two fluid pressure operated piston-cylinder assemblies **392*a* and 392*b*, with their fluid chambers in common communication with a fluid pressure source (not shown). The assembly 392 is constructed so that application of pressure to extend one of the fluid cylinder assemblies 392*a* or 392*b* operates to retract, or to allow retraction of, the other of the two cylinder assemblies. Each of the cylinder assemblies 392*a* and 392*b* is in contact with a cross member 16*a* and 16*b*, respectively, of the skid 16. Consequently, operation to extend the rearward cylinder system 392*a*, and coincidently retract the forward cylinder assembly 392*b*, generates a force against the cross member 16*a*, while allowing the cross member 16*b* to move toward the assembly 392. With the fluid cylinder assembly 392 anchored relative to the flatbed 18, the skid 16 is then propelled toward the rear of the flatbed. Operation of the fluid cylinder system 392 to extend the forward assembly 392*b* and to retract the rearward assembly 392*a* propels the skid 16 toward the forward end of the flatbed 18**.

A pin 394 projecting upwardly from, and fixed rigidly to, the flatbed 18 is confined within a slot **16*c* in the skid 16, oriented along a backward and forward direction along the skid. The confinement of the pin 394 within the slot 16*c* ensures that the operation of the double cylinder assembly 392 results only in longitudinal motion of the skid 16 relative to the longitudinal axis of the flatbed 18**.

Figure 32:
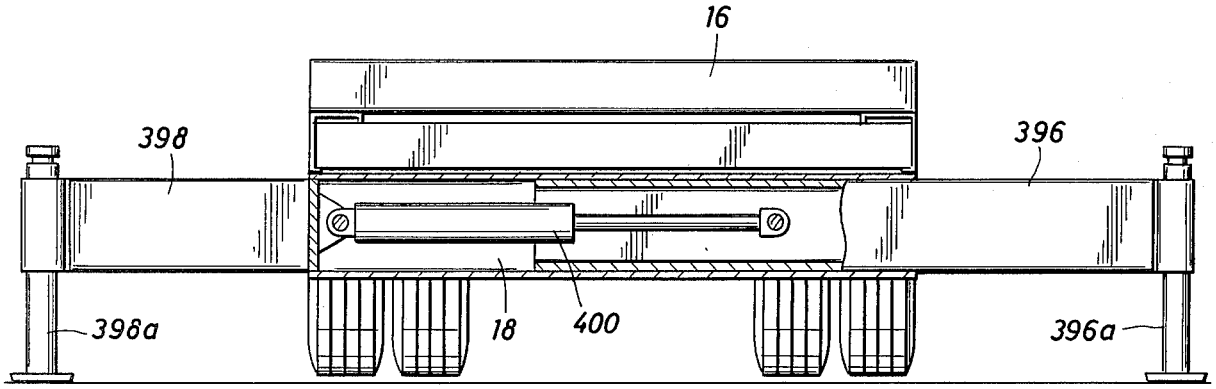
FIG. 32 is an end elevation of the skid and truck bed, partially broken away, taken along line 32—32 of FIG. 31, and illustrating the outrigger cylinder assembly.

When the flatbed 18 has been driven into position with its rear generally centered on a well site so that the substructure frame 14, extending beyond the flatbed, straddles the well site, fine adjustments in the orientation of the substructure relative to the well site may be made along the longitudinal axis of the flatbed by operation of the double cylinder system 392 as described. Lateral, or sideways adjustments of the skid 16 may also be made by use of fluid pressure. The flatbed 18 is equipped with a pair of outriggers 396 and 398, ending in feet **396*a* and 398*a*, respectively. With the outriggers 396 and 398 extended, the feet 396*a* and 398*a* may be lowered to contact the surface of the ground, and further advanced downwardly relative to the flatbed 18 to raise the rear wheels of the flatbed off of the ground, as shown in FIG. 32. The extension of the outriggers 396 may be accomplished by operation of a fluid pressure cylinder assembly 400, which has its cylinder anchored relative to the flatbed 18 and its piston anchored relative to the outrigger 396 as illustrated in FIG. 32. A similar fluid pressure cylinder assembly (not shown) may be employed to maneuver the opposite outrigger 398 inwardly and outwardly relative to the flatbed 18. With the rear wheels of the flatbed raised off of the ground, and the flatbed being supported by the outrigger feet 396*a* and 398*a* as well as the fifth-wheel truck 20 at the front of the flatbed, the fluid pressure cylinder assemblies, including 400, used to operate the extension and retraction of the outriggers 396 and 398 may be operated in unison to swing the rear end of the flatbed 18 and, therefore, that of the skid 16 laterally relative to the longitudinal axis of the flatbed. Thus, to move the rear of the truck to the right as viewed in FIG. 32, the cylinder assembly 400 is retracted at the same time the outrigger 398 is extended further from the flatbed 18 by operation of the corresponding fluid pressure cylinder assembly (not shown). This latter cylinder assembly may be retracted while the cylinder assembly 400 is extended to move the rear of the truck to the left as viewed in FIG. 32**.

By utilizing the outrigger fluid pressure cylinder assemblies as well as the double cylinder system 392 the skid 16 may be moved in two generally horizontal directions which are generally mutually orthogonal. Thus, a complete fine adjustment of the positioning of the centerline of the mast 12, when the mast is erected, may be made without the necessity of further maneuvering of the flatbed 18 by means of the truck 20.

Figure 33:
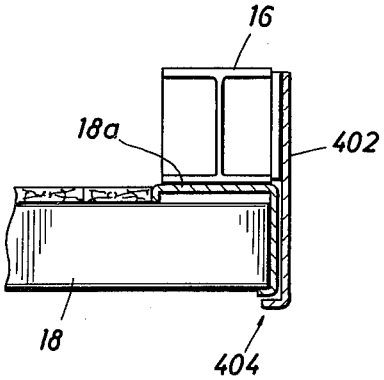
FIG. 33 is an enlarged, fragmentary horizontal cross section of an edge of the skid and truck bed, showing the rail of the truck bed supporting the skid.

To ensure that the skid 16 is constrained against rotational, or sideways motion relative to the longitudinal axis of the flatbed 18, one or more sidewalls 402 are rigidly joined to the outer frame of the skid 16 as illustrated in FIG. 33. The sidewalls 402 extend downwardly along the side of the flatbed 18, and wrap around under the edge of the flatbed, as illustrated generally at 404. Thus, by cooperation of the sidewalls 402, the pin-in-slot combination 394 and 16*c*, and the connection between the double cylinder system 392 and the cross members 16*a* and 16*b*, the skid 16 is held relatively fast to the flatbed 18 with the exception of the skid being able to be moved back and forth along the longitudinal axis of the flatbed 18.

As shown in FIG. 33, the flatbed 18 may be equipped with metal rails 18*a* to provide direct support for the skid 16, and a sliding surface over which the skid may be moved by operation of the double cylinder system 392.

Figure 27:
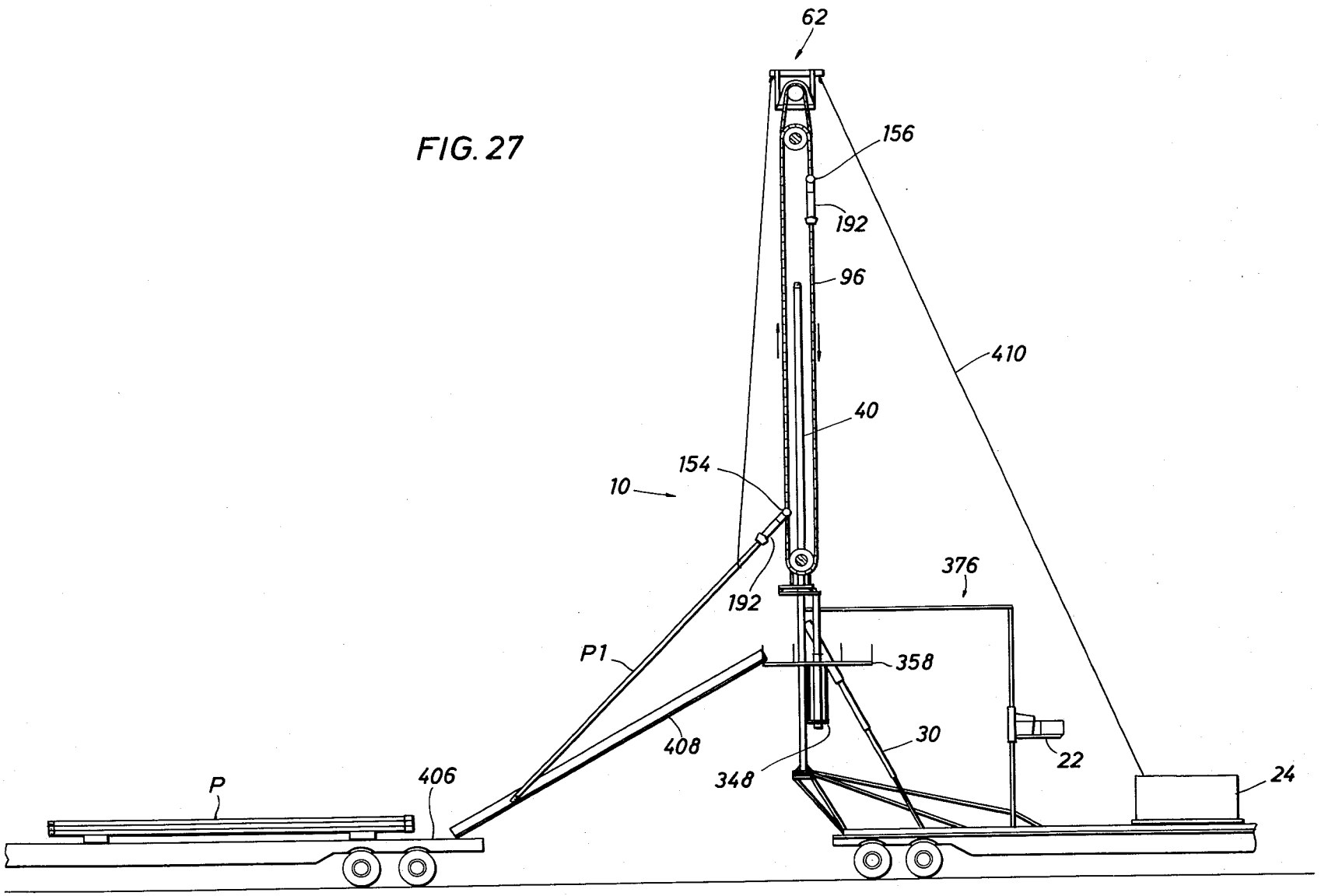
FIG. 27 is a schematic, partial side elevation of the well working rig showing a pipe segment being lifted from a truck bed by one of the elevators.
Figure 29:
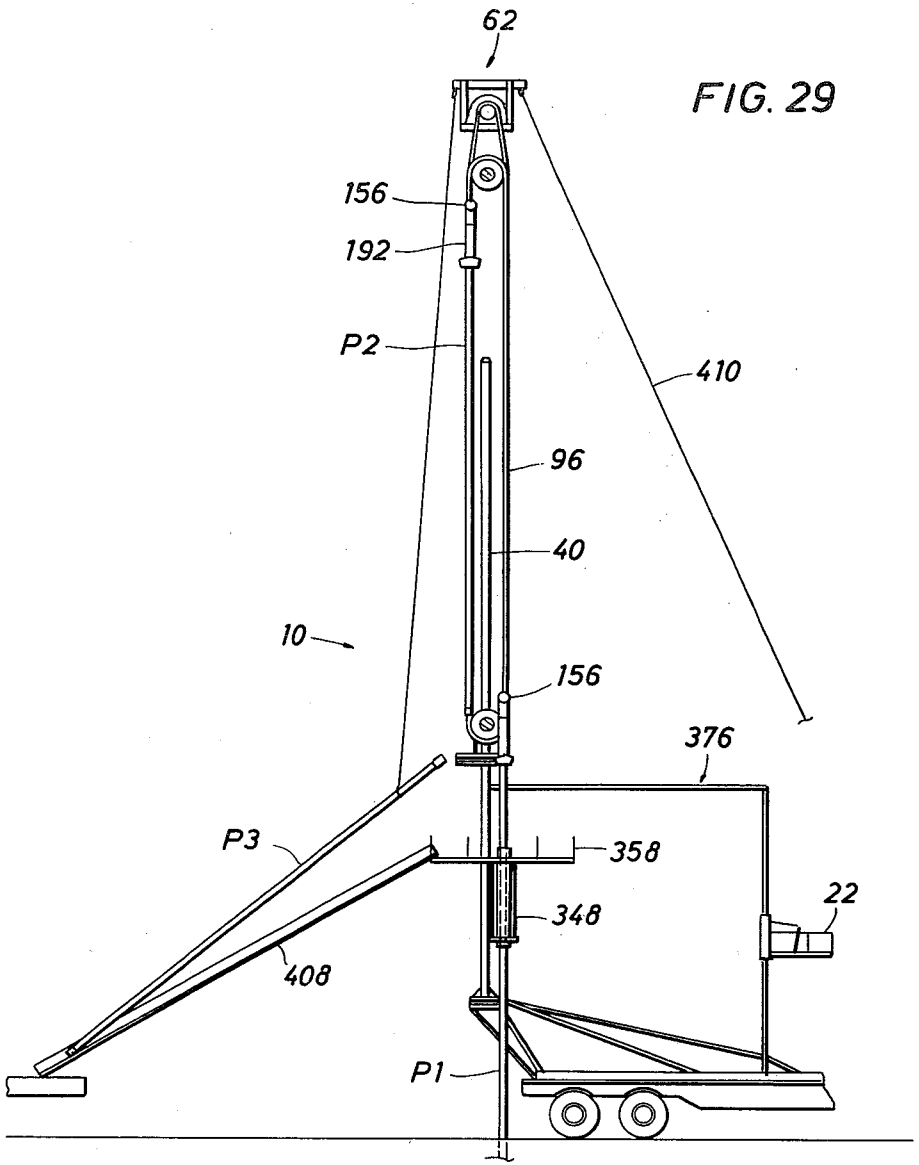
FIG. 29 is a view similar to FIGS. 27 and 28, showing the first pipe segment lowered through the snubber into the well by the first elevator, the second pipe segment raised by the second elevator, and a third pipe segment raised into position by a winch line to be engaged by the first elevator.
Figure 28:
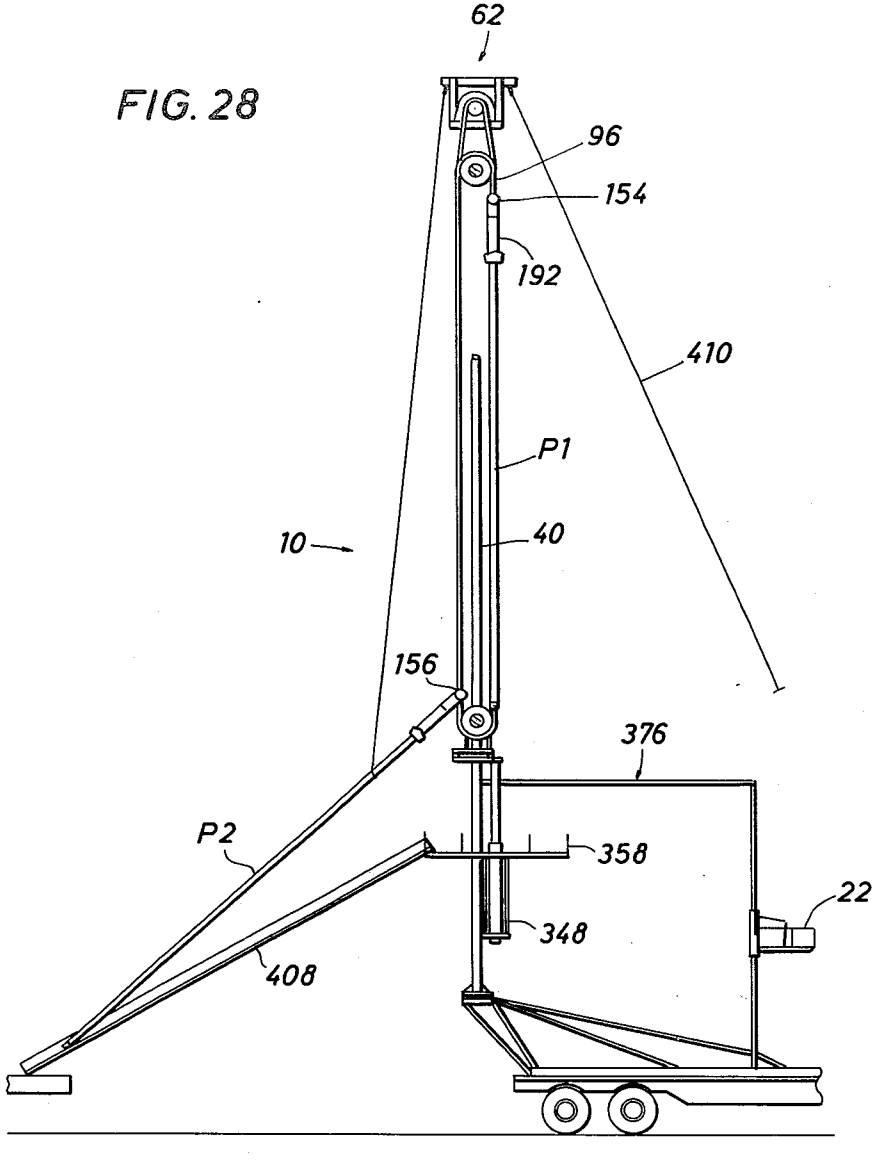
FIG. 28 is a view similar to FIG. 27, but showing a second pipe segment being lifted by the second elevator and the first pipe segment supported over the well by the first elevator.

FIGS. 27–29 illustrate the manipulation of pipe members into, and out of, a well by means of the well working rig 10. For purposes of clarity, only certain features of the apparatus are illustrated in FIGS. 27–29.

The flatbed 18 is maneuvered into position adjacent the well site, and any necessary fine adjustments are made as described to position the skid 16 so that, with the mast 12 erect, the pipe handlers 192 supported along the foward legs of the working chain loops will be aligned with the centerline of the well. The mast 12 is then erected and extended as described hereinbefore. The snubber 348 is swung into position over the well site, and the work basket 358 is unfolded. The leg assemblies 376 are lowered, and the control console 22 raised along the leg segments 382.

A collection of pipe members P may be provided toward the back of the rig 10 as shown in FIG. 27. Such pipe members may be transported by means of a truck 406. If necessary, a pipe ramp 408 may be extended from the truck 406 to the rearward edge of the work platform 358 to support pipe members being moved between the truck 406 and the mast 12. A winch line 410 may be extended from a winch of the power assembly 24 through pulleys contained in the masthead 62 and down to the pipe members P to the rear of the rig 10. A pipe member P1 may be engaged by the winch line 410, and the power assembly 24 operated to retract the winch line. Then, the pipe member P1 is raised toward the mast 12 as the lower end of the pipe member rides along the ramp 408. The upper end of the pipe member P1 may be engaged by the elevator of the pipe handling device 192 supported by, say, the hoisting bar 154. At this point, the hoisting bar 154 is positioned along the back leg of the working chain closed loops, and toward the lower end of the loops; the other hoisting bar 156 is positioned toward the top of the front of the closed loops. With the pipe member P1 engaged by the pipe holder 192, the winch line 410 may be disengaged from the pipe member P1. Then, the power assembly 24, controlled at the control console 22, may be operated to rotate the motors 66 and 68 of the masthead assembly 62 to circulate the working chains and thereby raise the hoisting bar 154 and pipe member P1 supported thereby. As the working chains are so circulated, the pipe member P1 is lifted off of the ramp 408 and assumes a vertical orientation. The hoisting bar 154 passes over the top of the driver wheels 90 and 94, with the pipe member P1 passing generally between the working chains 96 and 100.

FIG. 28 illustrates the position and orientation of the pipe member P1 just after it has passed between the sprocket wheels, and is suspended along the front legs of the working chain closed loops. The other hoisting bar 156 is then positioned at the lower end of the back leg of the working chain closed loops, at a position to receive the next pipe member P2. The winch line 410 is again extended toward the collection of pipe members P to engage the next pipe member P2, and the power assembly 24 is operated to raise the pipe member P2 to the position shown in FIG. 28. Then, with the lower end of the pipe member P2 still resting on ramp 408, the elevator of the pipe handler 192 supported by the hoisting bar 156 is made to engage the upper end of the pipe member P2, and the winch line 410 is disengaged from the pipe member.

Continuing operation of the motors 66 and 68 lowers the pipe member P1 to the snubber 348 which may be used to force pipe members into the well. A blowout preventer and various other well site devices may be positioned between the well and the bottom of the snubber 348 as needed.

If a pipe member is already present in the well, the pipe member P1 may be rotated by appropriate means to effect a threaded connection between the pipe member P1 and the pipe member in the well. The working chains and the hoisting bars may be held stationary during such threading operation, in which event the spring 274 within the pipe handler 192 supporting the pipe member P1 may be compressed in allowing the elevator 284 to be lowered relative to the hoisting bar 154 as the threads of the pipe member P1 advance downwardly along the threads of the pipe member already in the well.

The elevator supported by the hoisting bar 154 may then be disengaged from the pipe member P1, and the motors 66 and 68 operated to advance the working chains again. As the pipe member P1 is lowered through the snubber 348, the second pipe member P2, supported by the hoisting bar 156, is raised to the position shown in FIG. 29. The winch line 410 is employed to engage a third pipe member P3 and raise it to the position shown in FIG. 29 in anticipation of the hoisting bar 154 being moved into position to support the pipe member P3. With the pipe member P1 supported by the snubber 348, the elevator suspended below the hoisting bar 154 is disengaged from the pipe member P1 and the working chains further circulated to move the hoisting bar 154 into the position shown generally in FIG. 27. At that point, the hoisting bar 156 has been advanced to align the second pipe member P2 over the well site for lowering and engagement to the pipe member P1.

These steps are repeated until the desired pipe string is made up on the well. To remove such a pipe string from the well, the aforementioned steps are generally reversed. Thus, an elevator supported by a hoisting bar engages a pipe member projecting upwardly from the well, and the motors 66 and 68 are operated in the opposite rotational sense to raise the hoisting bar above the well site. Thus, the working chains are circulated in the rotational sense opposite to that used to run pipe into the well. Once the pipe member is clear of the snubber 348, it may be disengaged from the pipe member below. Again, the spring 274 in the pipe handler 192 permits, if necessary, upward movement of the pipe member during the unthreading operation without movement of the working chains.

Circulation of the working chains may then be effected to move the pipe member just taken from the well to the position of the back legs of the working chain closed loops. The opposite pipe handler 192 is then in position to engage the next pipe member protruding from the snubber 348. Once the next pipe member has been engaged by the elevator supported by the opposite bar, the working chains are again circulated to lower the first pipe member onto the ramp 408 as the next pipe member is being raised above the snubber 348. With the first pipe member in the position shown generally in FIG. 28 for the pipe member P2, the winch line 410 is used to engage the upper end of that pipe member while the elevator is disengaged therefrom. Then, the first pipe member may be lowered back onto the truck 406, as the working chains are further operated to move the second pipe member removed from the well into position over the ramp 408. The elevator supported by the first hoisting bar may then engage the next pipe member to be removed from the well. This procedure is repeated until all of the pipe members desired are removed from the well and advanced to the truck 406.

Two motor winches 412 and 414 are mounted on the lower ends of the traveling poles 42 and 46, respectively. These motor winches 412 and 414 may be utilized in combination with winch lines extending from the respective motor winches 412 and 414 to one or more pulleys of the masthead assembly 62. Such winch lines may then be extended downwardly to engage various pieces of equipment needed to be moved. For example, one or the other of the motor winches 412 or 414 may be used in conjunction with a winch line to raise or lower the pipe members between the truck 406 and the pipe handlers 192 in the operations described in conjunction with FIGS. 27–29.

The V-shaped passage **310*b* in the end plates 310 and the V-shaped passages 56*b* and 58*b* in the centering plates 48 and 56, respectively, permit movement of the traveling poles 42 and 46 along the corresponding gin poles 40 and 44 while accommodating the attachment of the frameworks 288 and 290 on the front of the gin poles 40 and 44, respectively. Also, the folding leg assemblies 376, as well as the fluid pressure cylinder assemblies 30, are anchored on the fronts of the gin poles 40 and 44. The split in the construction of the front of each of the traveling poles 42 and 46, including the aforementioned V-shaped passages in the various plates, as well as the absence of any cross members or struts along the fronts of the traveling poles also accommodates the attachment of the folding leg assembly 376 and the cylinders 30** on the fronts of the gin poles. Thus, a two-legged telescoping mast is disclosed which also includes the fixture of various apparatus along those portions of the legs, that is, the gin poles, over which other portions are telescoped, that is, the traveling legs.

Figure 34:
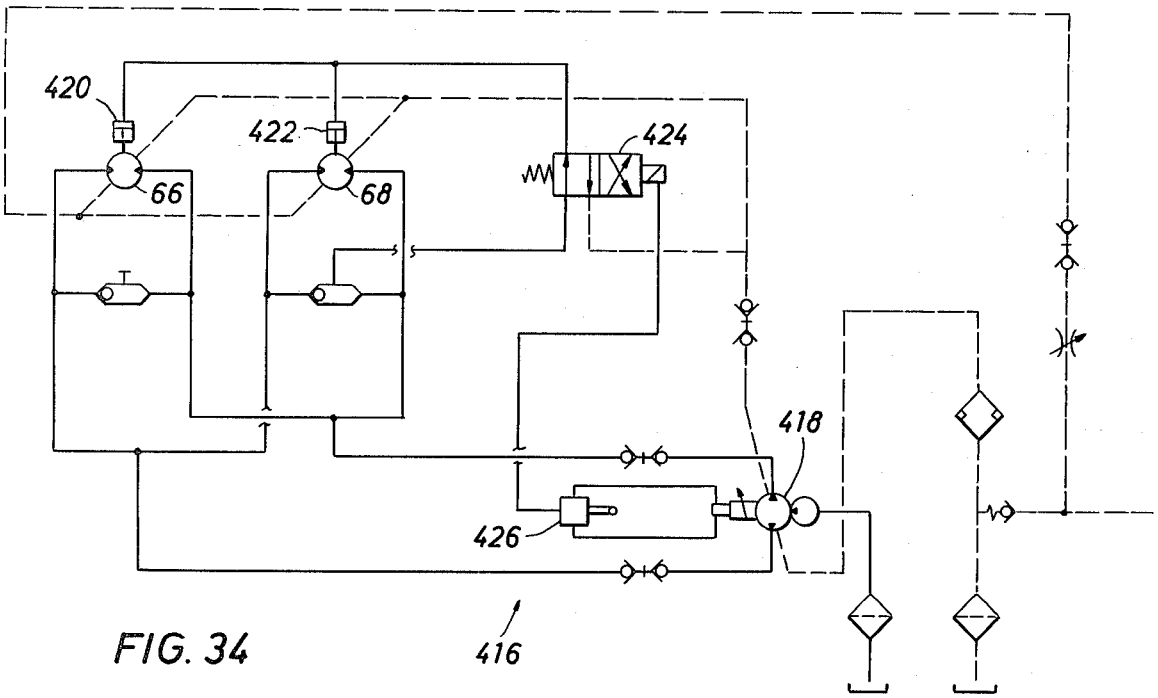
FIG. 34 is a schematic representation of a hydraulic system for operating the well working rig.

A fluid pressure system such as may be utilized in operating the rig 10 is shown schematically at 416 in FIG. 34. The masthead motors 66 and 68 used to drive the chain assembly are shown in a closed hydraulic system, powered by a pump 418. The motors 66 and 68 are thus fed by a common source, and are operated in unison. Reversal of the direction of fluid pressure application in the closed loop system reverses the direction of rotation of the motors 66 and 68. Brake release cylinders 420 and 422 are selectively operable by means of an electrically controlled four-way, two-position valve 424. The electrical control system 426 which operates the valve 424 also controls operation of the pump 418 and, therefore, the application of fluid pressure to the motors 66 and 68.

It will be appreciated that various hydraulic systems may be utilized to operate the motors 66 and 68, as well as the various fluid pressure cylinder systems of the rig 10, and the invention is in no way limited by the particular design features of the circuit 416.

A variation of the double-chain Ferris wheel type drive assembly is shown generally at 82' at FIG. 35, wherein a dual snubber type pipe gripping head, shown generally at 428, takes the place of one of the hoisting bars and elevator type holders. Details of the construction of the gripping head 428 may be appreciated by reference to FIGS. 37–42.

Figure 38:
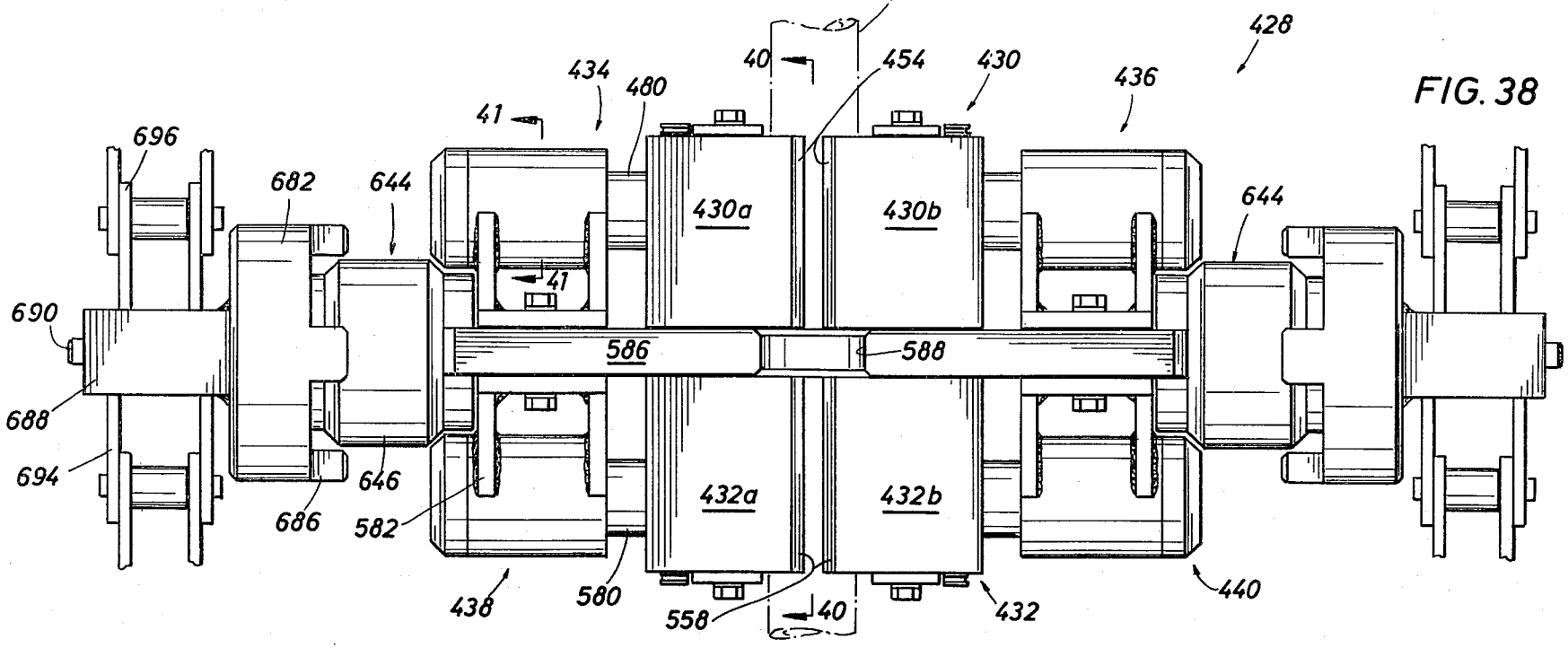
FIG. 38 is a front elevation of the snubbing head of FIG. 37, showing the dual slip bowls positioned in pipe-gripping configurations.

The pipe gripping head 428 includes upper and lower slip bowls, or housings, 430 and 432, respectively (FIG. 38). The upper slip housing 430 comprises two housing members **430*a* and 430*b*, positioned to face each other. The housing member 430*a* may be selectively driven toward and away from the opposing housing member 430*b* by a fluid pressure piston-and-cylinder assembly shown generally at 434. Similarly, the housing member 430*b* may be driven toward and away from the housing member 430*a* by a fluid pressure piston-and-cylinder assembly shown generally at 436. As discussed more fully hereinafter, the two fluid pressure assemblies 434 and 436 may be operated simultaneously to move the upper housing member 430*a* and 430*b* mutually toward each other to encompass and engage a pipe member P, for example, or to withdraw the housing members away from each other, thereby expanding the upper housing 430 to release such pipe member P for movement relative to the gripping head 428**.

The lower slip housing 432 likewise comprises a pair of opposed housing members **432*a* and 432*b* operable by fluid pressure piston-and-cylinder assemblies shown generally at 438 and 440, respectively, for simultaneous movement of the housing members 432*a* and 432*b*** toward or away from each other, for example.

Figure 39:
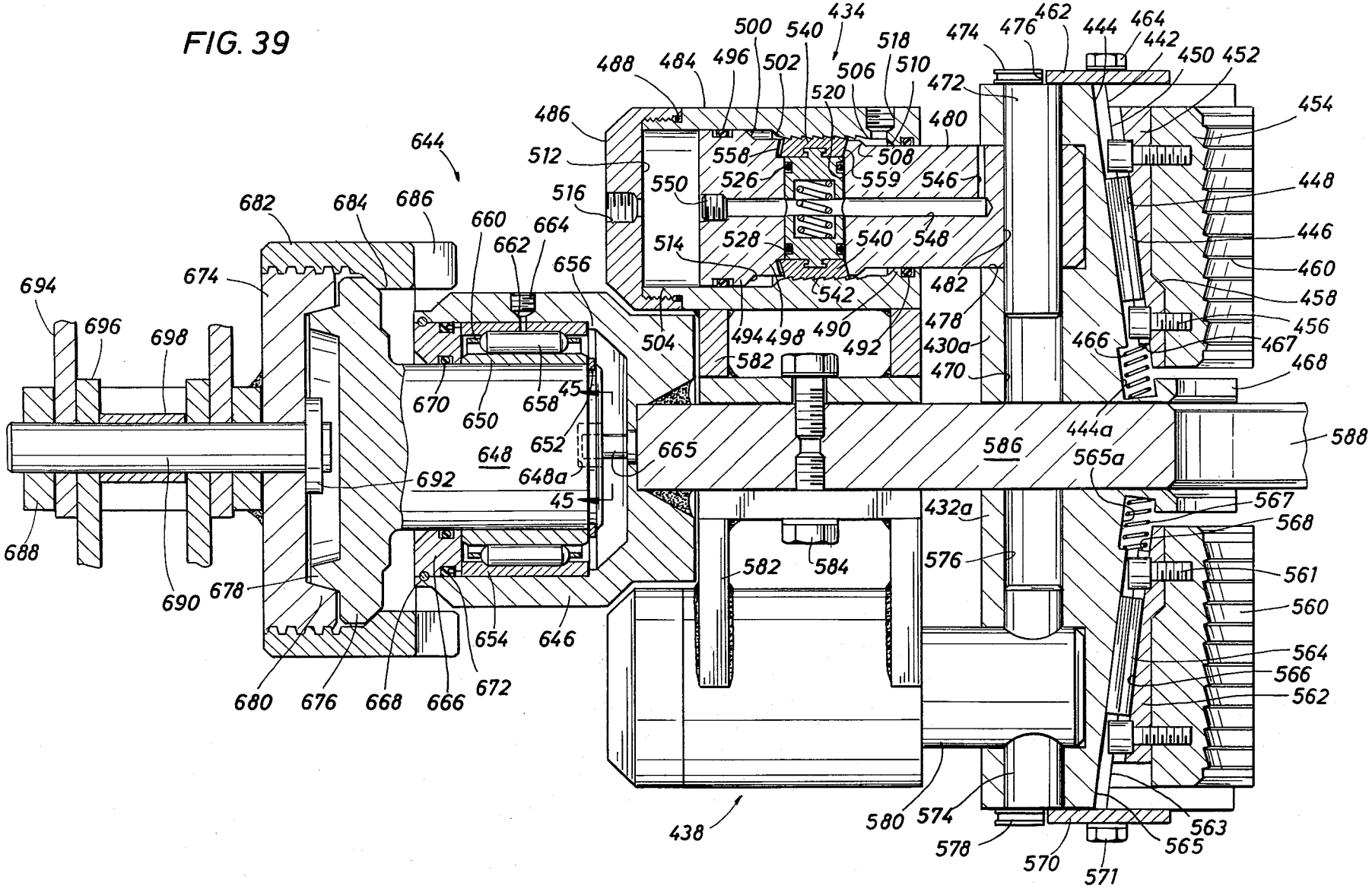
FIG. 39 is an enlarged front elevation in partial section of approximately the left half of the snubbing head as illustrated in FIG. 38, taken along line 39—39 of FIG. 37.

Details of the construction of the slip housings 430 and 432 and of the fluid pressure assemblies may be appreciated by reference to FIG. 39, wherein the interior construction of the slip housing members **430*a* and 432*a*, and that of the fluid pressure assembly 434**, are illustrated.

Figure 37:
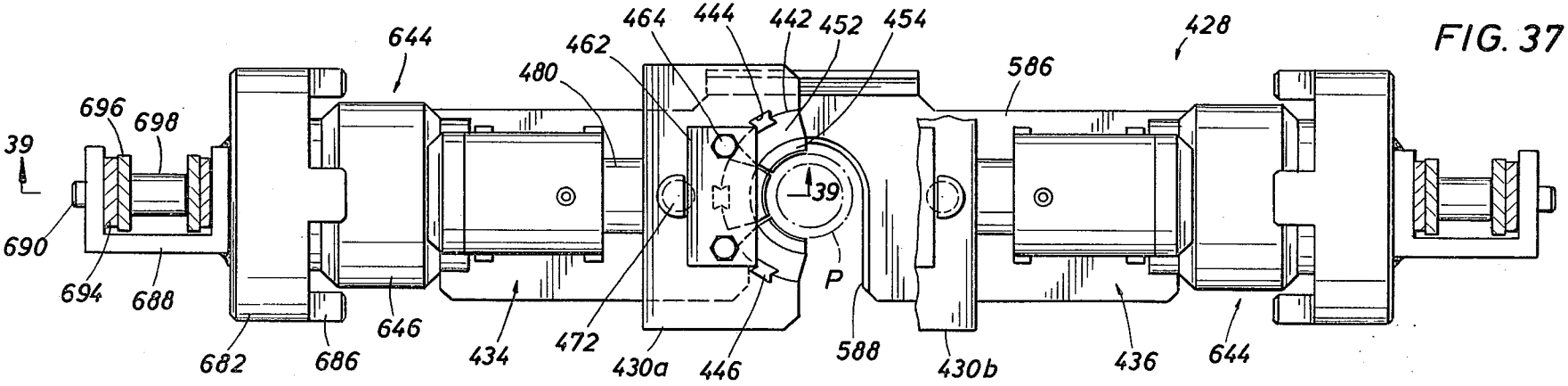
FIG. 37 is a top plan view, partly broken away and partly in section, of the snubbing head.

The housing member **430*a* features an upwardly facing surface in the form of a frustoconical segment 442. The face of the surface 442 is broken by three dovetail slots 444, which receive complementary dovetail locking blocks 446 (FIGS. 37 and 39). Each locking block 446 is also received within a complementary dovetail slot 448 along the back surface 450 of a slip holder 452. Each back surface 450 is in the form of a downardly facing frustoconical segment 442. The interlocking of the block 446 with the two slots 444 and 448 in each case constrains the corresponding slip holder 452 to movement along the housing slot 444, while the surfaces 442 and 450 are maintained generally in contact. Consequently, as discussed in further detail hereinafter, the generally complementary surfaces 442 and 450 establish a wedging effect whereby the housing member 430 may cause the slip holder 452 to be wedged against a pipe segment P (FIG. 37**).

Each of the slip holders 452 carries a dog, or slip member, 454 by a pair of bolts 456 positioned above and below the locking block 446 as shown in FIG. 39. The locking block 446 is thus prevented from sliding out of the slip holder slot 448. The radially outward surface of the slip 454 is generally a cylindrical segment in contact with a complementary surface area of the slip holder 452, with complementary frustoconical segment shoulders abutting at 458, and providing a wedging effect between the slip holder and the slip for transmitting upwardly-directed forces from the slip holder to the slip.

The radially inward surface of each slip 454 features a plurality of horizontal, arcuate gripping edges 460, facing upwardly after the fashion of buttress threads. Thus, the gripping edges 460 are oriented to grip a pipe member P and transmit upwardly-directed forces thereto (FIG. 39).

A keeper plate 462 is held to the top of the housing member 430*a* by bolts 464 and overlies the region within the frustoconical surface segment 442 to prevent movement of the slip holders 452 and slips 454 from within the housing segment. As illustrated in FIG. 39, the height of the housing member 430*a* is sufficient, compared to the sizes of the slip holders 452 and slips 454, to permit limited movement by the slip holders along the corresponding housing member slots 444. A coil spring 466 resides in an enlarged, elongate recess 444*a* below each of the housing dovetail slots 444, and engages a shoulder 467 formed on the back of the corresponding slip holder 452. The springs 466 maintain the respective slip holders 452 generally centered vertically along the slots 444 when no pipe member is being engaged by the corresponding slips 454. Additionally, the housing member 430*a* continues below and under each slip 454 in a generally arcuate lip 468 which limits the downward movement of the slips relative to the housing member when a pipe member is gripped by the slips and is applying downward forces thereto.

The housing member 430*a* features a vertical bore 470 which receives a locking pin 472. The pin 472 includes a head, or flange, 474 which limits the downward movement of the pin within the bore 470. The head 474 is truncated at 476 to permit the retainer plate 462 to overlie a portion of the pin, thereby preventing the pin from moving upwardly relative to the housing member 430*a*.

A transverse bore 478 extends within the housing member 430*a* and intersects the vertical bore 470. A piston arm 480 of the fluid pressure system 434 is received within the bore 478. A transverse bore 482 through the piston arm 480 is positioned in alignment with the housing member bore 470 so that the locking pin 472 passes within the piston arm bore 482 as well as the housing member bore 470. Thus, the locking pin 472 locks the piston arm 480 to the housing member 430*a*.

The fluid pressure assembly 434 further includes a fluid pressure cylinder constructed of a generally tubular body 484 with an end cap 486 threadedly engaged thereto, and sealed to the tubular body by an O-ring seal 488. The opposing end of the tubular body 484 features an inwardly-directed flange 490 closely fitting about the piston arm 480, and sealed thereto by an O-ring seal 492 carried in an appropriate annular groove in the flange.

At the opposite end of the piston arm 480 within the tubular body 484 is a piston head 494, closely fitting within the tubular body and sealed thereto by an O-ring seal 496 carried in an appropriate annular groove in the piston head. Adjacent the piston head 494 is an intermediate piston arm section 498, whose transverse diameter is also intermediate between the sizes of the transverse diameters of the narrower piston arm 480 and the broader piston head 494. Separating the piston head 494 from the intermediate arm section 498 is a frustoconical shoulder 500, generally complementary to a frustoconical shoulder 502 which separates a first interior surface region 504 of the tubular body 484 from a second, or intermediate, interior surface region 506 of the tubular body. Similarly, a frustoconical shoulder 508 separates the intermediate piston arm section 498 from the piston arm shank 480, and is generally complementary to a frustoconical shoulder 510 defining the interior limit of the flange 490 and separating the flange from the intermediate tubular body interior surface region 506. The longitudinal extent of the intermediate piston arm section 498 is generally the same as the longitudinal extent of the tubular body intermediate interior region 506. Consequently, the piston arm 480 may be moved longitudinally to the right, as viewed in FIG. 39, relative to the tubular body 484 so that the shoulders 500 and 502 mutually abut at the same time the shoulders 508 and 510 mutually abut, to limit movement of the piston in that direction.

A first pressure chamber 512 is defined within the tubular body 484 and between the end cap 486 and the opposing face of the piston head 494. The pressure chamber 512 is further defined by the O-ring seal 496. A second pressure chamber 514 is defined within the tubular body 484 and between the 0-ring seal 496 and the O-ring seal 492. The pressure chamber 514 thus extends along the intermediate section 498 of the piston arm and the intermediate interior region 506 of the tubular body.

A threaded port 516 is provided in the end cap 486 for receiving a fluid pressure communication line (not shown) for communicating fluid pressure into or out of the pressure chamber 512. A second threaded port 518 is provided through the tubular body 484 along the intermediate interior region 506 thereof for attachment of a second fluid pressure communication line (not shown) for communicating fluid pressure into or out of the pressure chamber 514. Fluid pressure thus introduced into either the pressure chamber 512 or the pressure chamber 514 operates on the corresponding side of the O-ring 496 to urge the piston head 494 toward or away from the tubular body flange 490, respectively. Introduction of fluid pressure into one or the other of the pressure chambers 512 or 514 may be accompanied by controlled venting of fluid pressure out of the other of the two pressure chambers accordingly to facilitate such movement of the piston head 494 and the piston arm 480. As the piston arm 480 is thus moved due to a pressure differential acting on the O-ring 496 and, therefore, on the piston head 494, the slip housing member 430*a* moves with the piston arm, being fixed against movement relative to the piston arm by the locking pin 472.

The piston arm 480 features a double-acting, locking piston assembly, the details of which may be appreciated by reference to FIGS. 39, 41 and 42. The intermediate piston arm section 498 includes a generally cylindrical transverse bore 520. Two opposed floating pistons 522 and 524 are received within the bore 520, and sealed thereto by O-ring seals 526 and 528, respectively, carried in appropriate annular grooves in the corresponding pistons. The upper piston 522 features, at its downward end, a longitudinally-extending recess 530, which faces a longitudinally-extending recess 532 at the inward end of the second piston 524. A coil spring 534 resides within the recesses 530 and 532, and is held compressed between the two pistons 522 and 524, thereby urging the pistons longitudinally away from each other.

As may be appreciated by reference to FIG. 42 wherein the piston 522 is further illustrated, each of the floating pistons features an arcuate T-ridge 536 extending across the end of the piston opposing the spring-confining recess. The T-ridge 536 is received within a generally complementary T-slot 538 traversing the undersurface of a slip head 540. The slip head 540 is generally arcuate to complement the T-ridge 536 and the end of the floating piston as well as the intermediate surface region 506 of the tubular member 484.

The tubular surface region 506 features a plurality of inwardly-directed edges, or threads 542, facing toward the flange 490 after the fashion of buttress threads. Each of the slip heads 540 features a plurality of outwardly-facing, arcuate gripping ridges, or threads, 544 which are generally complementary to the tubular body threads 542 and face toward the piston head 494 after the fashion of buttress threads.

In uging the floating pistons 522 and 524 mutually apart, the coil spring 534 also urges the piston head gripping edges 544 into meshing engagement with the tubular body edges 542. Due to the orientation of the edges 542 and 544, the slip heads 540 may ratchet over the threaded tubular body surface 506, further compressing the spring 534 as needed, in conjunction with movement of the piston head 494 and piston arm 480 to the right, as viewed in FIG. 39, as the slip housing member 430*a* is moved away from the tubular body 484 toward the retracted configuration. However, the coil spring 534 is of sufficient size and force constant to automatically maintain the slip heads 540 in locking engagement with the threaded surface 506 to prevent movement of the piston arm 480 to the left as viewed in FIG. 39, relative to the tubular body 484, by the intermeshing of the buttress-thread type edges 542 and 544, in the absence of forces urging the pistons 522 and 524 mutually together against the spring. Consequently, the piston arm 480 may be locked againt movement toward the interior of the tubular body 484 by the spring 534 merely being permitted to act on the pistons 522 and 524 without driving forces acting in the opposite sense. With the piston arm 480 thus locked, the housing member 430*a* may be locked in the retracted configuration.

The O-ring seals 526 and 528 sealing the floating pistons 522 and 524 to the piston arm intermediate section 498 further define the pressure chamber 514. When fluid pressure is introduced into the pressure chamber 514, such fluid pressure acts on the O-ring seals 526 and 528, urging the corresponding pistons 522 and 524 radially inwardly to further compress the coil spring 534. When such fluid pressure applied to the seals 526 and 528 is sufficient to overcome the forces of the spring 534, the pistons 522 and 524 are thus moved radially inwardly to compress the spring, and retract the slip heads 540 and their gripping edges 544 from locking engagement with the gripping edges 542 of the interior intermediate surface region 506 of the tubular body 484. Then, the piston arm 480 and the piston head 494 are released from the mechanical lock, provided by the floating piston assembly, for movement to the left, as viewed in FIG. 39, toward the cylinder end cap 486. The same application of fluid pressure in the pressure chamber 514 which thus collapses the double floating piston system to unlock the piston arm 480 from the tubular body 484 acts on the O-ring seal 496 of the piston head 494 to move the piston head and the piston arm toward the cylinder end cap 486. The slip housing member 430*a* is thus propelled by the piston arm 480 to the extended configuration.

The respective faces of the gripping edges 542 and 544 which mesh and contact to prevent movement of the piston arm 480 toward the end cap 486 may be somewhat slanted in that direction (to the left as viewed in FIG. 39) to facilitate disengagement of the edges upon application of fluid pressure in the second chamber 514. Typically, a slant of about 10° from the vertical may be advantageous for that purpose.

A vent passage 546 communicates between the enviroment and the region between the O-ring seals 526 and 528 by means of an intersecting longitudinal passage 548 along the piston arm 480 to prevent pressure or vacuum locks from interferring with movement of the floating pistons 522 and 524 in response to forces generated by the coil spring 534 and to application of fluid pressure in the pressure chamber 514. The passage 548 is drilled along the piston arm 480 from the piston head 494, where the passage is threaded to receive a plug 550 to maintain the integrity of the pressure chamber 512.

As shown in FIG. 41, the intermediate piston arm region 498 features an annular groove 552 at the longitudinal location of the bore 520 to accommodate the slip heads 540. Two arcuate keepers 554 are held to the sides of the piston arm section 498 within the groove 552 by bolts 556, and serve to prevent the slip heads 540 from sliding about the longitudinal axis of the piston arm 480 to disengage from the corresponding T-ridges 536.

As illustated in FIG. 39, the annular wall 558 defining the longitudinal extent of the annular groove 552 toward the piston head 494 is constructed to slant inwardly, typically about 10°, to abut the generally complementary slant of the longitudinal ends of the slip heads 540. The opposing annular wall 559 defining the longitudinal extent of the groove 552 away from the piston head 494 is slanted outwardly at approximately the same angle as the slant of the first wall 558, to abut a generally complementary slant of the longitudinal ends of the slip heads 540. The slanted surface 558 tends to wedge the slip heads 540 away from the tubular body intermediate section 506 to facilitate the racheting of the slip heads along the tubular body gripping edges 542 as the piston arm 480 is propelled away from the end cap 486. With the piston arm intermediate section 498 locked against movement toward the cylinder end cap 486 by the intermeshing of the edges 542 and 544, the slanted surface 559 wedges the piston slip heads 540 into tighter engagement with the threaded interior intermediate tubular body surface 506 in response to forces acting on the piston arm 480 and the piston head 494 toward the end cap 486. The lateral width of the groove 552 between the surfaces 558 and 559 is sufficient to allow the slip heads 540 to adjust to be wedged by the appropriate surface 558 and 559 in response to the tendency of the piston arm 480 to move away from or toward the end cap 486, respectively.

The construction and operation of the fluid pressure assemblies 436, 438 and 440 may be the same as that of the fluid pressure assembly 434. The fluid pressure communication ports of the two assemblies 434 and 436 associated with the upper slip housing 430 may be connected to fluid pressure supply and control systems, or the same system, so that these two fluid pressure assemblies operate in unison to move the two slip housing members 430*a* and 430*b* toward each other simultaneously, and to mutually separate the slip housing members 430*a* and 430*b* by moving them simultaneously toward their corresponding fluid pressure assemblies 434 and 436, respectively. Similarly, the fluid pressure assemblies 438 and 440 may be connected to a common fluid pressure source and control system, for example, to operate in unison, thereby moving the lower slip housing members 432*a* and 432*b* simultaneously toward or away from each other.

Additionally, the construction and operation of the upper slip housing member 430*b* is the same as that of the slip housing member 430*a* described in detail hereinbefore. Thus, with the two slip housing members 430*a* and 430*b* being operated simultaneously by their corresponding fluid pressure assemblies 434 and 436, respectively, the slip housing members 430*a* and 430*b* may be simultaneously moved toward each other to grippingly engage a pipe member P by six gripping slips 454 to transmit upwardly-directed forces to the pipe member. Also, the pipe member P may be released from gripping engagement by the slips 454 by simultaneous movement of the slip housing members 430*a* and 430*b* away from the pipe member in response to operation of the fluid pressure assemblies 434 and 436.

The construction and operation of each of the lower slip housing members 432*a* and 432*b* are mutually alike, and similar to the construction and operation of the upper slip housing members 430*a* and 430*b*. As illustrated in FIG. 39, the slip housing member 432*a*, complete with a set of three pipe gripping slips 560 mounted by bolts 561 on slip holders 562 which are held to a complementary frustoconical wedging surface segment 563 of the housing member by a dovetail locking block 564, is essentially an inverted version of the upper slip housing member 430*a*. The gripping edges of the slip members 560 are oriented to engage a pipe member and to transmit thereto downwardly-directed forces (as viewed in FIG. 39). Each block 564 is received by complementary dovetail slots 565 and 566 in the surface 563 and corresponding slip holder 562, respectively. A coil spring 567 resides in an enlarged, elongate recess 565*a* above each of the housing dovetail slots 565, and engages a shoulder 568 formed on the back of the corresponding slip holder 562. A keeper plate 570, held to the bottom of the housing member 432*a* by bolts 571, underlies the slip holders 562 to prevent them from falling from within the housing member. The springs 567 cushion movement of the slip holders 562 upwardly along the housing slots 565. The keeper plate 570 also maintains a locking pin 574 within a bore 576 in the lower slip housing member 432*a*, a truncated pin head 578 limiting further movement of the pin within the housing bore. The pin 574 serves to anchor a piston arm 580 of the fluid pressure assembly 438 to the slip housing member 432*a*.

Each of the fluid pressure assemblies 434–440 is mounted on a bracket 582 which is held by one or more bolts 584 to a center beam 586. Thus, as the fluid pressure assemblies 536–540 are selectively operated to open or close one or the other or both of the slip housings 430 and 432, the motion of the slip housing members occurs relative to the central beam 586 due to the anchoring of the fluid pressure assemblies to that central beam. The central beam 586 features a transverse, elongate recess 588, characterized by an arcuate inner end. As illustrated in FIGS. 37 and 38, the recess 588 is positioned to receive a pipe member P which is thus encompassed and gripped by the slips of either or both of the slip housings 430 and 432 in the retracted configuration. A gusset, or beam 589 is welded along the central beam 586 longitudinally aligned with the recess 588 and on the opposite side of the central beam to strengthen the central beam at that point (FIG. 40).

Figure 43:
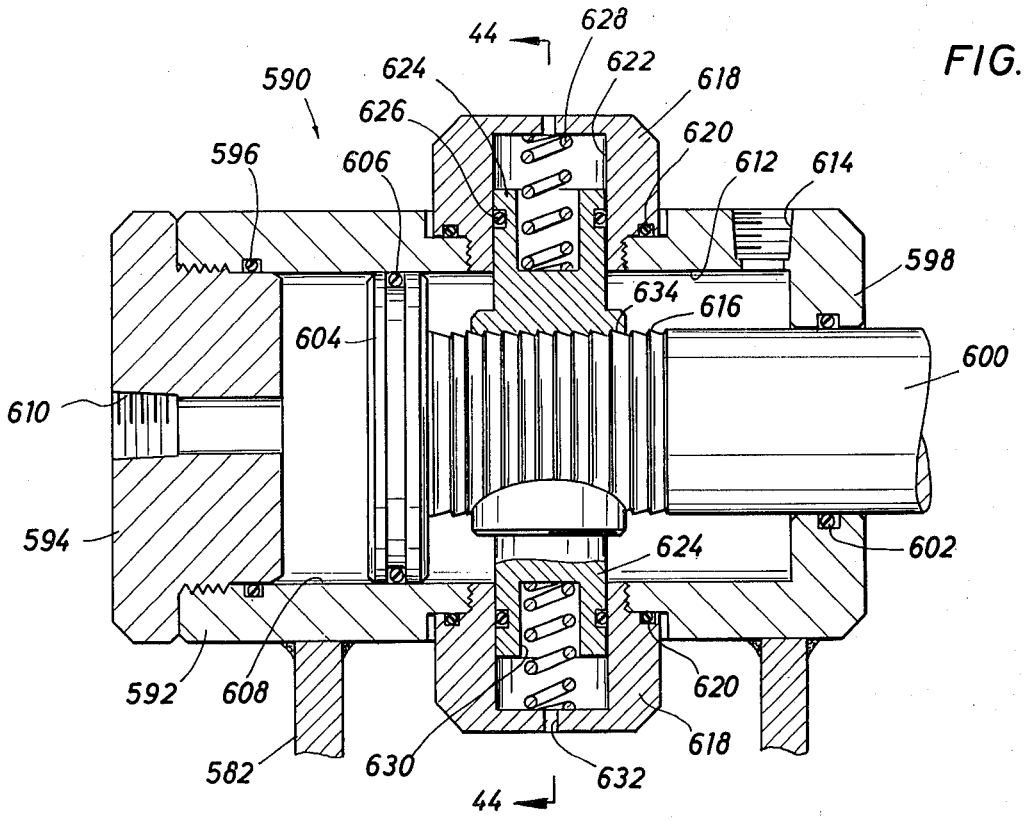
FIG. 43 is an enlarged side elevation in partial section of a variation of the snubber fluid pressure drive assembly.
Figure 44:
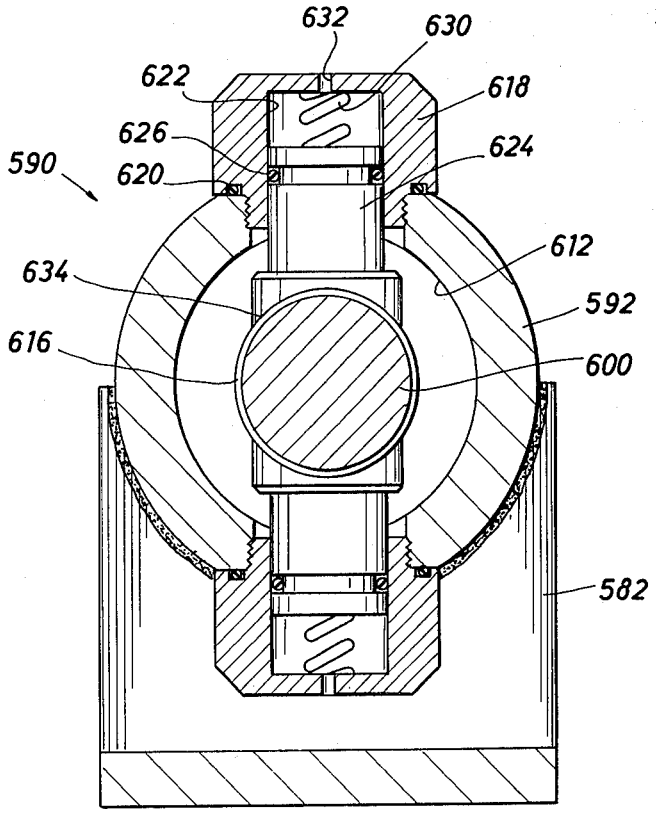
FIG. 44 is a vertical cross section of the drive assembly shown in FIG. 43, taken along line 44—44 of FIG. 43.

An alternate version of a fluid pressure assembly which may be used in place of one or all of the fluid pressure assemblies 434–440 described hereinbefore is illustrated in FIGS. 43 and 44, shown generally at 590. The fluid pressure assembly 590 includes a generally tubular body 592 closed at one end by an end cap 594 which is sealed to the tubular body by an O-ring seal 596 carried in an appropriate groove. The opposite end of the tubular body 592 features an inwardly-directed annular flange 598 which is closely fitting about a piston arm 600, and sealed thereto by an O-ring seal 602 carried in an appropriate groove in the flange. The piston arm 600 may extend and be anchored to a slip housing member such as 430*a*, for example.

The opposite end of the piston arm 600 within the tubular body 592 ends in a piston head 604 which is closely fitting within the tubular body and sealed thereto by an O-ring seal 606 carried in an appropriate groove in the piston head. Thus, a first pressure chamber 608 is defined within the tubular body 592 between the end plate 594 and the piston head 604 and its seal 606. Access to the pressure chamber 608 is provided by a threaded port 610 in the end plate 594 which may receive a fluid pressure communication line (not shown) whereby fluid pressure may be communicated into or out of the pressure chamber.

A second pressure chamber 612 is defined within the tubular body 592 between the seals 602 and 606. Access to the second pressure chamber is provided by a threaded port 614 which may receive a fluid pressure communication line (not shown) for communicating fluid pressure into or out of the second pressure chamber. As in the case of the previously described fluid pressure assembly 434, fluid pressure differential selectively established across the piston head seal 606 by appropriate communication of fluid pressure to and/or from the pressure chambers 612 and 608 urges the piston head 604 and the piston arm 600, as well as the attached slip housing member, toward or away from the tubular body end cap 594. Also, the fluid pressure assembly 590 may be anchored to the central beam 586 by a bracket 582 as in the case of the previously described fluid pressure assembly 434.

Toward the piston head 604, the piston arm 600 features a plurality of annular gripping edges, or threads, 616 generally facing toward the piston head after the fashion of buttress threads. The tubular body 592 is broken by a pair of laterally extending piston housings 618, threadely engaged in appropriate bores through the wall of the tubular body and sealed to the tubular body by O-ring seals 620. The interior of each housing 618 is in the form of a cylindrical recess 622 which receives a floating piston 624 which is closely fitted within the walls of the cylindrical recess and sealed thereto by O-ring seals 626 carried in appropriate grooves in the floating pistons. A coil spring 628 resides within each housing 618 and extends within an annular recess 630 in the floating piston 624 contained within the housing, and urges the piston radially inwardly toward the piston arm 600. A vent passage 632 is provided in each housing 618 to prevent pressure or vacuum locks from interfering with movement of the floating piston 624.

The head of each piston 624 features a plurality of transversely extending, arcuate gripping edges, or threads, 634 which face away from the piston head 604 and are generally complementary to the annular edges 616 of the piston arm 600. The coil springs 630 thus urge the pistons 624 into gripping engagement with the piston arm 600 by means of the piston edges 634 meshing and locking with the piston arm edges 616. With the threads 634 and 616 thus meshed, and the springs 630 holding the pistons 624 in gripping engagement with the piston arm 600, the piston arm 600 is prevented from moving longitudinally toward the tubular body end cap 594 due to the orientation of the gripping edges 616 and 634. However, the piston arm 600 may be moved away from the end cap 594, with the piston arm edges 616 ratcheting along the floating piston edges 634 as the floating pistons 624 are moved radially outwardly against the springs 628.

The two floating pistons 624 are provided on opposite sides of the tubular body 592 and of the piston arm 600 to balance the forces thereby applied transversely to the piston arm. The O-ring seals 626 further define the pressure chamber 612. Further, application of fluid pressure to the pressure chamber 612 acts on the seals 626 to move the floating pistons 624 radially outwardly, further compressing the springs 628 and releasing the floating piston gripping edges 634 from meshing and locking with the piston arm edges 616, thus permitting the piston arm to be moved longitudinally toward the end cap 594. To facilitate such disengagement of the gripping edges, the abutting faces of the edges 616 and 634 may be slanted as discussed in relation to the edges 542 and 544 of the fluid pressure assembly 434. The same fluid pressure introduced into the pressure chamber 612 to free the piston arm from the floating pistons 624 acts on the seal 606 and the piston head 604 to drive the piston arm 600 toward the end cap 594. A pressure differential acting across the O-ring seal 606 in the opposite direction may move the piston head 604 and the piston arm 600 away from the end cap 594, causing the piston arm edges 616 to ratchet between the floating piston edges 634 and compressing the springs 630 as noted hereinbefore. It will be appreciated that the operation of the fluid pressure assembly 590 is generally the same as the operation of the fluid pressure assembly 434 as previously described. Regardless of which version of the fluid pressure assembly is utilized, the upper slip housing members **430*a* and 430*b* may be operated simultaneously as described hereinbefore, and the lower slip housing members 432*a* and 434*b*** may also be mutually simultaneously operated as discussed.

Each of the two ends of the central beam 585 are welded, for example, to a swivel assembly shown generally at 644 in FIGS. 37 and 38, with one of the swivel assemblies 644 illustrated in detail in FIG. 39, both assemblies being alike. Each swivel assembly 644 includes a housing 646, which is welded to the end of the central beam 586. The housing 646 receives a longitudinally extending hub 648. An inner race 650 circumscribes the hub 648 within the housing 646, and is held in place partly by a snap ring 652 residing in an appropriate annular groove about the end of the hub. An outer annular race 654 also circumscribes the hub 648, and fits against the interior surface of the generally tubular housing 646, and is held in place partly by a housing shoulder 656. A plurality of roller bearings 658 is arrayed about an approprite cylindrical frame 660 and confined between the inner and outer races 650 and 654, respectively. A threaded port and passageway 662 through the wall of the housing 646 and through the outer race 654 provides means for introducing lubricating fluid between the housing and the hub 648 to lubricate the roller bearings 658. The threaded port is sealed by a plug 664. The lubricated roller bearings 658 thus provide a relatively friction-free suspension between the housing 646 and the hub 648 to permit the pipe gripping assembly 428 to rotate about the longitudinal axis of the central beam 586 relative to the hubs 648 at each end of the central beam. To limit such rotation, a pair of pins 665 may be set in appropriate bores in the end of the central beam 586 and passed through appropriate holes in the housing 646 to be received in an elongate slot **648*a* in the end of the hub 648. As may be appreciated by reference to FIGS. 39 and 45, the degree of rotation permitted the central beam 586 relative to the hub 648 is determined by the thickness of the pins 665 and the mutual separation thereof, in addition to the width of the slot 648*a*. Sufficient rotation may be permitted the snubbing head 428 to insure any needed movement in handling pipe members in snubbing operations as discussed hereinafter, for example. Alternatively, the pins 665 may be deleted from the snubbing head 428 to permit its complete rotation as the working chains 96 and 100 are moved about their respective closed loop paths for moving pipe entirely by means of one or more snubbing heads 428**.

The generally annular region between the hub 648 and the housing 646 containing the roller bearings 658 is closed by a ring 666 which is closely fitting within the housing and about the hub, and is locked to the housing by a wire retainer 668 in appropriate grooves in the ring and housing. An O-ring seal 670 carried in an appropriate groove in the ring 666 seals the ring to the hub 648. A U-seal 672 carried in an appropriate groove in the ring 666 seals the ring to the housing 646. The ring 666 abuts the inner and outer races 650 and 654, respectively, to further confine and prevent longitudinal movement of the races.

The hub 648 is joined to an end plate 674 by a hammer union as follows. The hub 648 extends radially outwardly in a flange 676, from which longitudinally protrudes an annular shoulder 678 which is received within the confines defined by an annular shoulder 680 extending longitudinally from the end plate 674 in the opposite sense of the shoulder 678. As illustrated in FIG. 39, the shoulder 678 features an external frustoconical shape generally complementary to the abutting interior frustoconical shape of the shoulder 680. The two annular shoulders 678 and 680 are generally wedged together in response to a hammer nut 682 threadedly engaging the end plate 674 and being tightened thereto, with a radially inwardly extending flange 684 of the nut 682 overlapping and abutting the hub flange 676 and driving the latter toward the end plate 674. The hammer nut 682 includes a plurality of lugs 686 by which the threaded engagement between the nut and the end plate 674 may be tightened.

A U-shaped retainer 688 is welded to the end plate 674. A pin 690 passes through holes in both side walls of the retainer 688 as well as a hole in the end plate 674. The enlarged head 692 of the pin 690 is confined within the annular space between the end plate 674 and the hub 648 to prevent the pin from moving longitudinally out of the retainer holes. The pin 690 also passes through holes in two links 694 and 696 of the working chain 96 or 100, as well as a spacer sleeve 698. The pipe gripping head 428 is thus integrated into the two chains 96 and 100 in essentially the same manner as are the hoisting bars 154 and 156 as previously described.

With the pipe gripping head 428 thus mounted on the working chains 96 and 100 by the swivel assemblies 644 (and the limit pins 665 deleted), the pipe gripping head may assume any rotational orientation about its longitudinal axis. Further, the pipe gripping head 428 may be carried by the working chains 96 and 100 throughout their complete path of rotation, in just the same manner that the hoisting bars 154 and 156, supporting pipe holders such as 192 for example, may be circulated with the working chains. Further, pipe members P may be supported by the snubbing head 428 as this pipe gripping device is thus circulated by the working chains 96 and 100, with the pipe members passing between the working chains from one side of the mast 12 to the other.

The hoisting mechanism 286 may also be used in conjunction with a pipe gripping head 428 to extend or collapse the mast 12 in the same manner as the hoisting bars 154 and 156 may be used for these purposes. For example, when the arms 296 of the hoisting mechanism 286 are extended, the saddles 302 may receive the housings 646 (or the nuts 682) of the swivel assemblies 644 rather than a hoisting bar 154 or 156. Then, appropriate operation of the motors 66 and 68 will effect extension or collapse of the mast 12 as discussed hereinbefore.

A pair of pipe gripping heads 428 may be used in place of both of the hoisting bars 154 and 156 and pipe holders such as 192. The process of making up a pipe string in a well as well as the process of removing a pipe string from a well, as described hereinbefore and illustrated in FIGS. 27–29, may be conducted with two gripping heads 428. The pipe members are then supported and manipulated by means of the pipe gripping heads 428 rather than the pipe holders 192.

The use of a pipe gripping head 428 for inserting pipe within a well, and for drawing pipe from a well, may be appreciated by reference to FIGS. 36A–E, herein a pipe gripping head 428 is illustrated mounted on a double-chain Ferris wheel type drive assembly 82' in conjunction with a pipe holder 192', which may be of the type previously described as supported by the hoisting bars 154 and 156 (although two pipe gripping heads 428 may be used).

With the drive assembly 82' positioned over a well, the pipe gripping head 428 may be used as a rapid snubber in conjunction with a snubbing head 348', which may be provided by the snubber 348 supported by the framework 350 and the mast 12 as previously described, or just a single, fixed snubbing head. Consequently, a movable snubbing head 428 is provided in conjunction with a fixed snubbing head 348'.

A pipe member P may be raised by the pipe holder 192' from a pipe storage area (not shown) after the fashion described hereinbefore in conjunction with FIGS. 27–29. Thus, the drive assembly 82' is operated to elevate the pipe holder 192' to raise the pipe member P as shown in FIG. 36A, and to transport the pipe member between the working chain loops 96 and 100 to a position directly over the well, as shown in FIG. 36B. The pipe member P may then be lowered within the fixed snubbing head 348' which is operated to grip the pipe member P. The pipe member P is then released from the pipe holder 192', and the drive assembly 82' is again operated to advance the pipe gripping head 428 down along the pipe member, as indicated in FIG. 36C.

The pipe member P may be received within the recess 588 of the central beam 586, with the upper and lower gripping heads 430 and 432 both in their respective extended configurations, wherein the slip housing members **430*a*, 430*b*, 432*a* and 432*b* are each positioned away from the recess to allow free passage of the pipe within the recess. With the pipe thus partially enclosed within the recess 588, the lower slip housing members 432*a* and 432*b* are propelled radially inwardly by their respective fluid pressure assemblies 438 and 440 to grip the pipe member P with the slips 560 (FIG. 39). Then, the slip heads 540 engage the grooved intermediate inner surfaces of the tubular bodies 484 to lock the slip housing members 432*a* and 432*b* in position relative to the pipe member P, with the slips 560 in gripping engagement with the pipe member. The gripping head 428 will then retain such gripping engagement with the pipe member P even if the fluid pressure is released from the first pressure chambers 512 of the fluid pressure assemblies 438 and 440. The driving assembly 82' may then be operated to propel the gripping head 428 downwardly toward the well, with the fixed snubbing head 348 in release configuration, thereby allowing the pipe member P to be driven downwardly for the stroke of the gripping head 428. The sloped, generally complimentary surfaces of the housing member, the slip holders 562 and the slips 560** combine to provide a wedging effect to facilitate transmission of downwardly directed forces to the pipe to drive the pipe into the well against well fluid pressure.

At the bottom of the stroke, as shown in FIG. 36D, the pipe member P has been advanced toward and into the well a distance equal to the stroke of the gripping head 428. Then, the fixed snubbing head 348' may be operated to grippingly engage and anchor the pipe member P, after which fluid pressure may be applied to the second pressure chambers 514 to drive the floating pistons 522 and 524, with their slip heads 540, radially inwardly. The piston arms 580 are then released from locking engagement with the tubular members 484 and are driven radially outwardly relative to the pipe member P by the fluid pressure introduced into the chambers 514, thus removing the slips 560 from gripping engagement with the pipe member P.

The drive assembly 82' is operated to raise the gripping head 428 relative to the pipe member P. The lower slip housing members **432*a* and 432*b* are then propelled radially inwardly to again grip the pipe member P by means of the slips 560, as shown in FIG. 36E. The fixed snubbing head 348' then releases the pipe member P, which is driven downwardly the distance of another stroke of the pipe gripping head 428, by means of operation of the drive assembly 82'**.

This stroking procedure is repeated until the pipe member P is left inserted in the well, and extending a short distance above the fixed snubbing head 348'.

With the gripping head 428 released from the pipe member P the drive assembly 82' is again used to raise a second pipe member by means of the pipe holder 192'. The second pipe member is manipulated to a position over the pipe member P already inserted within the fixed snubbing head 348', and is rotated to threadedly engage the two pipe members. The pipe holder 192' is released from the second pipe member, and the drive assembly 82' is operated to position the gripping head 428 at a location along the second pipe member.

The second pipe member is driven into the well attached to the first pipe member in the same fashion that the first pipe member was inserted within the well. Thus, the gripping head 428 is operated to grippingly engage the second pipe member by means of the slips 560 of the lower slip housing 432. The fixed snubbing head 348' releases the first pipe member P, and the drive assembly 82' is operated to propel the gripping head 428 and two pipe members downwardly relative to the well. At the end of a stroke by the gripping head 428, the fixed snubbing head 348' again grippingly engages the second pipe member in the string, and the gripping head 428 is released from the pipe member. The drive assembly 82' is operated to raise the gripping head 428 along the second pipe member, and the lower slip housing 432 is operated to grippingly engage the second pipe member again. The fixed snubbing head 348' releases the pipe members, which are then further driven into the well by a downward stroke of the pipe gripping head 428.

The process is repeated until the desired amount of pipe is made up and inserted within the well. The present invention thus provides a high speed snubbing device which allows the stroke of the traveling snubbing head 428 to be relatively rapidly effected by means of the double chain drive assembly 82'. Further, the number of strokes and the stroke length of the traveling snubbing head 428 used for each new pipe member may be varied as well conditions dictate, for example, by merely varying the position along the pipe to be gripped by the snubbing head at the beginning of the stroke, and/or the position of the head 428 the end of the stroke.

When well conditions and the amount of pipe made up into a string inserted within the well are such that the weight of the pipe in the well balances or exceeds the upwardly-directed forces acting on the pipe string due to well fluid pressure, the pipe gripping head 428 may be utilized to further make up and insert pipe within the well by use of the upper slip housing 430. The gripping head 428 provides support for at least some of the weight of the pipe string by means of the upwardly-directed edges 460 of the upper slips 454. Just as in the case of the gripping head upper slip housing 430 being used to lift pipe as discussed hereinafter, the combination of sloped surfaces of the housing members 430*a* and 430*b*, and of the slip holders 452 and slips 454 provides a wedge effect for transmitting upwardly-directed forces to the pipe. The pipe gripping head 428 may be used to complete a snubbing operation, even where the weight of the pipe string being inserted within the well exceeds the upwardly-directed forces acting on the pipe string due to the well pressures, without inverting the gripping head slips, for example.

Alternatively, the pipe gripping head 428 may be provided with but one slip housing, and may be used in an upright or an inverted orientation, depending on the well conditions. The gripping head 428 in that case maybe selectively inverted by rotation of the gripping head about the swivel assemblies 644, for example. The pins 665 may be deleted to permit such rotation.

Pipe may be removed from a well, under any pressure conditions, by use of the pipe gripping head 428 by generally reversing the steps described hereinbefore. The pipe may be removed by use of a pair of gripping heads 428 positioned at opposed locations along the drive assembly 82', or by use of a single pipe gripping head 428 and a pipe holder 192'. Where, for example, the pipe string weight must be supported to raise the pipe from the well, the pipe gripping head 428 is positioned over the end of a pipe string extending above and gripped by the fixed snubbing head 348' or some other pipe gripping device. The upper slip housing 430 is operated to grip the pipe and raise the pipe string with the fixed gripping device in release configuration, in much the same fashion that the pipe holders 192 were used to raise pipe from the well as described in conjunction with FIGS. 27–29.

When a pipe member clears the lower gripping device 348', that gripping device is operated to anchor the remainder of the pipe string, and the raised pipe gripping head 428 is disengaged from the raised pipe. The drive assembly 82' is operated to position the pipe holder 192' in engagement with the raised pipe member, which is then separated from the remainder of the pipe string and placed back in the storage area, again by operation of the drive assembly 82'. The gripping head 428 is then positioned to engage the pipe string extending above and gripped by the fixed gripping device 348', and the process is repeated until all pipe desired is removed from the well.

Under conditions wherein the downhole fluid pressure exceeds the weight of the pipe string remaining in the well, the gripping head 428 may be utilized as described to remove and disengage pipe members from the pipe string. However, to accomodate the upwardly-directed forces tending to drive the pipe string out of the well, the lower slip housing 432 with its slips 558 may be used to grip the pipe and control the ascent of the pipe string when the pipe string is released from gripping engagement by the fixed gripping device 348'.

The present invention thus provides a pipe gripping head which may be utilized for rapid insertion or removal of pipe relative to a well by means of a double-chain Ferris wheel type drive assembly. Since the locking of the slip housing members is mechanical, the fluid pressure used to drive the slip housing members into gripping engagement with pipe members may be reduced after the pipe members have been so engaged. Further, since the fluid pressure is not used to maintain the slips in gripping engagement with the pipe, the fluid pressure thus utilized may be either hydraulic or gaseous. While threaded gripping slips have been described and illustrated herein, the means for so mechanically locking the pipe gripping head 428 in gripping engagement with a pipe member may take a variety of forms. Thus, while floating pistons with threaded heads which mesh with threads either on the pistons or the cylinders of the fluid pressure assemblies are described and illustrated, the floating pistons may simply engage in appropriate holes to so lock the piston arms relative to the cylinders.

The foregoing disclosure and description of the invention is illustrative and explanatory thereof, and various changes in the method steps as well as the details of the illustrated apparatus may be made within the scope of the appended claims without departing from the spirit of the invention.

I claim:

1. Apparatus for gripping pipe members comprising:

a. gripping means selectively movable generally transversely to such pipe member between a retracted configuration in which said gripping means may grippingly engage such pipe member, and an extended configuration in which said gripping means is released from gripping engagement with such pipe member; and b. propulsion means connected to said gripping means, and including fluid pressure means comprising piston means and cylinder means selectively operable in response to fluid pressure for so selectively moving said gripping means between said retracted and extended configurations, and lock means comprising at least one locking piston carried by said piston means, movable generally laterally relative to said piston means to selectively grippingly engage the corresponding cylinder means for releasably locking said fluid pressure means whereby said gripping means may be locked in said retracted configuration.

2. Apparatus as defined in claim 1 wherein said lock means further comprises spring means for biasing said locking pistons into gripping engagement with the corresponding cylinder means, and said locking pistons may be released from gripping engagement with the corresponding cylinder means by application of fluid pressure.

3. Apparatus as defined in claim 2 wherein:

a. each of said piston means so carries two locking pistons positioned generally mutually longitudinally aligned along said piston means, and oriented to move transversely to said piston means toward and away from each other to disengage from and to engage the corresponding cylinder means, respectively;

b. said spring means comprises a spring positioned generally between the two locking pistons carried by each piston means whereby each said spring urges the corresponding two locking pistons mutually apart and toward engagement with the corresponding cylinder means; and c. said locking pistons carried by each of said piston means are selectively moveable mutually toward each other to disengage from the corresponding cylinder means upon application of fluid pressure.

4. Apparatus as defined in claim 1 wherein said lock means further comprises slip means operable for automatically releasably locking said piston means and said cylinder means against mutual relative movement with said gripping means in said retracted configuration, said slip means being releasable by application of fluid pressure.

5. Apparatus as defined in claim 1 wherein said lock means is operable for locking said gripping means in said retracted configuration by operation of biasing means, and said lock means is releasable from said locking configuration by operation of fluid pressure.

6. Apparatus as defined in claim 1 wherein said gripping means further comprises slip means mounted on at least two members so movable by operation of said propulsion means between said extended configuration and said retracted configuration.

7. Apparatus as defined in claim 1 wherein said gripping means comprises a first gripping assembly including means for engaging such pipe members and transmitting force thereto in one longitudinal direction sense of such pipe members, and a second gripping assembly including means for engaging such pipe members and transmitting force thereto in the opposite longitudinal direction sense of such pipe members.

8. Apparatus as defined in claim 7 wherein each of said first and second gripping assemblies is independently, selectively operable to grip and release pipe members.

9. Apparatus as defined in claim 7 wherein said lock means is operable for locking said gripping means in said retracted configuration by operation of biasing means, and said lock means is releasable from said locking configuration by operation of fluid pressure.

10. Apparatus for manipulating pipe members comprising:

a. mast means;

b. continuous chain means, extending generally longitudinally along at least a portion of said mast means;

c. wheel means mounted on said mast means for maintaining said chain means so extended;

d. power means, positioned generally toward the first end of said mast means, for selectively pulling on said chain means to propel said chain means about said wheel means in a first rotational sense or a second rotational sense opposite the first rotational sense;

e. means for selectively engaging pipe members, joined to said continuous chain means and movable therewith as said power means so propels said chain means, and including:

i. gripping means selectively movable generally transversely to such pipe member between a retracted configuration in which said gripping means may grippingly engage such pipe member, and an extended configuration in which said gripping means is released from gripping engagement with such pipe member;

ii. propulsion means, connected to said gripping means, and including fluid pressure means comprising piston means and cylinder means selectively operable in response to fluid pressure for so selectively moving said gripping means between said retracted and extended configurations; and iii. lock means including at least one locking piston carried by said piston means, movable generally laterally relative to said piston means to selectively grippingly engage the corresponding cylinder means for releasably locking said fluid pressure means against movement when said gripping means is in said retracted configuration.

11. Apparatus as defined in claim 10 wherein said lock means is operable for locking said gripping means in said retracted configuration by operation of biasing means, and said lock means is releasable from said locking configuration by operation of fluid pressure.

12. Apparatus as defined in claim 10 wherein said means for engaging pipe members further comprises swivel means for joining said gripping means to said continuous chain means such that said gripping means may be selectively oriented throughout a range of directions relative to said chain means while said chain means is so propelled about said wheel means.

13. Apparatus as defined in claim 10 wherein said gripping means comprises a first gripping assembly including means for engaging such pipe members and transmitting force thereto in one longitudinal direction sense of such pipe members, and a second gripping assembly including means for engaging such pipe members and transmitting force thereto in the opposite longitudinal direction sense of such pipe members.

14. Apparatus as defined in claim 13 wherein each of said first and second gripping assemblies is independently, selectively operable to grip and release pipe members.

15. Apparatus as defined in claim 10 wherein said gripping means further comprises slip means mounted on at least two members so movable by operation of said propulsion means between said extended configuration and said retracted configuration.

16. Apparatus as defined in claim 10 wherein:

a. said continuous chain means comprises two closed chain loops;

b. said wheel means comprises a first sheave assembly positioned generally toward said first end of said mast means, and a second sheave assembly positioned along said mast means generally in the opposite direction relative to said first sheave assembly; and c. said power means comprises motor means for connecting to said first sheave assembly whereby said power means is selectively operable to propel said first sheave assembly in said first or second rotational sense.

17. Apparatus as defined in claim 16 wherein:

a. said continuous chain means further comprises drive chain means;

b. said wheel means further comprises a drive wheel assembly whereby said drive chain means is connected to said motor means; and c. said drive chain means is connected to said two closed chain loops by said first sheave assembly.

* * * * *